US011713585B2

(12) United States Patent
Vogtner et al.

(10) Patent No.: US 11,713,585 B2
(45) Date of Patent: Aug. 1, 2023

(54) LOW PROFILE SPA JET ASSEMBLIES AND METHOD

(71) Applicant: Custom Molded Products, LLC, Newnan, GA (US)

(72) Inventors: Zachary T. Vogtner, Fayetteville, GA (US); Victor L. Walker, Temecula, CA (US)

(73) Assignee: Custom Molded Products, LLC, Newnan, GA (US)

( * ) Notice: Subject to any disclaimer, the term of this patent is extended or adjusted under 35 U.S.C. 154(b) by 0 days.

(21) Appl. No.: 17/522,307

(22) Filed: Nov. 9, 2021

(65) Prior Publication Data

US 2022/0145653 A1 May 12, 2022

Related U.S. Application Data

(60) Provisional application No. 63/111,397, filed on Nov. 9, 2020.

(51) Int. Cl.
*E04H 4/14* (2006.01)

(52) U.S. Cl.
CPC ..... *E04H 4/14* (2013.01)

(58) Field of Classification Search
CPC ..... E04H 4/14
USPC ..... 4/496, 488
See application file for complete search history.

(56) References Cited

U.S. PATENT DOCUMENTS

| | | | | |
|---|---|---|---|---|
| 4,592,100 | A * | 6/1986 | Robertson | A61H 33/60 4/488 |
| 5,738,638 | A * | 4/1998 | Henkin | A61H 33/601 601/169 |
| 6,123,274 | A * | 9/2000 | Perdreau | A61H 33/6052 239/587.3 |
| 8,978,174 | B2 | 3/2015 | Drury | |
| 9,719,667 | B2 | 8/2017 | Drury | |
| 10,422,149 | B1 * | 9/2019 | Krombein | E04H 4/169 |
| 10,611,008 | B2 | 4/2020 | Pugliese | |

* cited by examiner

*Primary Examiner* — Lori L Baker
(74) *Attorney, Agent, or Firm* — Laurence P. Colton; Smith Tempel Blaha LLC

(57) ABSTRACT

A low profile spa jet having a structure allowing for the use of a jet housing for both threaded/nut and grommet installation, wherein the jet protrudes into the spa tub less than 0.5". The low profile spa jet also can have a jet face/flange that is interchangeable between threaded and grommet jet bodies without changing the relationship to the spa wall, wherein the jet protrudes the same amount in the installed state for both styles of jet body. The low profile spa jet also can have a jet face/flange that is removable and/or interchangeable before and after the jet body and jet internal are installed in the spa.

24 Claims, 45 Drawing Sheets

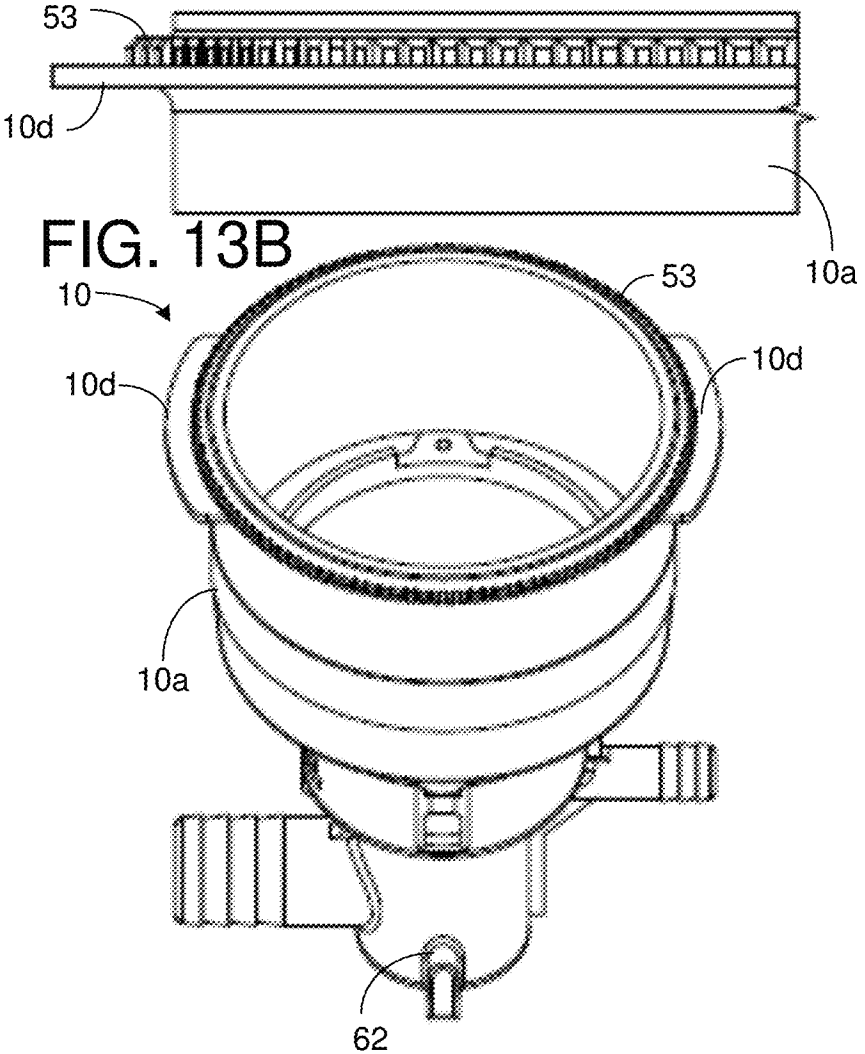
FIG. 13B
FIG. 13A
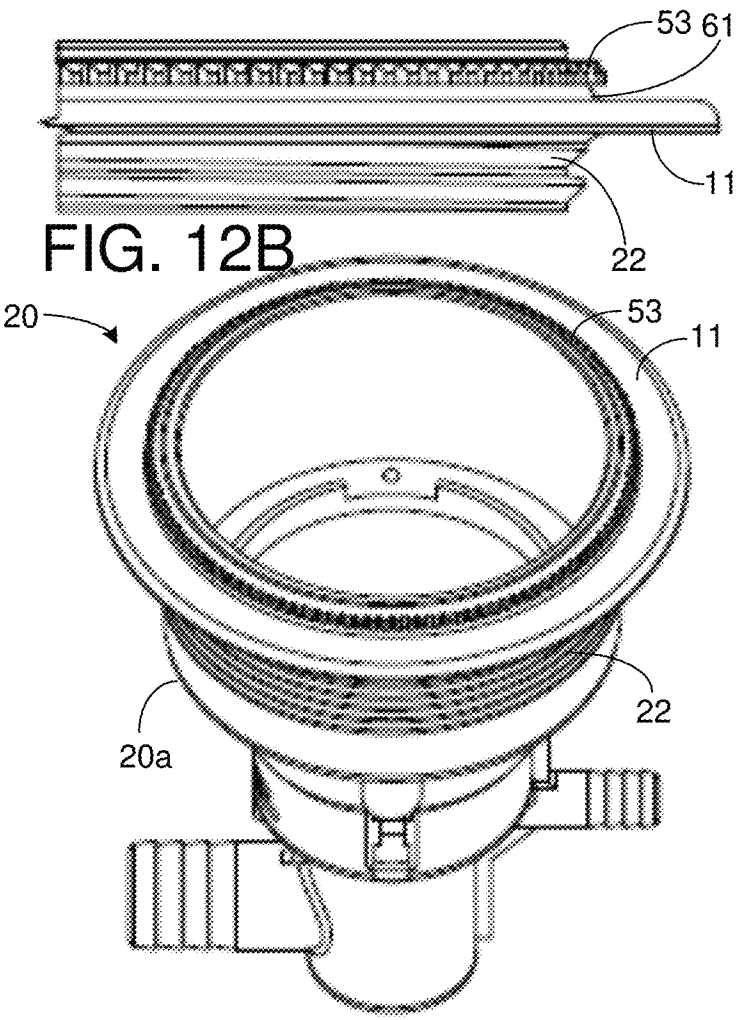
FIG. 12B
FIG. 12A

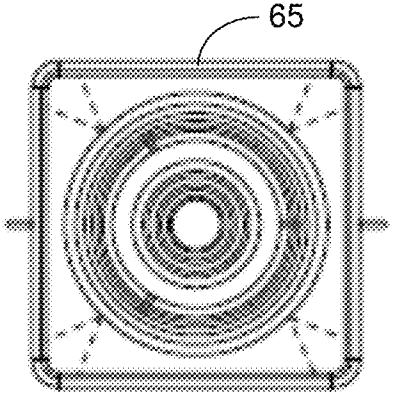
FIG. 14
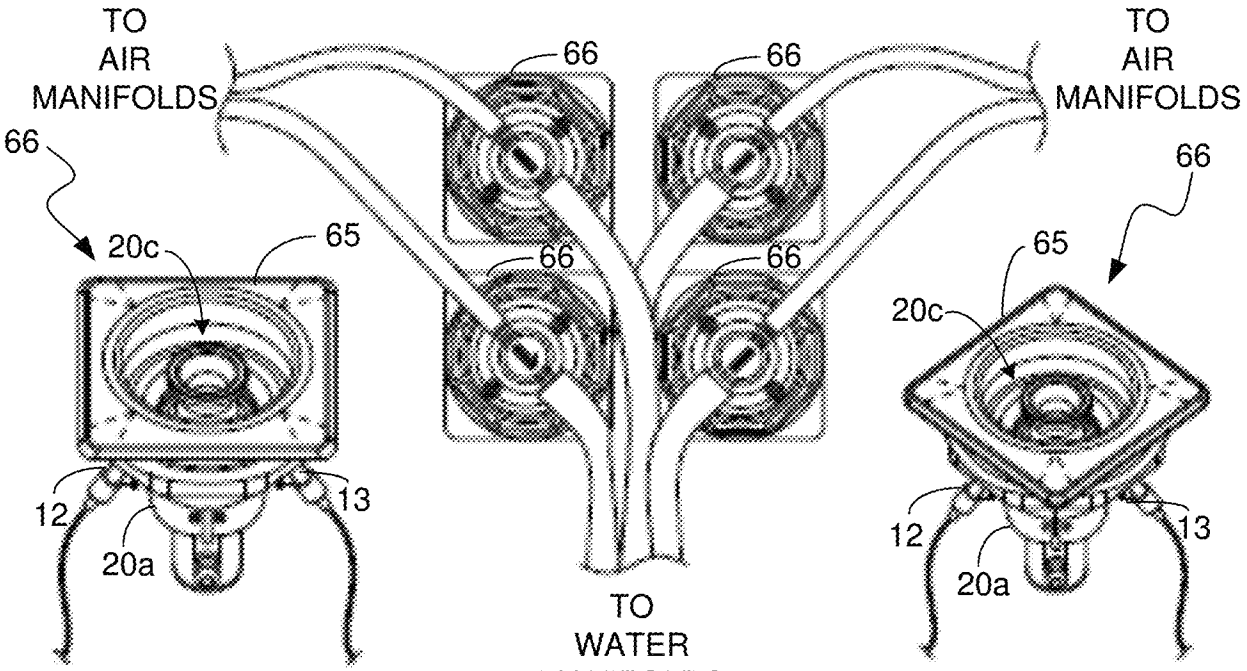
FIG. 15
FIG. 16
FIG. 17

LOW PROFILE SPA JET ASSEMBLIES AND METHOD

CROSS-REFERENCE TO RELATED APPLICATIONS

The present application is a nonprovisional application claiming priority to and the benefit of the filing date of U.S. provisional application Ser. No. 63/111,397, filed on Nov. 9, 2020, entitled "LOW PROFILE SPA JET", which is incorporated by reference herein.

BACKGROUND OF THE INVENTION

Technical Field

The present disclosure is directed generally to water jet fixtures for use in spas, pools, jacuzzis, and the like. The present disclosure is directed more specifically to lower and low profile water jet fixtures that protrude a smaller or lesser distance into the tub.

Prior Art

Artificial water structures, such as conventional hot tubs, spas, and jetted bath tubs, as well as whirlpool baths, swimming pools, and the like, hereinafter referred to and defined as "spas", comprise various components and features, such as jets. In the most common embodiments, jets for spas inject water together with air, if desired, against the bodies of users usually partially immersed therein. Such jets allow the users to control the water or aerated water input to the spa.

Spas are generally constructed in a variety of materials and methods. Initially, stand-alone spas were made by pool contractors and such by digging a hole in the ground and installing rebar, plumbing, electrical components, and other items. The rebar was then covered with cement, gunite, or other similar materials. A variety of interior finishes, including plaster, tile, and pebble coat finishes are available. The materials are very expensive and produce a product that is generally immobile. Some spas, including those integrated with swimming pools are still constructed this way.

In the early 1970s, the portable hot tub or spa came into being. The first examples were made from wood, which was shaped and fashioned into a circle and surrounded by bands of steel to maintain the circular shape. The installer would then wet the wood for some time, allowing the wood to expand to seal the joint to prevent leaks. At this time, due to the construction method, there were limited choices for consumers in regards to the lighting options of these hot tubs. Most designs only offered one incandescent light in the bottom of the spa, mainly for safety reasons. These first spas were improved upon by the addition of seating and through-wall jets that would provide massage action using water circulated through a pump.

Newer spas with multiple jets became popular and as a result produced a demand for improved methods of manufacturing spas. Such methods use gel-coat and fiberglass to create a vessel to hold the water, which in turn allowed for the addition of more hydrotherapy jets. These new spas also were enclosed in a housing, or skirt, which made it possible to leave the spa sitting above ground.

"Portable" spas evolved with the advent of single sheet thermoforming manufacturing. This method uses a single sheet of plastic which is formed into a female mold, removed from the mold, and reinforced using a variety of different materials, such as high density polyurethane, polyester-based resin, fiberglass, or epoxy.

Current spa tubs are generally relatively deep vacuum formed tubs having a smooth acrylic interior surface and a relatively rougher fiberglass back. The spa tubs are provided with a number of fixtures, including water jet assemblies. The appeal of a spa tub is primarily due to the hydrotherapy provided by the number of pressurized water jets recessed into the tub wall, which provide a massaging action. Spa jets are typically recessed in the tub wall to minimize the distance that the jet face protrudes beyond the wall surface in order to optimize bather comfort, to prevent clothing and the like from becoming snagged, and to prevent damage to the spa jets. In particular, each hydrotherapy jet assembly is connected to a pressurized water supply and an air supply. The pressurized water flows through a hydrotherapy jet assembly having a nozzle. As the water flows through the nozzle, air is drawn from an inlet into a low pressure area and mixes with the water. The mixture of pressurized water and air thereby provide an aerated therapeutic jet of water.

One well-known prior art hydrotherapy jet assembly fixture includes four components: a wall fitting, a gasket, a jet valve body, and caulk. Another well-known prior art hydrotherapy jet assembly fixture includes a jet body, a jet internal assembly, a gasket, and a nut. Yet another well-known prior art hydrotherapy jet assembly fixture includes a jet body, a jet internal assembly, and a grommet.

Other prior art in the spa industry include various types of water jets, water features, devices for attaching fixtures to spas, devices for lighting spas, such as U.S. Pat. No. 9,719,667 for spa jet lighting clips for attaching LED to jet housings, U.S. Pat. No. 8,978,174 for a mechanism for holding the jet internal/nozzle assembly in the jet body, U.S. Pat. No. 10,611,008 for grommet jet installation tools.

With regard to water jet installation methods, there are different methods depending on the type of jet fitting. To install a jet assembly consisting of a wall fitting, a gasket, a jet valve body, and caulk, a hole is first drilled in the tub from the inside of the tub through to the back of the tub at the desired location of the fixture. Next, the back of the tub surrounding the drill site must be ground smooth, flat, and parallel to the interior of the tub. This grinding is done by eye and introduces a margin for potential error into the installation. Newer hole saw bits are available that allow for this hole to be cut from the back side through to the interior of the tub, and include grinding discs that can grind the wall around the hole all in one step. The gasket is placed onto the wall fitting, and the wall fitting is inserted through the drilled hole from the interior of the tub, such that the gasket is between the wall fitting and the interior surface of the tub. The jet valve body is then attached to the portion of the wall fitting exiting the back of the tub. However, as the tubs are relatively deep, two persons are required to install the fixture in the tub; one person holds the wall fitting stationary from the interior of the tub, while the other person threads the jet valve body onto the wall fitting from the back of the tub such that the wall fitting and the jet valve body sandwich the tub wall. A bead of caulk seals the jet valve body to the back of the tub wall. The jet assembly is then connected to a water conduit and an air conduit.

To install a jet assembly consisting of a jet body, a jet internal assembly, a gasket and a nut, a hole is first drilled in the tub wall from the inside of the tub through to the back of the tub at the desired location of the fixture. Next the back of the tub surrounding the drill site must be ground smooth, flat, and parallel to the interior of the tub. This grinding is done by eye and introduces a margin for potential error into the installation. Newer hole saw bits are available that allow for this hole to be cut from the back side through to the interior of the tub, and include grinding discs that can grind the wall around the hole all in one step. The gasket is placed onto the jet body, and the jet body is inserted through the drilled hole from the interior of the tub, such that the gasket is between the jet body flange and the interior surface of the tub. The nut is then attached to the portion of the jet body exiting the back of the tub. However, as the tubs are relatively deep, two persons are required to install the fixture in the tub. One person holds the jet body stationary from the interior of the tub, while the other person threads the nut onto the jet body from the back of the tub such that they sandwich the tub wall. A bead of caulk may be used to further seal the jet body to the tub wall. The jet assembly is then connected to a water conduit and an air conduit. Finally, the jet internal assembly is installed into the jet body. The jet internal assembly typically consists of a decorative flange to hide the jet body flange, a nozzle assembly, and a diffuser, which may include a mechanism to turn on or turn off the flow of water and/or air to the jet.

To install a jet assembly consisting of a jet body, a jet internal assembly, and a grommet, a hole is first drilled in the tub wall from the inside of the tub through to the back of the tub, or from the back of the tub to the interior of the tub, at the desired location of the fixture. The grommet is inserted through the drilled hole from the interior of the tub, such that the grommet flange is contacting the interior surface of the tub. The jet body is then pushed through the grommet from the interior side of the tub and/or pulled through the grommet from the back of the tub such that the jet body flange is contacting the grommet flange. To aid in this installation, the installer may use a rubber mallet, tamp for hammer, slide hammer, or other tool from the interior of the tub and/or a pulling device from the back of the tub to push/pull the jet body into position. Likewise, a lubricant may be used on the inside of the grommet, the outside of the jet body, or both. Once the grommet and jet body are seated, the jet assembly is then connected to a water conduit and an air conduit. Finally, the jet internal assembly is installed into the jet body. The jet internal assembly typically consists of a decorative flange to hide the jet body flange and grommet flange, a nozzle assembly, and a diffuser, which may include a mechanism to turn on or turn off the flow of water and/or air to the jet.

In contrast to the installation methods discussed above, with the increased ease of installation, grommet-style jets typically require only one installer to install this type of jet and can be installed more quickly than other types of jets. These are just some of the reasons why this type of jet assembly is becoming more and more popular amongst hot tub manufacturers. Another reason for the popularity of grommet-style jets is that they do not require the use of secondary sealants such as caulk or silicone. Yet another reason is that this type of jet assembly has fewer components. However, due to the installation process, the grommet and jet body must each have a flange substantially wide enough and thick enough to prevent the components from squeezing through the mounting hole as the installation forces are applied. The stack-up of these flanges can make it more challenging to minimize the overall jet height, namely, the distance the jet protrudes from the spa wall. Additionally, it is not uncommon for a spa manufacturer to use both grommet-style fittings and threaded/nut-style fittings together in the same spa. It would be advantageous for each of the grommet and nut type fittings to have a consistent height (or depth) dimension from the spa wall after installation.

As the industry has continued to grow, spa features have also continued to evolve. In the pool and spa industry, for example, lighting has taken on an increasingly significant role. Early hot tubs used incandescent lights to illuminate the hot tub for safety. These early incandescent lights did not allow for convenient color changing and the bulb life was short. The lights used plastic colored lenses to change the light color (e.g., red or blue) but were not user friendly and were difficult to store and install. The incandescent lights used colored lens covers which were mounted to the light in an area located underwater. Because of the light location, removing and exchanging the lens was difficult and time consuming. The lenses were also only available in a few colors so consumers had few aesthetic options to choose from. Furthermore, the lights did not offer any accent or ambiance lighting characteristics and were mainly designed to light the bottom foot area of the hot tub for safety reasons.

Soon thereafter, fiber optic lighting became popular and consumers had more colors and features to choose from. New light features included, but were not limited to, bar top lighting and control lighting. Fiber optic systems also allowed for some accent lighting features in the spas, but the fiber optic systems were also very labor intensive to install/manufacture and very difficult to fix once the product is placed in its final location.

Due to the continuing rise in popularity of lighting in water containment vessels, and particularly in spas, accent lighting continues to evolve. The newest trend in lighting appeared with the advent of light emitting diodes (LED lights). LED lights are durable, low cost, high-illumination, high-efficiency lights that are easily adaptable to the spa industry. LED lights have a major cost advantage over fiber optic systems and are also more reliable. As a result, many spa fittings have been adapted to receive LEDs for lighting purposes. The LEDs may be incorporated into a spa fitting by integrated ports, snap-on clips, attached by adhesive, or by other means known in the art.

One such spa fitting that can benefit from the addition of lighting is the spa jet. Typically, spa jets are illuminated by attaching a light source to a transparent or translucent jet body. The lights are typically attached to the outside of the jet body on the dry side of the tub wall and therefore are more easily accessible through the spa skirt/cabinet/paneling if a light should need to be replaced. In application, the jet body flange is typically covered by a jet internal assembly, a decorative flange or faceplate made of plastic and/or metal attached to a plastic nozzle structure. Portions of the nozzle or nozzle structure are made of transparent or translucent material and allow the light to transmit into the water stream. When the water stream is aerated, it can produce a brighter and more dynamic light display. However, when the water is not flowing, or if the water stream is not aerated, the lighting effect becomes a single static point of light in the center of the jet.

What is needed in the art is a method, design, and construct of a low profile spa jet for use in connection with spas. It is to such methods, designs, and constructs, and others, that preferred embodiments of the present disclosure are directed.

BRIEF SUMMARY OF THE INVENTION

It is a goal of the present disclosure to provide a low profile jet for both grommet and nut type installations while achieving the same finished height (depth) from the spa wall surface after installation. When mounted side by side in the spa, one could not easily tell the difference between the two.

As mentioned above, jets are typically recessed into pockets molded into the spa wall. However, molding these pockets limits how many different jet configurations are possible for each molded shell. Jets can only install into the designated locations (e.g., the recessed pockets), and it would be unsightly to leave a jet pocket blank (without a jet).

If the spa jet were made to be low profile enough to eliminate the need for these recessed pockets, then the jets could be installed anywhere in the molded tub without the need for recessed pockets. In this way, a spa manufacturer could use the same molded shell to create multiple finished spa configurations. For example, the spa manufacturer could produce a spa with twenty jets, a spa with forty jets, and a spa with sixty jets from the same molded shell thereby creating multiple spa models with the same molded shell.

A further advantage of a low profile jet is that it improves bather comfort, both with water and without water. Typically, consumers are reluctant to "wet test" spas as they are shopping. That is to say, consumers rarely change into a bathing suit in the spa showroom to test out a spa with water in the tub. More commonly, a consumer will do a "dry test", meaning they will get into the spa without water wearing their clothes. When the spa is full of water the human body becomes buoyant and there is less body weight applied against the spa jets or other features in the spa. However, when sitting in a spa without water there is no buoyancy to take body weight off of the jets or any other features protruding from the spa wall. A low profile jet will be more comfortable in a "dry test" as it will not protrude as far from the spa wall.

To achieve optimum "dry test" comfort, some spa manufacturers may still choose to recess the low profile jets so that none of the jet protrudes beyond the recessed pocket. Yet another advantage of a low profile jet is that a shallower pocket is required to make the jet face completely flush with the spa wall. A shallower pocket is easier to mold and requires less draft. This can allow for more complex and precise pocket shapes.

Briefly, the invention includes a low-profile jet for both threaded/nut and grommet installation, wherein the jet protrudes into the spa tub less than 0.5". In exemplary embodiments, the jet face/flange is interchangeable between threaded and grommet jet bodies without changing the relationship to the spa wall, namely, the jet protrudes the same amount in the installed state for both styles of jet body. For example, it is contemplated that one cannot tell the difference between a threaded jet and a grommet jet of the present disclosure when the jets are mounted side-by-side.

The inventive jet face/flange is removable and/or interchangeable before and after the jet body and jet internal are installed in the spa. The jet internals and the nozzle assembly stay in the jet body when the face/flange is removed, however, the jet internals and the nozzle assembly also can be removed and interchanged independently from the jet face/flange.

The inventive jet face/flange can be clocked/turned/rotated at various increments along the jet body circumference for various orientations relative to water and air inlets. For one example, the jet face/flange can be clocked in <90 degree increments, such as in preferably <10 degree increments. In an exemplary embodiment of the current design, a 3" version and a 5" version of the jet can have 4.5 degree increments along >45 degrees of the jet body circumference, and preferably between 45 degrees and 135 degrees of the jet body circumference, and more preferably between 45 degrees and 90 degrees of the jet body circumference. For another example, a 3" version of the jet is adjustable along 108 degrees of the jet body circumferences. For yet another example, a 5" version of the jet is adjustable along 135 degrees of the jet body circumference.

It is another goal of the present disclosure is to provide light to the transparent or translucent jet body flange or grommet flange for a low profile jet leaving a portion, or portions, of the lighted flange exposed to create unique and interesting accent lighting shapes and effects.

In other exemplary embodiments of the invention, a light ring and/or accent lighting can be built into the jet body. Such a light ring and/or accent lighting can be used for lighting a portion or portions of the jet that are visible from inside the spa (wet side) when the jet assembly is installed in the spa (mainly the jet body flange). Generally, the light source/s for illuminating the light ring and/or accent lighting is/are located on the dry side of the spa wall.

This summary is provided to introduce a selection of concepts that are further described below in the detailed description. This summary is not intended to identify key or essential features of the claimed subject matter, nor is it intended to be used as an aid in limiting the scope of the claimed subject matter.

These features, and other features and advantages of the present disclosure will become more apparent to those of ordinary skill in the relevant art when the following detailed description of the preferred embodiments is read in conjunction with the appended drawings in which like reference numerals represent like components throughout the several views.

BRIEF DESCRIPTION OF THE DRAWINGS

The example, representative or preferred embodiments are best understood from the following detailed description when read with the accompanying drawing figures. It should be noted that the various features shown in the drawings are not necessarily drawn to scale. In fact, the dimensions may be arbitrarily increased or decreased for clarity of discussion.

FIG. 8B also shows the jet face/flange assembly shown in FIG. 1 ready to be attached to the jet housing in accordance with a representative embodiment.

In FIG. 10B, one of the key features of the clock/turning/rotating feature of the jet face/flange assembly is shown engaged with the gap between two adjacent teeth of the counterpart clock/turning/rotating feature of the jet housing flange to lock the jet face/flange assembly in position relative to the circumference of the jet housing.

FIGS. 12A and 13A show top perspective views of the grommet style and threaded/nut style spa jet assemblies shown in FIGS. 4 and 5, respectively, with the jet face/flange assemblies removed to show the circumferentially arranged teeth of the counterpart clock/turning/rotating feature disposed on the respective jet housing flanges 11 in accordance with a representative embodiment.

FIGS. 12B and 13B show side plan views of upper portions of the spa jet assemblies shown in FIGS. 12A and 13A, respectively, in accordance with a representative embodiment.

FIG. 14 shows a top plan view of a rectangular jet face/flange assembly that can be used with the grommet style and threaded/nut style jet spa assemblies shown in FIGS. 4 and 5, respectively, in accordance with a representative embodiment.

FIG. 15 shows a top perspective view of the threaded/nut style jet spa assembly shown in FIG. 5 with the rectangular jet face/flange assembly shown in FIG. 14 attached thereto in accordance with a representative embodiment, where the rectangular jet face/flange assembly is aligned with the plumbing of the jet spa assembly.

FIG. 16 shows a top perspective view of the threaded/nut style jet spa assembly shown in FIG. 5 with the rectangular jet face/flange assembly shown in FIG. 14 attached thereto in accordance with a representative embodiment, where the rectangular jet face/flange assembly is at a 45° angle to the plumbing of the jet spa assembly.

FIG. 17 shows a front plan view of a simulated grouping of four of the jet spa assemblies shown in FIG. 16 with their plumbing connected to respective water and air manifolds.

DETAILED DESCRIPTION OF PREFERRED EMBODIMENTS

Figure 1:
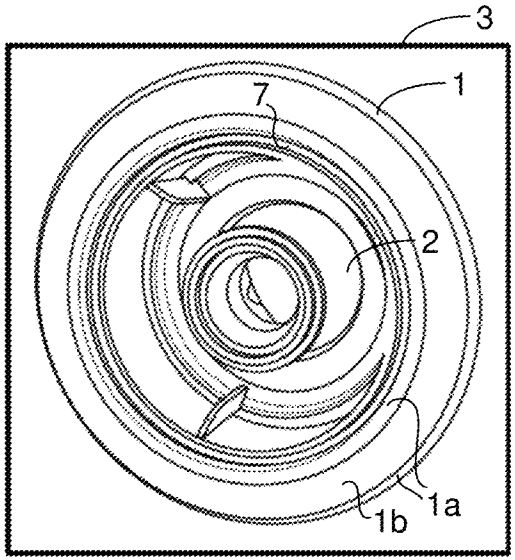
FIG. 1 illustrates a front perspective view of a jet face/flange assembly of a spa jet assembly having a directional nozzle configuration as mounted on a spa wall in accordance with a representative embodiment of the present disclosure.

Reference will now be made in detail to the preferred or representative embodiments of the invention, examples of which are illustrated in the accompanying drawings. While the invention will be described in conjunction with the preferred or representative embodiments, it will be understood that they are not intended to limit the invention to those embodiments. On the contrary, the invention is intended to cover alternatives, modifications, and equivalents, which may be included within the spirit and scope of the invention as defined by the appended claims.

It is a goal of the present disclosure to provide a low profile jet for both grommet and nut type installations while achieving the same finished height (depth) from the spa wall surface after installation. When mounted side by side in the spa one could not easily tell the difference between the two.

As mentioned above, jets are typically recessed into pockets molded into the spa wall. However, molding these pockets limits how many different jet configurations are possible for each molded shell. Jets can only install into the designated locations (e.g., the recessed pockets), and it would be unsightly to leave a jet pocket blank (without a jet).

If the spa jet were made to be low profile enough to eliminate the need for these recessed pockets, then the jets could be installed anywhere in the molded tub without the need for recessed pockets. In this way, a spa manufacturer could use the same molded shell to create multiple finished spa configurations. For example, the spa manufacturer could produce a spa with twenty jets, a spa with forty jets, and a spa with sixty jets from the same molded shell thereby creating multiple spa models with the same molded shell.

A further advantage of a low profile jet is that it improves bather comfort, both with water and without water. Typically, consumers are reluctant to "wet test" spas as they are shopping. That is to say, consumers rarely change into a bathing suit in the spa showroom to test out a spa with water in the tub. More commonly, a consumer will do a "dry test", meaning they will get into the spa without water wearing their clothes. When the spa is full of water the human body becomes buoyant and there is less body weight applied against the spa jets or other features in the spa. However, when sitting in a spa without water there is no buoyancy to take body weight off of the jets or any other features protruding from the spa wall. A low profile jet will be more comfortable in a "dry test" as it will not protrude as far from the spa wall.

To achieve optimum "dry test" comfort, some spa manufacturers may still choose to recess the low profile jets so that none of the jet protrudes beyond the recessed pocket. Yet another advantage of a low profile jet is that a smaller pocket is required to make the jet face completely flush with the spa wall. A shallower pocket is easier to mold and requires less draft. This can allow for more complex and precise pocket shapes.

Briefly, the invention includes a low-profile jet for both threaded/nut and grommet installation, wherein the jet protrudes into the spa tub less than 0.5". In exemplary embodiments, the jet face/flange is interchangeable between threaded and grommet jet bodies without changing the relationship to the spa wall, namely, the jet protrudes the same amount in the installed state for both styles of jet body. For example, it is contemplated that one cannot tell the difference between a threaded jet and a grommet jet of the present disclosure when the jets are mounted side-by-side.

The inventive jet face/flange is removable and/or interchangeable before and after the jet body and jet internal are installed in the spa. The jet internals and the nozzle assembly stays in the jet body when the face/flange is removed, however, the jet internals and the nozzle assembly also can be removed and interchanged independently from the jet face/flange.

The inventive jet face/flange can be clocked/turned/rotated at various increments along the jet body circumference for various orientations relative to water and air inlets. For one example, the jet face/flange can be clocked in <90 degree increments, such as in preferably <10 degree increments. In an exemplary embodiment of the current design, a 3" version and a 5" version of the jet can have 4.5 degree increments along >45 degrees of the jet body circumference, and preferably between 45 degrees and 135 degrees of the jet body circumference, and more preferably between 45 degrees and 90 degrees of the jet body circumference. For another example, a 3" version of the jet is adjustable along 108 degrees of the jet body circumferences. For yet another example, a 5" version of the jet is adjustable along 135 degrees of the jet body circumference.

It is another goal of the present disclosure is to provide light to the transparent or translucent jet body flange or grommet flange for a low profile jet leaving a portion, or portions, of the lighted flange exposed to create unique and interesting accent lighting shapes and effects.

In other exemplary embodiments of the invention, a light ring and/or accent lighting can be built into the jet body. Such a light ring and/or accent lighting can be used for lighting a portion or portions of the jet that are visible from inside the spa (wet side) when the jet assembly is installed in the spa (mainly the jet body flange). Generally, the light source/s for illuminating the light ring and/or accent lighting is/are located on the dry side of the spa wall.

In the following detailed description, a few exemplary, or representative, embodiments are described to demonstrate the inventive principles and concepts. For purposes of explanation and not limitation, representative embodiments disclosing specific details are set forth in order to provide a thorough understanding of an embodiment according to the present disclosure. However, it will be apparent to one having ordinary skill in the art having the benefit of the present disclosure that other embodiments that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present disclosure.

The terminology used herein is for purposes of describing particular embodiments only, and is not intended to be limiting. The defined terms are in addition to the technical and scientific meanings of the defined terms as commonly understood and accepted in the technical field of the present teachings.

As used in the specification and appended claims, the terms "a", "an", and "the" include both singular and plural referents, unless the context clearly dictates otherwise. Thus, for example, "a device" includes one device and plural devices.

Relative terms may be used to describe the various elements' relationships to one another, as illustrated in the accompanying drawings. These relative terms are intended to encompass different orientations of the device and/or elements in addition to the orientation depicted in the drawings. For example, terms such as "over", "above", "below", "top", "bottom", "upper", and "lower" may be used to describe the various elements' relationships to one another, as illustrated in the accompanying drawings. These relative terms are intended to encompass different orientations of the device and/or elements in addition to the orientation depicted in the drawings. For example, if the device were inverted with respect to the view in the drawings, an element described as "above" another element, for example, would now be below that element.

The terms "substantial" or "substantially" mean to within acceptable limits or degrees acceptable to those of skill in the art. For example, the term "substantially parallel to" means that a structure or device may not be made perfectly parallel to some other structure or device due to tolerances or imperfections in the process by which the structures or devices are made. The term "approximately" means to within an acceptable limit or amount to one of ordinary skill in the art.

Where a first device is said to be connected or coupled to a second device, this encompasses examples where one or more intermediate devices may be employed to connect the two devices to each other. In contrast, where a first device is said to be directly connected or directly coupled to a second device, this encompasses examples where the two devices are connected together without any intervening devices other than electrical connectors (e.g., wires, bonding materials, etc.).

Exemplary, representative or preferred embodiments will now be described with reference to the figures, in which like reference numerals represent like components, elements or features. It should be noted that features, elements or components in the figures are not intended to be drawn to scale, emphasis being placed instead on demonstrating inventive principles and concepts.

Figure 2:
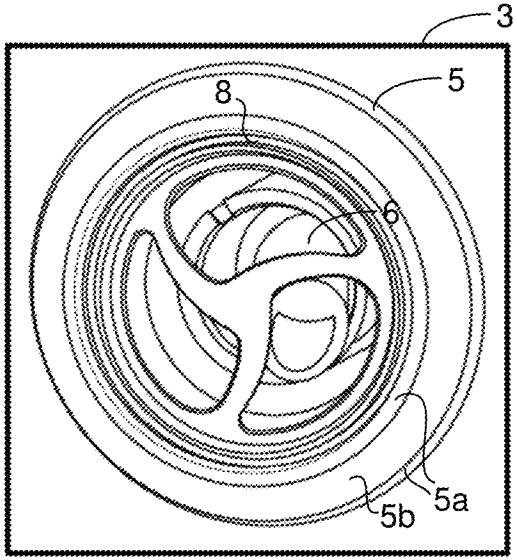
FIG. 2 illustrates a front perspective view of a jet face/flange assembly of the spa jet assembly having a bearingless roto nozzle configuration as mounted on a spa wall in accordance with another representative embodiment of the present disclosure.
Figure 3:
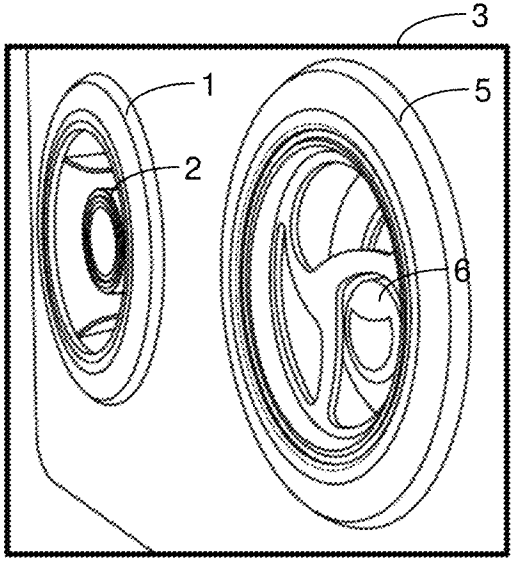
FIG. 3 illustrates front perspective views of the jet face/flange assemblies shown in FIGS. 1 and 2 as mounted on a spa wall in accordance with another representative embodiment of the present disclosure.

FIGS. 1-3 illustrate several jet faces/flange assemblies 1-3, respectively, as mounted on a spa wall 3 using one or more methods of the present disclosure. FIG. 1 illustrates a front perspective view of a jet face/flange assembly 1 of a spa jet assembly having a directional nozzle configuration 2 as mounted on a spa wall 3 in accordance with a representative embodiment of the present disclosure. FIG. 2 illustrates a front perspective view of a jet face/flange assembly 5 of the spa jet assembly having a bearingless rotational (roto) nozzle configuration 6 as mounted on a spa wall 3 in accordance with another representative embodiment of the present disclosure. FIG. 3 illustrates a front perspective view of the jet face/flange assemblies 1 and 5 shown in FIGS. 1 and 2, respectively, as mounted on a spa wall 3 in accordance with another representative embodiment of the present disclosure.

As can be seen, the jet faces/flange assemblies 1 and 5 extend from the spa wall 3 only a relatively small distance, thus showing the low profile aspect of the present disclosure. The spa jet assembly comprising the jet face/flange assembly 1 shown in FIG. 1 comprises a low profile directional nozzle configuration 2 and the spa jet assembly comprising the jet face/flange assembly 5 comprises a bearingless roto nozzle configuration 6. FIG. 3 shows both of the jet face/flange assemblies 1 and 5 mounted side by side on the spa wall 3.

As will be described below in more detail, even though the jet face/flange assemblies 1 and 2 are very different and have different nozzle configurations, they preferably are constructed to ensure that they extend substantially equal distances away from the spa wall 3 when they are in their installed states. It should be noted that the inventive principles and concepts are not limited to the jet face/flange assemblies having any particular designs or configurations, as will be understood by those of skill in the art in view of the description provided herein.

As will be described below in more detail, the jet face/flange assemblies 1 and 5 are removable and/or interchangeable before and after the jet housing (not shown) and the jet internal assembly (not shown) are installed in the spa wall 3. For example, with reference to FIG. 3, jet face/flange assembly 1 can be removed and replaced with another instance of the jet face/flange assembly 5 so that the jet face/flange assemblies match one another, and this is true regardless of the fact that the respective spa jet assemblies have different nozzle configurations 2 and 6. The jet internal assemblies, which comprise the nozzle configurations 2 and 6, can stay in the respective jet housings when the jet face/flange assemblies 1 and 5 are removed. In addition, the jet internal assemblies also can be removed and interchanged independently from the respective jet face/flange assemblies 1 and 5.

In accordance with a preferred embodiment, jet face/flange assembly 1 comprises a flange 1*a* and a stainless steel (SS) escutcheon 1*b* and jet face/flange 5 comprises a flange 5*a* and a SS escutcheon 5*b*. In accordance with the embodiment depicted in FIGS. 1-3, portions 7 and 8 of the respective jet housings of the spa jet assemblies comprising the jet face/flange assemblies 1 and 5, respectively, are exposed, i.e., are not covered by the jet face/flange assemblies 1 and 5, and are translucent to allow light emitted by one or more LEDs (not shown) located on the dry side of the spa wall 3 to pass through the exposed portions 7 and 8 to be visible to the spa users.

Figure 5:
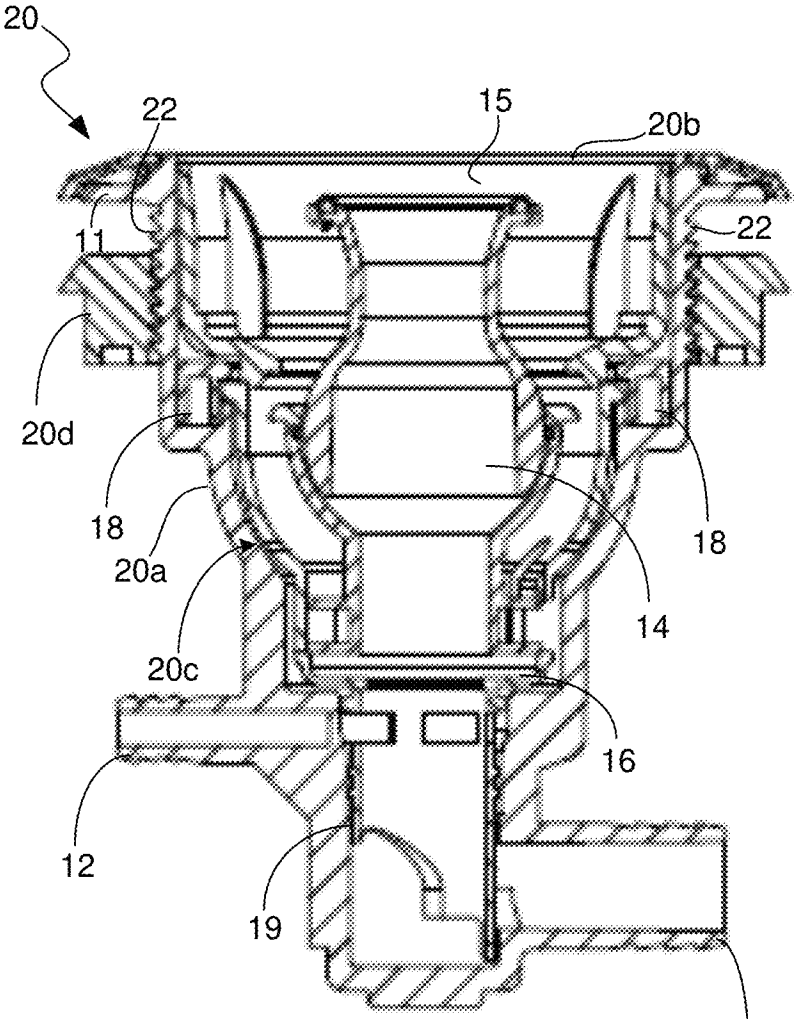
FIG. 5 is a cross-sectional view of a threaded/nut style spa jet assembly in accordance with a representative embodiment.
Figure 4:
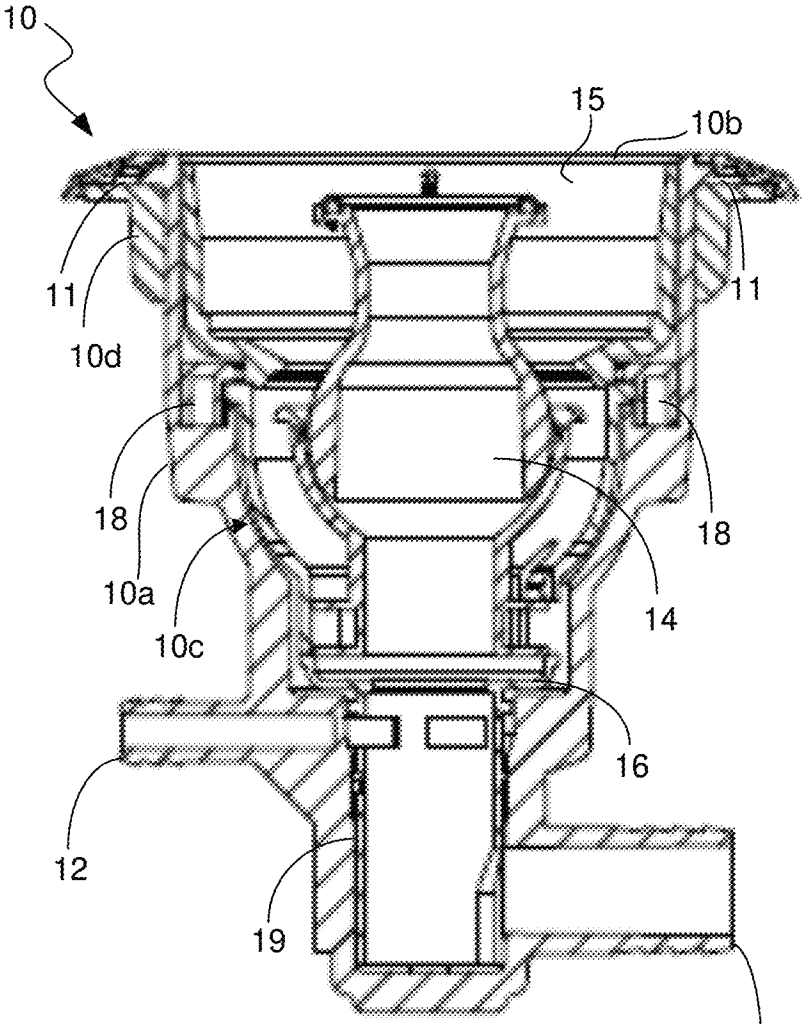
FIG. 4 is a side cross-sectional view of a grommet style spa jet assembly in accordance with a representative embodiment.

The spa jet assembly can have different spa wall interface configurations for removably coupling the jet housing to the spa wall. In accordance with one representative embodiment, the spa wall interface comprises a grommet. In accordance with another representative embodiment, the spa wall interface comprises a threaded/nut configuration. FIG. 4 is a side cross-sectional view of a low profile spa jet assembly 10 in accordance with a representative embodiment in which the spa wall interface comprises a grommet. Low profile spa jet assemblies described herein in which the spa wall interface comprises a grommet are referred to herein as grommet style spa jet assemblies. FIG. 5 is a side cross-sectional view of a low profile spa jet assembly 20 in accordance with a representative embodiment in which the spa wall interface comprises a threaded/nut configuration. Low profile spa jet assemblies described herein in which the spa wall interface comprises a threaded/nut configuration are referred to herein as threaded/nut style spa jet assemblies.

FIGS. 4 and 5 show the complete spa jet assemblies 10 and 20, respectively, including the jet housings 10*a* and 20*a*, respectively, jet face/flange assemblies 10*b* and 20*b*, respectively, and jet internal assemblies 10*c* and 20*c*, respectively. The grommet style spa jet assembly 10 also includes a grommet 10*d*. The threaded/nut style spa jet assembly 20 also includes a threaded nut 20*d*.

The jet face/flange assembly 10*b* can be, for example, one of the jet face/flange assemblies 1 or 5 shown in FIGS. 1 and 2, respectively. Likewise, the jet face/flange assembly 20*b* can be, for example, one of the jet face/flange assemblies 1 or 5 shown in FIGS. 1 and 2, respectively. Various embodiments of coupling features of the jet face/flange assemblies 10*b* and 20*b* and of the jet housings 10*a* and 20*a* that are suitable for removably securing the jet face/flange assemblies 10*b* and 20*b* to the jet housings 10*a* and 20*a*, respectively, are described below in more detail.

With reference to FIG. 4, the jet housing 10*a* has an internal region that is adapted to receive and house the jet internal assembly 10*c*, a jet housing flange 11, an air connection 12, and a water connection 13. The jet internal assembly 10*c* includes a nozzle configuration 14, a jet barrel 15, and a diffuser 16, which interfaces with air connection 12 and the water connection 13 of the jet housing 10*a*. The assembly 10 can also include a locking ring 18 and an O-ring 19 for positioning and securing the jet internal assembly 10*c* within the jet housing 10*a*.

The jet housing 10 is removably coupled by the grommet 10*d* to the spa wall (not shown). The jet face/flange assembly 10*b* is removably coupled, or secured, to the jet housing flange 11. The jet housing flange 11 is adapted to be removably secured to the jet face/flange assembly 10*b* either before or after the jet housing 10*a* has been installed in a spa wall and either before or after the jet internal assembly 10*c* has been installed and the water and air connections 13 and 12, respectively, have been connected to external water and air connections (not shown), respectively. This feature allows the jet face/flange assembly 10*b* to be interchanged with a different jet face/flange assembly of the same or different configuration or design while the jet housing 10*a* and the jet internal assembly 10*c* remain in the installed positions.

With reference to FIG. 5, many features of the threaded/nut style spa jet assembly 20 can be identical to features of the grommet style spa jet assembly 10. For example, the jet housing 20*a* has an internal region that is adapted to receive and house the jet internal assembly 20*c*, a jet housing flange 11, an air connection 12, and a water connection 13. Like the jet internal assembly 10*c* shown in FIG. 4, the jet internal assembly 20*c* shown in FIG. 5 includes the nozzle configuration 14, the jet barrel 15, and the diffuser 16, which interfaces with the air connection 12 and the water connection 13 of the jet housing 20*a*. The assembly 20 can also include the locking ring 18 and the O-ring 19 for positioning and securing the jet internal assembly 20*c* within the jet housing 20*a*.

The nozzle configurations 14 shown in FIGS. 4 and 5 can be, for example, the directional nozzle configuration 2 shown in FIG. 1 or the bearingless roto nozzle configuration 6 shown in FIG. 2. The jet face/flange assemblies 10*b* and 20*b* can be, for example, the jet face/flange assemblies 1 and 5, respectively, shown in FIGS. 1 and 2, respectively.

The jet housing 20 is removably coupled by the threaded/nut configuration to the spa wall (not shown). The threaded/nut configuration comprises a male threaded surface 22 disposed on the outer surface of the jet housing 20*a* adjacent the jet housing flange 11 and a female threaded surface on the threaded nut 20*d*. These threaded surfaces threadingly engage one another to removably secure the jet housing 20*a* to the spa wall.

The jet face/flange assembly 20*b* is removably coupled, or secured, to the jet housing flange 21. The jet housing flange 11 is adapted to be removably secured to the jet face/flange assembly 20*b* either before or after the jet housing 20*a* has been installed in a spa wall and either before or after the jet internal assembly 20*c* has been installed and the water and air connections 13 and 12, respectively, have been connected to external water and air connections (not shown), respectively.

Figure 6:
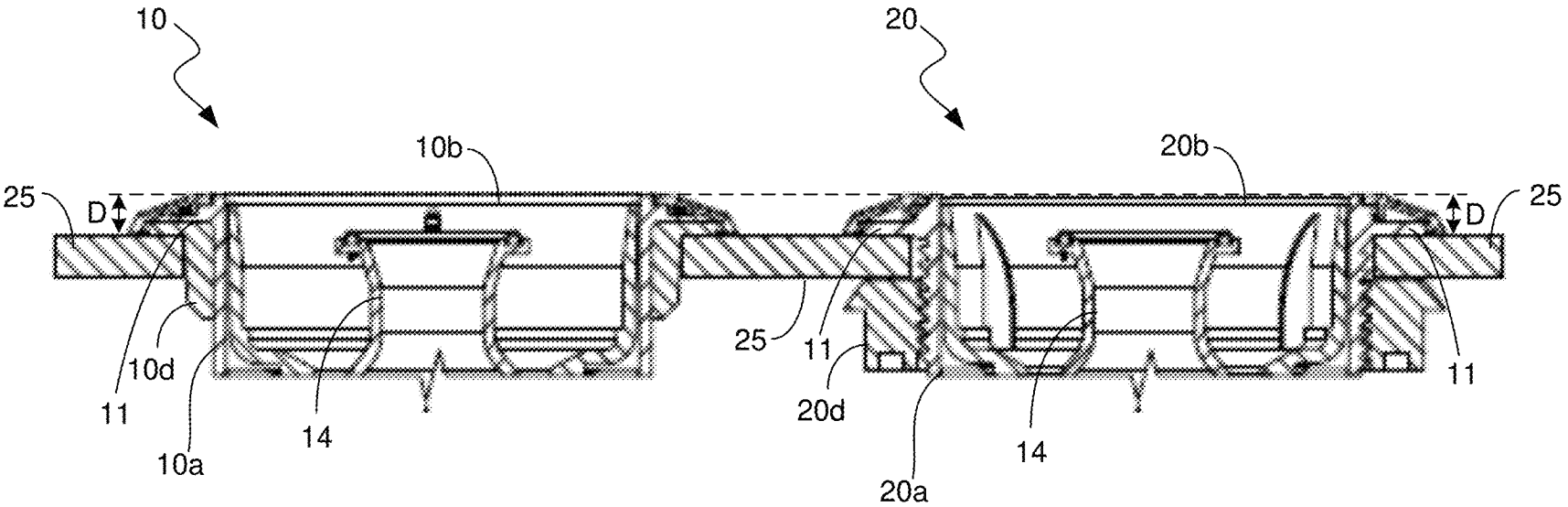
FIG. 6 is a side cross-sectional view of upper portions of the grommet style and threaded/nut style spa jet assemblies shown in FIGS. 4 and 5 mounted side by side on a spa wall.

FIG. 6 is a side cross-sectional view of upper portions of the grommet style and threaded/nut style spa jet assemblies 10 and 20, respectively, shown in FIGS. 4 and 5, respectively, mounted side by side on a spa wall 25. It should be noted that even though the spa jet assemblies 10 and 20 can be of different styles and/or configurations (e.g., one comprises jet face/flange 1 shown in FIG. 1 and the other comprises jet face/flange 5 shown in FIG. 2), the distance D between the spa wall 25 and the outer surfaces of the jet face/flange assemblies 10*b* and 20*b* in a direction substantially normal to the outer surfaces of the jet face/flange assemblies is the same for both assemblies 10 and 20. This feature allows the face/flange assemblies to be mixed and matched, interchanged, etc., while still maintaining the low profiles of the assemblies 10 and 20. As indicated above, the face/flange assemblies 10*b* and 20*b* can be removed and replaced after installation of the spa jet assemblies 10 and 20 without having to first decouple the jet housings 10*a* and 20*a* from the spa wall 25 and without having to deinstall the jet internal assemblies 14.

The grommet style jet housing 10*a* and the threaded style jet housing 20*a* are constructed so as to allow the insertion of a same jet internal assembly 14 into the jet housings 10*a* and 20*a*, although jet internal assemblies having different configurations can be used with the jet housings 10*a* and 20*a*. As the use of the grommet 10*d* adds some distance between the jet housing 10*a* and the jet face/flange assembly 10*b*, the upper structure of the jet housings 10*a* and 20*a* surrounding or forming the mouths of the jet housings 10*a* and 20*a* preferably are constructed somewhat differently, as will be described below in more detail with reference to FIGS. 12A-13B. A gasket (not shown) fits between the jet housing flange 11 and the spa wall 25. The gasket and jet housing flange 11 can be sized such that the overall height of the grommet style spa jet assembly 10 is the same as the threaded/nut style spa jet assembly 20. However, the mouth area of the jet housing extends the same distance from the spa wall 25 in both the grommet style and the threaded style spa jet assemblies 10 and 20, respectively, such that the jet face/flange assemblies 10*b* and 20*b* can have a common height to allow a jet face/flange assembly 10*a* to be removed and replaced with a jet face/flange assembly 20*b*, and vice versa, if desired or deemed necessary.

As will be described below in more detail, the jet face/flange assemblies 10*b* and 20*b* can have one or more snap features that engage one or more respective notch features of the jet housing flange 11 to removably couple the jet face/flange assemblies 10*b* and 20*b* to the jet housing flanges 11 of the jet housings 10*a* and 20*a*, respectively.

Figure 7A:
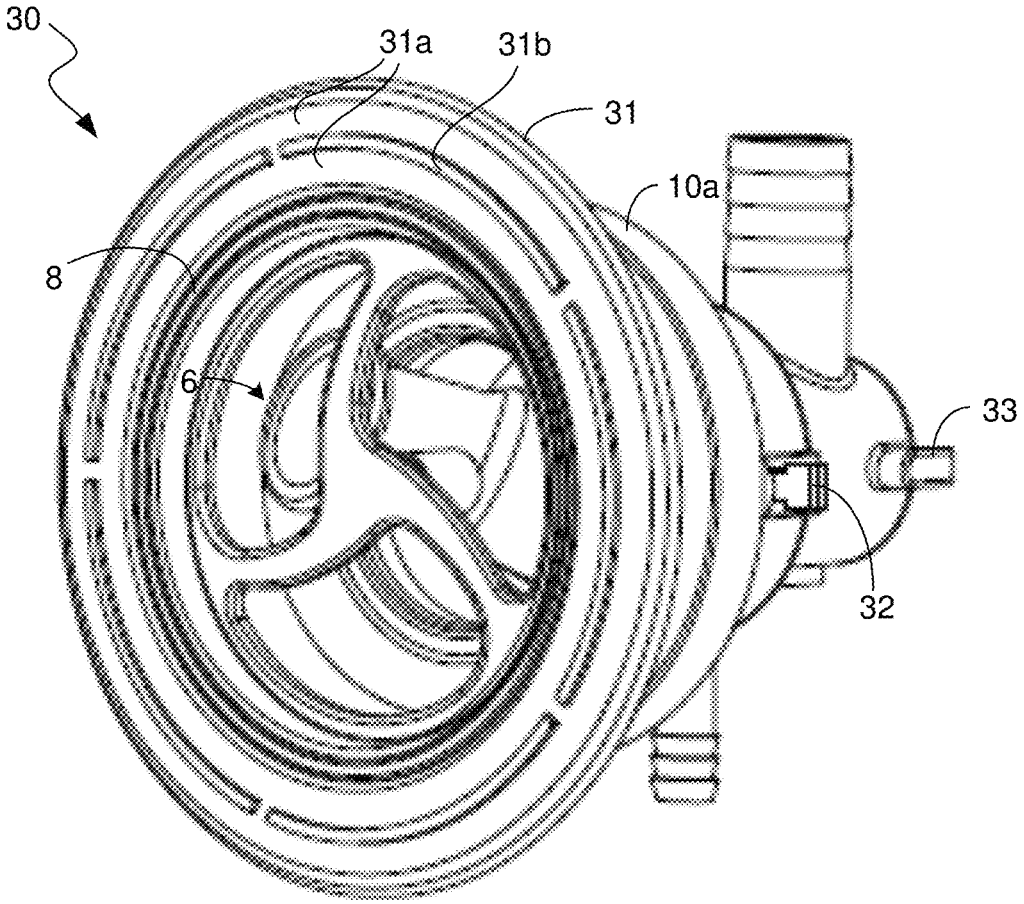
FIGS. 7A and 7B are front perspective and side cross-sectional views, respectively, of a grommet style spa jet assembly having a bearingless roto nozzle configuration in accordance with a representative embodiment and having the jet face/flange assembly shown in FIG. 2.
Figure 7B:
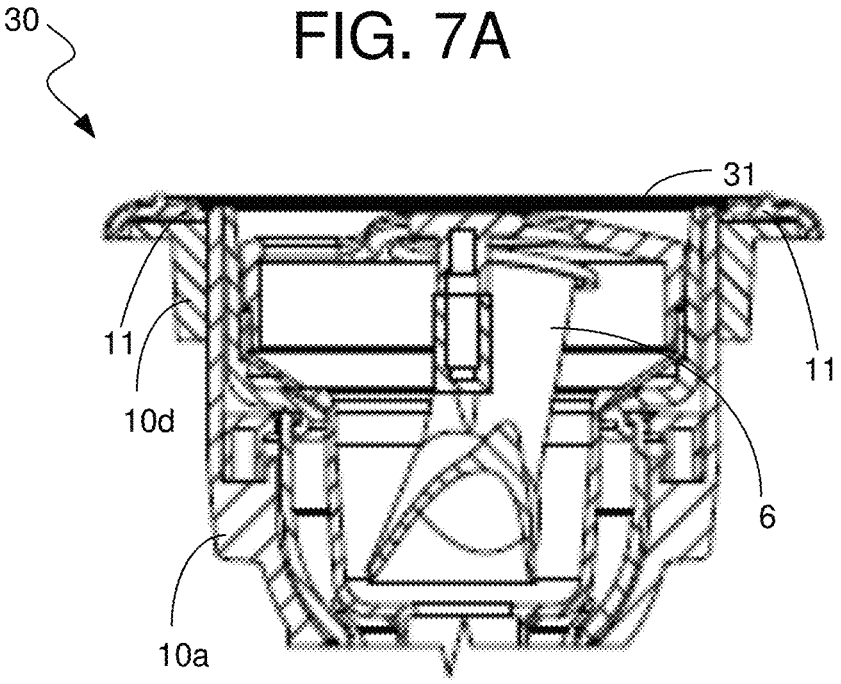

FIGS. 7A and 7B are front perspective and side cross-sectional views, respectively, of a grommet style spa jet assembly 30 having the bearingless roto nozzle configuration shown in FIG. 2 and a jet face/flange assembly 31 that is different from the jet face/flange assemblies 1 and 5 shown in FIGS. 1 and 2, respectively. The flange and the escutcheon of the jet face/flange assemblies can be made in custom designs. In accordance with this representative embodiment, portions 31*a* and 31*b* of the jet face/flange assembly 31 comprise a plastic flange and an SS escutcheon, respectively. The jet housing 10*a* can be identical to the jet housing 10*a* shown in FIG. 3. The jet face/flange assembly 31 can be removably secured to the jet housing flange 11 by the aforementioned snap/notch features, or by any other suitable attachment mechanism, such as via a male threaded/female threaded arrangement, for example.

In accordance with this representative embodiment, portion 8 of the jet housing 10*a* is left exposed, i.e., not covered by the jet face/flange assembly 31, for lighting purposes. The jet housing 10*a* can be made of a light transmissive material, such as PVC, for example, which is preferred for gluing pipe/hose, or any other suitable transparent or translucent material. In accordance with this embodiment, the jet housing 10*a* includes a clip 32 for attaching one or more lighting elements, such as LEDs, for example, to the jet housing 10*a*. (See U.S. Pat. No. 9,719,667, which is incorporated by reference herein). LEDs may be attached to cylindrical ports/holes in the grommet 10*d*, as will be described below in more detail. Lighting elements can also be disposed in ports molded into the jet housing 10*a* or into ports molded into the grommet 10*d*.

Light emitted by the lighting element(s) (not shown) passes through the translucent or transparent material of the jet housing 10*a* and passes through the exposed portion 8 of the jet housing 10*a* so that it is visible by the spa user. The exposed portion 8 can be textured to enhance lighting effects. A light diffusing additive can be included in the resin comprising the jet housing 10*a* to enhance lighting effects.

In accordance with this representative embodiment, the grommet style spa jet assembly 30 has one or more features 33 to allow for a puller tool (not shown) to assist in installation (see U.S. Pat. No. 10,611,008, which is incorporated by reference herein). A pusher tool (not shown) may also be used to seat the jet housing 10*a* in the grommet 10*d*.

Figure 8A:
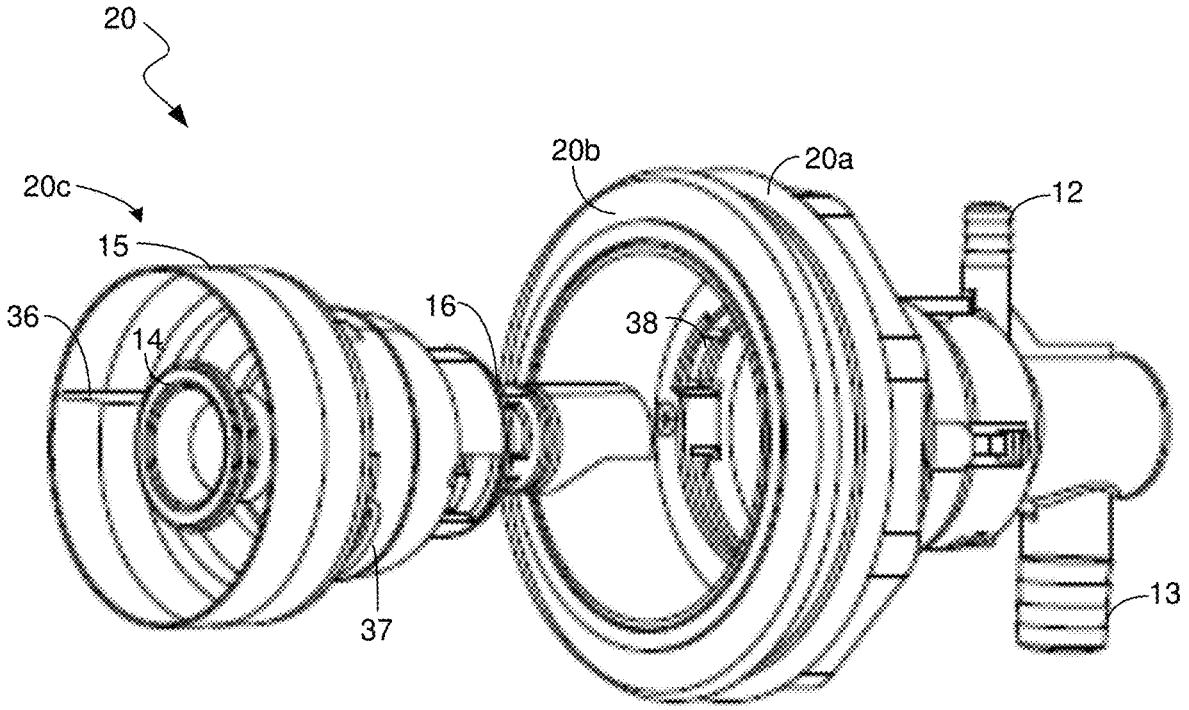
FIGS. 8A and 8B illustrate, respectively, front perspective views of the mounting of a jet internal assembly during insertion and after insertion, respectively, of the jet internal assembly of the threaded/nut spa jet assembly shown in FIG. 5 into a jet housing of the threaded/nut spa jet assembly in accordance with a representative embodiment.
Figure 8B:
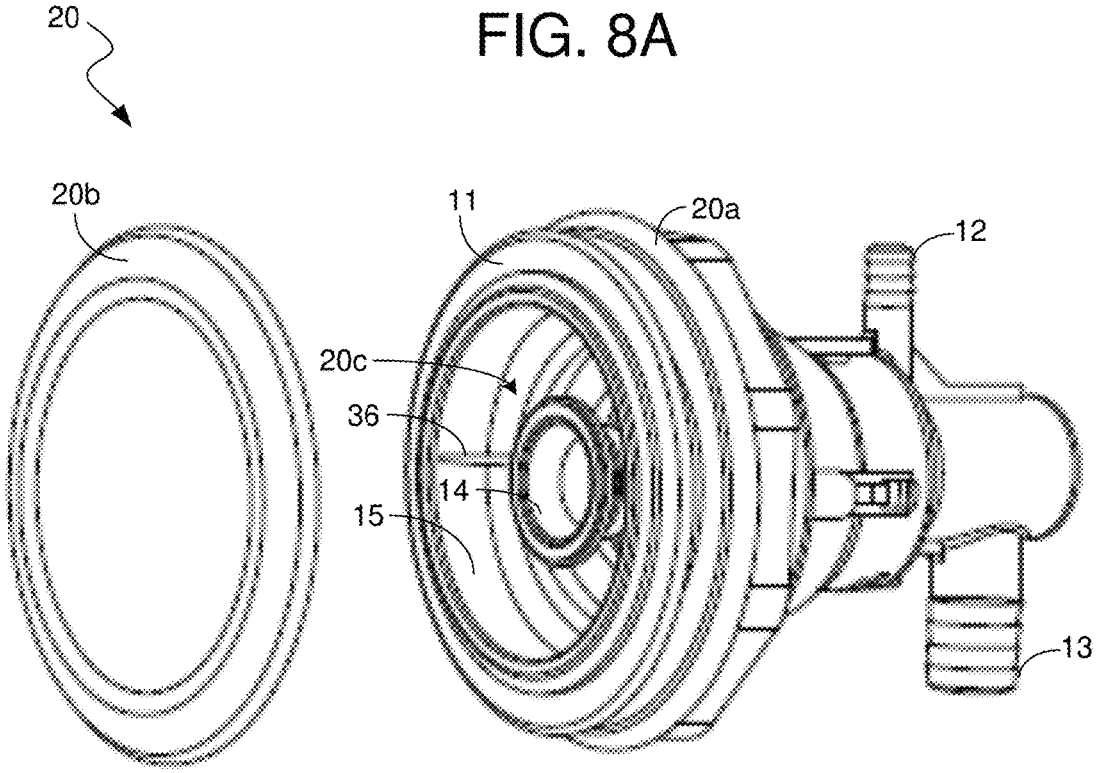

FIGS. 8A and 8B illustrate, respectively, front perspective views of partial assembly of the low profile threaded/nut style spa jet assembly 20 shown in FIG. 5 during insertion and after insertion, respectively, of the jet internal assembly 14 into the jet housing 20*a* of the low profile threaded/nut spa jet assembly 20 in accordance with a representative embodiment. FIG. 8B also shows the jet face/flange assembly 20*b* shown in FIG. 5 prior to it being removably secured to the jet housing flange 11 in accordance with a representative embodiment.

The jet internal assembly 20*c* (nozzle 14, barrel 15, diffuser assembly 16) can be removed from the jet housing 20*a* and interchanged into any other jet housing 20*a* of the same size. In accordance with this representative embodiment, the jet internal assembly 20*c* is installed in or removed from the jet housing 20*a* by gripping grip fins 36 with fingers and exerting a rotational force on the jet internal assembly 20*c* until tabs 37 on the jet internal assembly 20*c* engage with or disengage from spring clips 38 within the jet housing 20*a*. Such an engagement/disengagement configuration for this purpose is disclosed in U.S. Pat. No. 8,978,174, which is incorporated by reference herein. Other engagement/disengagement mechanisms are known that are suitable for this purpose as well. The jet face/flange assembly 20*b* comprising the flange and the escutcheon can be snapped onto (or threaded, bayonet lock, press fit, etc.) and removed from the jet housing 20*a* independently from the jet internal assembly 20*c* and interchanged with any other jet face/flange assembly of the same size having the same or a different configuration. The jet face/flange assembly may comprise various shapes and designs to provide custom looks for different spa manufacturers using the same spa jet assembly platform disclosed herein.

Figures 9A, 9B, 9C, 9D:
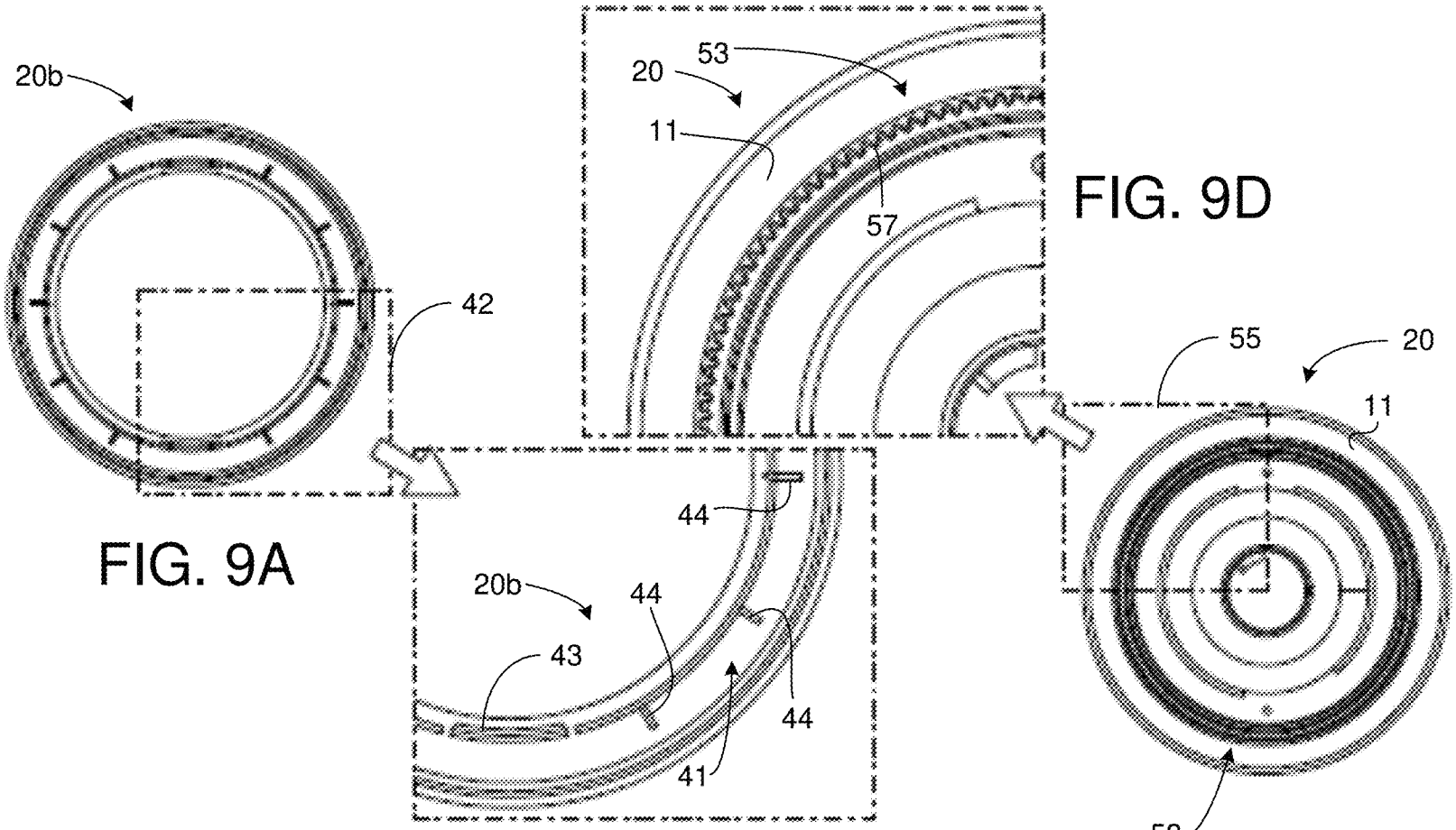
FIG. 9A is a bottom plan view of a jet face/flange assembly configured to snap onto and cover a flange of a jet housing and having a clock/turning/rotating feature that allows the jet face/flange assembly to be rotatable adjusted in increments relative to the jet housing in accordance with a representative embodiment.
FIG. 9B is an enlarged view of a portion of the bottom plan view shown in FIG. 9A showing a snap feature for engaging the jet housing flange and showing key features of the clock/turning/rotating feature shown in FIG. 9A in accordance with a representative embodiment.
FIG. 9C is a top plan view of a spa jet assembly in accordance with a representative embodiment having the jet face/flange assembly shown in FIGS. 9A and 9B removably secured to the jet housing flange in accordance with a representative embodiment.
FIG. 9D is an enlarged view of a portion of the top plan view shown in FIG. 9C showing circumferentially arranged teeth on the jet housing flange for engaging the key features of the clock/turning/rotating feature of the jet face/flange assembly shown in FIG. 9B in accordance with a representative embodiment.

FIG. 9A is a bottom plan view of the jet face/flange assembly 20*b* shown in FIGS. 8A and 8B in accordance with a representative embodiment in which the bottom surface of the jet face/flange assembly 20*b* is configured to snap onto and cover the jet housing flange 11 of the jet housing 20*a* and comprises a clock/turning/rotating feature 41 on its bottom surface that allows the jet face/flange assembly 20*b* to be rotatably adjusted in angular increments relative to a circumference of the jet housing 20*a*. FIG. 9B is an enlarged view of a portion of the bottom plan view shown in FIG. 9A in dashed box 42 showing a snap feature 43 on the bottom surface of the jet face/flange assembly 20*b* for engaging a notch feature on the jet housing flange 11 and showing key features 44 of the clock/turning/rotating feature 41 shown in FIG. 9A in accordance with a representative embodiment. FIG. 9C is a top plan view of the spa jet assembly 20 shown in FIGS. 8A and 8B with the jet face/flange assembly 20*b* removed to allow a counterpart clock/turning/rotating feature 53 on the top surface of the jet housing flange 11 to be seen, which is configured to engage the clock/turning/rotating feature 41 of the jet face/flange assembly 20*b*. FIG. 9D is an enlarged view of a portion of the top plan view shown in FIG. 9C in the dashed box 55 showing circumferentially arranged teeth 57 comprising the counterpart clock/turning/rotating feature 53 of the jet housing flange 11 for engaging the key features 44 of the clock/turning/rotating feature 41 of the jet face/flange assembly 20*b* shown in FIG. 9B in accordance with a representative embodiment.

Figure 10B:
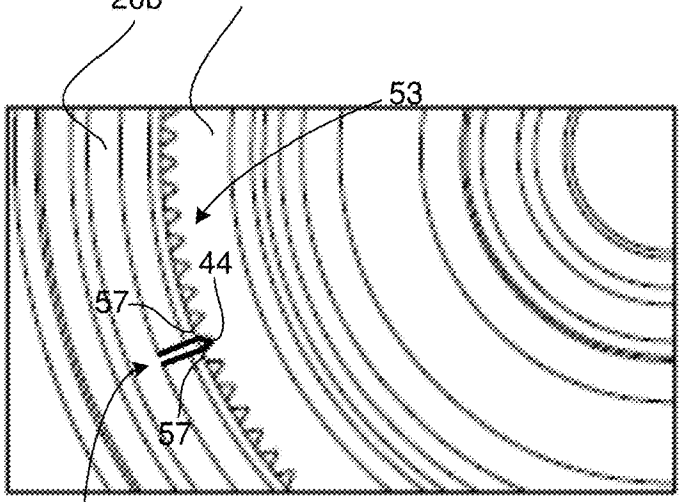
FIG. 10B is a bottom plan view of a cross-section of the spa jet assembly shown in FIG. 10A taken along cross-section line A-A' of FIG. 10A to show engagement of a clock/turning/rotating feature of the jet face/flange assembly with a counterpart clock/turning/rotating feature of the jet housing flange, as shown in FIG. 9D.

The key features 44 interact with the teeth 57 to allow the rotation and releasable holding in place of the jet face/flange assembly 20*b* relative to a circumference of the jet housing 11, as will be discussed below in more detail with reference to FIG. 10B. Thus, as discussed herein, the jet face/flange assembly 20*b* can be clocked/turned/rotated into different positions on the jet housing 20*a* relative to the circumference of the jet housing 20*a* for different looks. This feature also allows freedom to position the air and water connections 12 and 13, respectively, in different orientations to optimize plumbing and piping efficiency of the jet housing 20*a* and then to rotationally adjust the clock/turning/rotating feature 41 of the jet face/flange assembly 20*b* to align the jet face/flange assembly 20*b* with all of the other jet face/flange assemblies installed in the spa wall for the best or a desired appearance.

It should be noted that although the clock/turning/rotating feature has been described with reference to the threaded/nut style spa jet assembly 20, it applies to the grommet style spa jet assembly 10 as well as to other spa jet assemblies disclosed herein and to all of the embodiments of the jet face/flange assemblies disclosed herein.

Figure 10A:
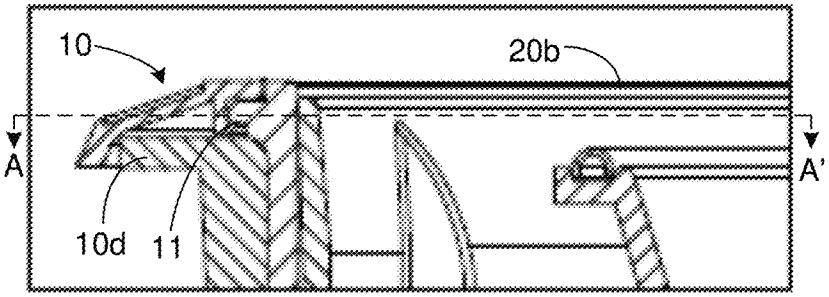
FIG. 10A is a side cross-sectional view of the upper portion of the low profile grommet style spa jet assembly shown in FIG. 4 that includes the jet face/flange assembly shown in FIGS. 9A and 9B secured to the jet housing flange in accordance with a representative embodiment.

FIG. 10A is a side cross-sectional view of the upper portion of the low profile grommet style spa jet assembly 10 shown in FIG. 4 that includes the jet face/flange assembly 20*b* shown in FIGS. 9A and 9B secured to the jet housing flange 11 in accordance with a representative embodiment. FIG. 10B is a bottom plan view of a cross-section of the spa jet assembly 10 shown in FIG. 10A taken along cross-section line A-A' of FIG. 10A to show engagement of the clock/turning/rotating feature 41 of the jet face/flange assembly 20*b* with the counterpart clock/turning/rotating feature 53 of the jet housing flange 11, as shown in FIG. 9D. In FIG. 10B, one of the key features 44 of the clock/turning/rotating feature 41 of the jet face/flange assembly 20*b* is shown engaged with the gap between two adjacent teeth 57 of the counterpart clock/turning/rotating feature 53 of the jet housing flange 11 to lock the jet face/flange assembly 20*b* in position relative to the circumference of the jet housing 20*a*.

Figure 11:
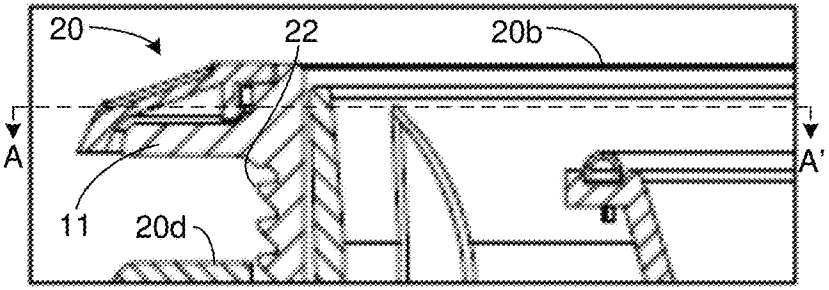
FIG. 11 is a side cross-sectional view of the upper portion of the low profile threaded/nut style spa jet assembly shown in FIG. 5 that includes the jet face/flange assembly shown in FIGS. 9A and 9B secured to the jet housing flange in accordance with a representative embodiment.

FIG. 11 is a side cross-sectional view of the upper portion of the low profile threaded/nut style spa jet assembly 20 shown in FIG. 5 that includes the jet face/flange assembly 20*b* shown in FIGS. 9A and 9B secured to the jet housing flange 11 in accordance with a representative embodiment. The bottom plan view shown in FIG. 10B is also accurate as a bottom plan view of a cross-section of the spa jet assembly 20 shown in FIG. 11 taken along cross-section line A-A' of FIG. 11 to show engagement of the clock/turning/rotating feature 41 of the jet face/flange assembly 20*b* with the counterpart clock/turning/rotating feature 53 of the jet housing flange 11.

FIGS. 12A and 13A show top perspective views of the threaded/nut style and grommet style spa jet assemblies 20 and 10, respectively, shown in FIGS. 5 and 4, respectively, with the jet face/flange assemblies removed to show the circumferentially arranged teeth of the counterpart clock/turning/rotating feature 53 disposed on the respective jet housing flanges 11. FIGS. 12B and 13B show side plan views of upper portions of the spa jet assemblies 20 and 10 shown in FIGS. 12A and 13A, respectively, in accordance with a representative embodiment.

In the side plan view shown in FIG. 12B, it can be seen that a gap 61 exists in between the top surface of the jet housing flange 11 and the counterpart clock/turning/rotating feature 53. This gap 61 allows the jet face/flange assembly to be removably secured to the jet housing flange 11 over 360° degrees of orientation of the jet face/flange assembly relative to the circumference of the jet housing 20*a* while still allowing the key features 44 of the clock/turning/rotating feature 41 of the jet face/flange assembly to engage the gaps between the teeth 57 of the counterpart clock/turning/rotating feature 53 of the jet housing flange 11. In other words, snaps of the jet face/flange assembly can engage notches on the jet housing 20*a* 360° around the jet housing 20*a*.

In order to ensure that threaded/nut style and grommet style spa jet assemblies 20 and 10, respectively, have the same overall height to allow the interchangeability and low profile benefits discussed herein to be realized, the gap 61 shown in FIG. 12B does not exist in between the flange of the grommet 10*d* and the counterpart clock/turning/rotating feature 53 shown in FIG. 13B. Consequently, snaps of the jet face/flange assembly cannot be secured to notches of the jet housing 10*a* where the flange segments of the grommet 10*d* are located. This results in >90° orientation of the jet face/flange assembly relative to the circumference of the jet housing 10*a*.

The flange segments of the grommet 10*d* prevent the jet housing 10*a* from pulling through the grommet 10*d* and the mounting hole in the spa wall. The jet housing 10*a* can have features 62 to allow for a puller tool to assist in installation, and a pusher tool may be used to seat the jet housing 10*a* in the grommet 10, as disclosed in U.S. Pat. No. 10,611,008, which is incorporated by reference herein.

As indicated above, the jet face/flange assemblies can have a variety of configurations. FIG. 14 shows a top plan view of a rectangular jet face/flange assembly 65 that can be used with, for example, the low profile grommet style and threaded/nut style jet spa assemblies 10 and 20, respectively, shown in FIGS. 4 and 5, respectively, in accordance with a representative embodiment. FIG. 15 shows a top perspective view of a threaded/nut style jet spa assembly 66 having the jet internal assembly 14 and the jet housing 20*a* shown in FIG. 5, but with the jet face/flange assembly 20*b* shown in FIG. 5 replaced by the rectangular jet face/flange assembly 65 shown in FIG. 14 in accordance with a representative embodiment. In the embodiment shown in FIG. 15, the rectangular jet face/flange assembly 65 is aligned with the air and water connections 12 and 13, respectively, of the jet housing 20*a*. FIG. 16 shows a top perspective view of the threaded/nut style jet spa assembly 66 shown in FIG. 15, but with the rectangular jet face/flange assembly 65 at a 45° angle to the air and water connections 12 and 13, respectively, of the jet housing 20*a*. FIG. 17 shows a front plan view of a simulated grouping of four of the jet spa assemblies 66 shown in FIG. 16 with their plumbing connections connected to respective external water and air manifolds.

The jet face/flange assemblies 65 can be removably secured to (e.g., snapped onto) the respective jet housings 20*a* at various locations and/or intervals using suitable coupling mechanisms, such as those discussed above with reference to other embodiments. An installer can determine the orientation relative to the water and air connections 12 and 13, respectively. It should be noted that the jet face/flange assemblies 65 can be used with any of the jet housings discussed herein, such as with the grommet style jet housing 10*a* and variations thereof, for example.

Figure 18A:
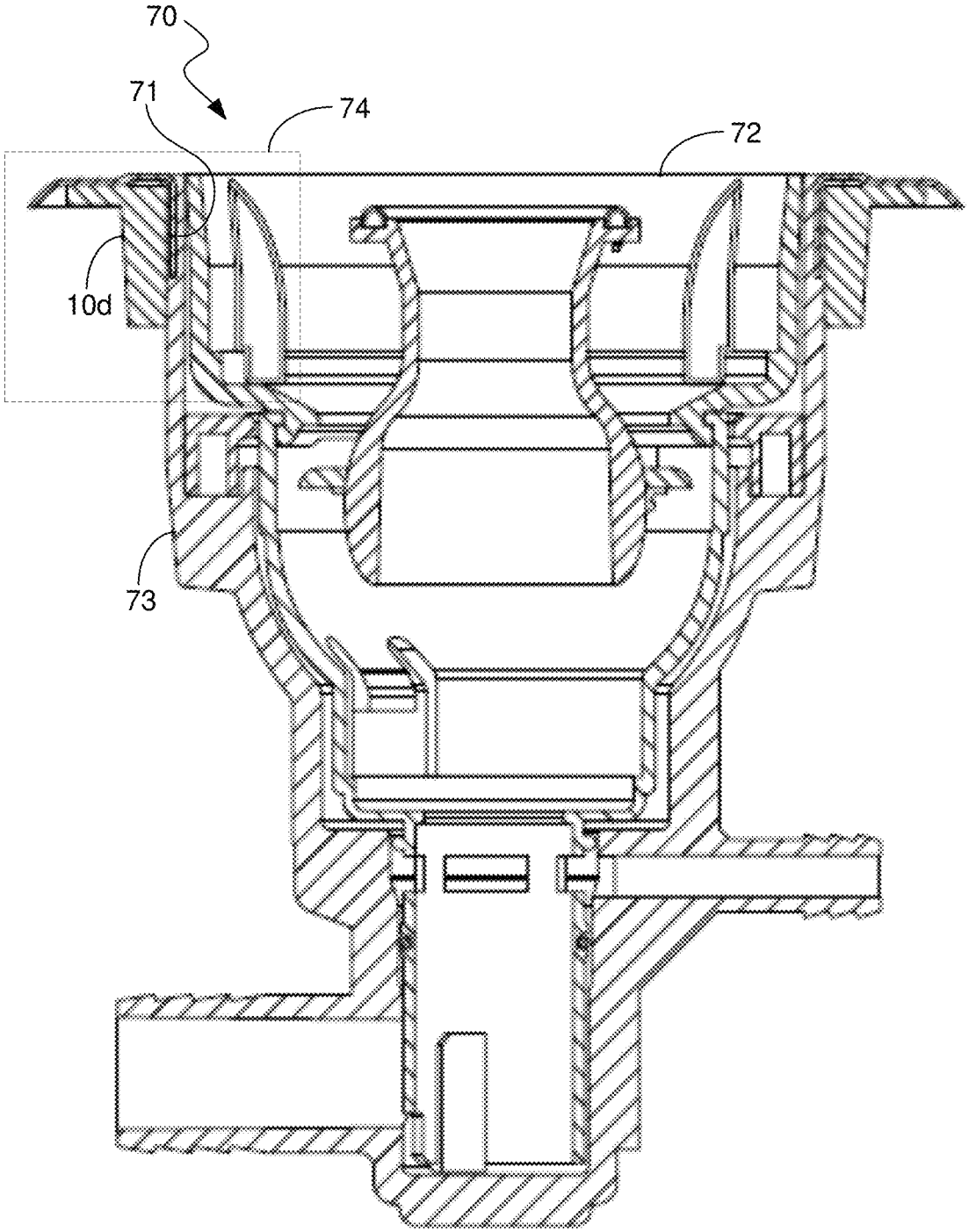
FIG. 18A shows a side cross-sectional view of the grommet style spa jet assembly in accordance with a representative embodiment in which a portion of the jet face/flange assembly is embedded in the jet housing of the spa jet assembly to provide increased strength during installation.
Figure 18D:
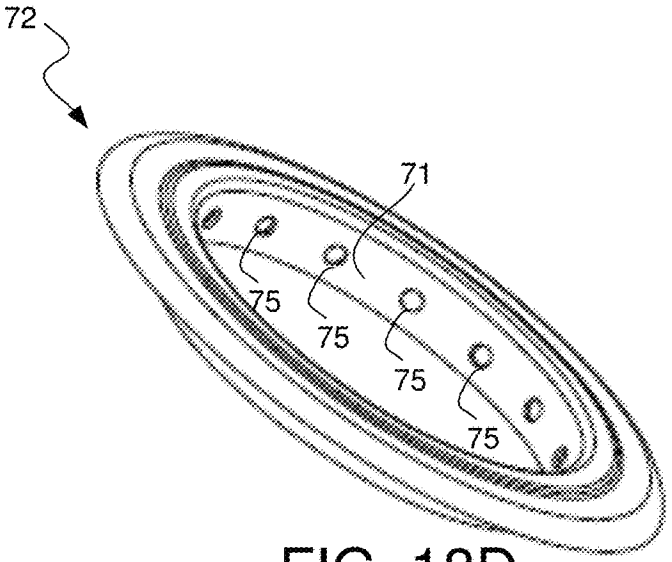
FIG. 18D shows a top perspective view of the jet face/flange assembly of the grommet style spa jet assembly shown in FIGS. 18A-18C in accordance with a representative embodiment in which the portion of the jet face/flange assembly that is configured to be embedded in the jet housing has holes formed in it for mechanically through which mold material comprising the jet housing flows during the process of molding the jet housing to anchor the jet face/flange assembly in the mold material once it hardens.
Figure 18B:
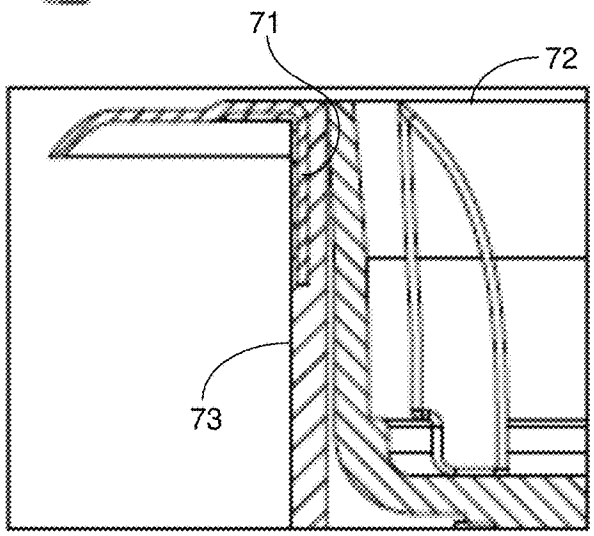
FIG. 18B shows an enlarged view of the portion of the grommet style spa jet assembly shown in FIG. 18A inside of the dashed box in accordance with an embodiment showing the embedded portion of the jet face/flange.
Figure 18C:
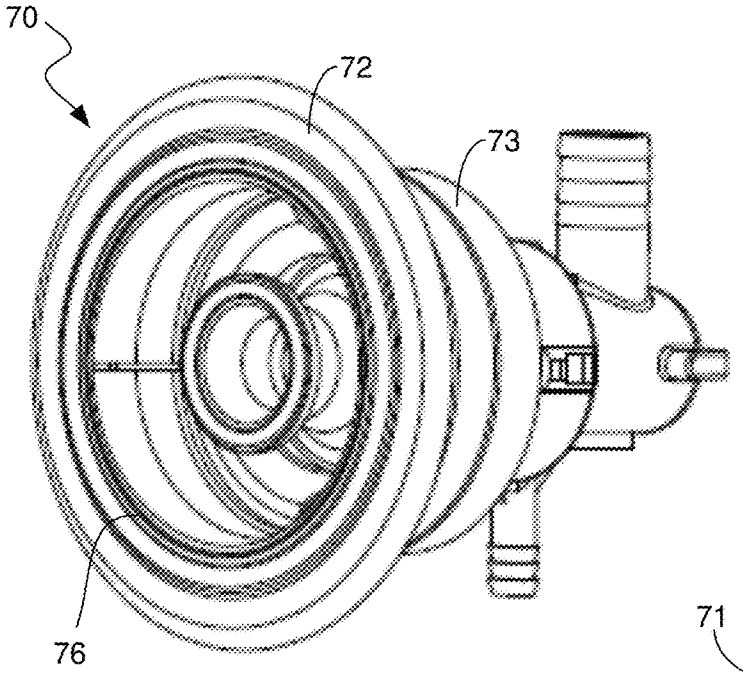
FIG. 18C shows a front perspective view of the grommet style spa jet assembly shown in FIG. 18A.

FIG. 18A shows a side cross-sectional view of the low profile grommet style spa jet assembly 70 in accordance with a representative embodiment in which a portion 71 of the jet face/flange assembly 72 is embedded in the material comprising the jet housing 73 of the spa jet assembly 70 to provide increased strength of the assembly 70 during installation. FIG. 18B shows an enlarged view of the portion of the grommet style spa jet assembly 70 shown in FIG. 18A inside of the dashed box 74 in accordance with an embodiment showing the embedded portion 71 of the jet face/flange assembly 72. FIG. 18C shows a front perspective view of the grommet style spa jet assembly 70 shown in FIG. 18A. FIG. 18D shows a top perspective view of the jet face/flange assembly 72 of the grommet style spa jet assembly 70 shown in FIGS. 18A-18C in accordance with a representative embodiment in which the portion 71 of the jet face/flange assembly that is configured to be embedded in the jet housing 73 has holes 75 formed in it through which mold material comprising the jet housing 73 flows during the process of molding the jet housing 73 to anchor the portion 71 of the jet face/flange assembly 72 in the mold material once it hardens.

The low profile grommet style spa jet assembly 70 shown in FIGS. 18A-18C can have the same configuration as the low profile grommet style spa jet assembly 10 shown in FIG. 4 with the exception that the jet housing 73 has the portion 71 of the jet face/flange assembly 70 embedded therein. Thus, the jet housing 73 shown in FIGS. 18A-18D can have the same configuration as the jet housing 10*a* shown in FIG. 4 with the exception that the jet housing 73 has the portion 71 of the jet face/flange assembly 70 embedded therein.

The jet face/flange assembly 72 preferably is formed from metal, such as stainless steel, which may have a thinner wall thickness and therefore result in a lower profile jet. Prior to the molding process being performed to form the jet housing 73, the portion 71 of the jet face/flange assembly 72 that has the holes 75 formed in it can be inserted into the mold part (not shown) that is used to mold the jet housing 73. The molding material that will comprise the jet housing 73 is then poured into the mold part and envelopes the portion 71, flowing through the holes 75. The mold material is a plastic material, such as PVC, for example. Once the mold material is cured and the molded jet housing 73 is removed from the mold part, the portion 71 remains embedded in the molded jet housing 73.

The formed metal jet face/flange assembly 72 can be made in custom designs, and decorative plastic covers (not shown) can snap over the jet face/flange assembly 72 to provide two-tone options, for example; however, this may result in a taller profile. As discussed above, at least one portion 76 (FIG. 18C) of the jet housing 73 can be left exposed, i.e., uncovered by the jet face/flange assembly 72, for lighting purposes. The jet housing 73, or portions of the jet housing 73, can be made in a light transmissive or translucent material, such as PVC, for example, to allow for a lighting feature. As indicated above, PVC is a preferred material for gluing pipe and/or hose, but any suitable transparent or translucent material can be used as the material for the jet housing 73. The exposed portion 76 can be textured to enhance the lighting effects. Light diffusing additives can be included in the resin to enhance lighting.

Figure 19A:
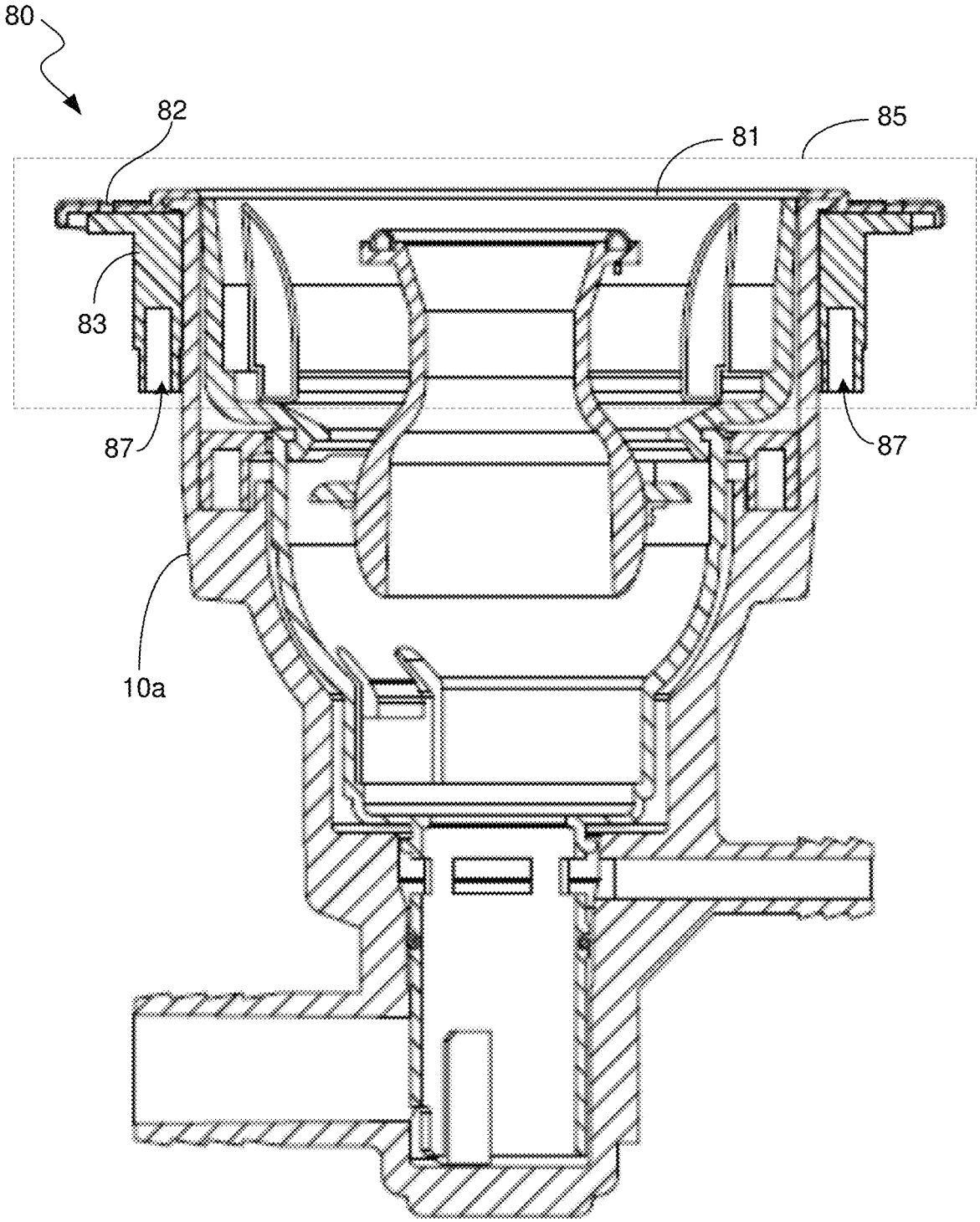
FIG. 19A shows a side cross-sectional view of the grommet style spa jet assembly in accordance with a representative embodiment in which the jet face/flange assembly has an opening, or slit, formed in it and the grommet is translucent to allow light emitted by LEDs of the spa jet assembly to pass through the translucent grommet and through the opening, or slit, formed in the jet face/flange assembly.
Figure 19C:
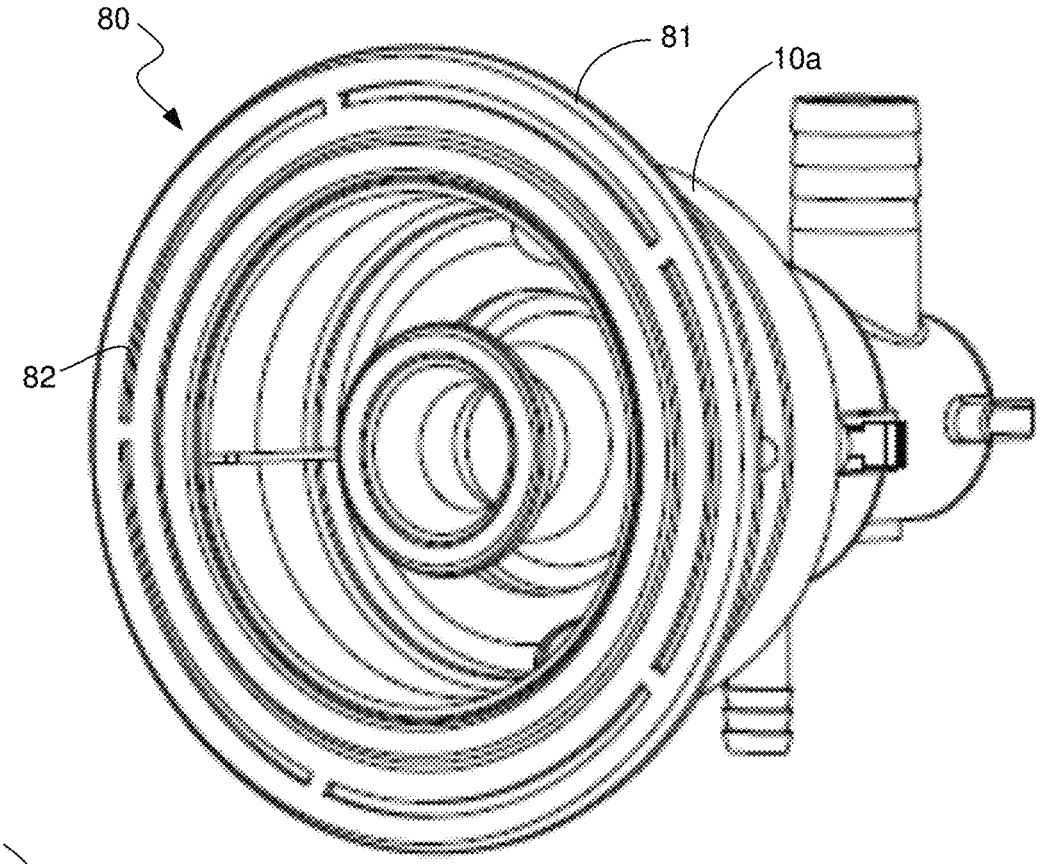
FIG. 19C shows a front perspective view of the grommet style spa jet assembly shown in FIG. 19A.
Figure 19B:
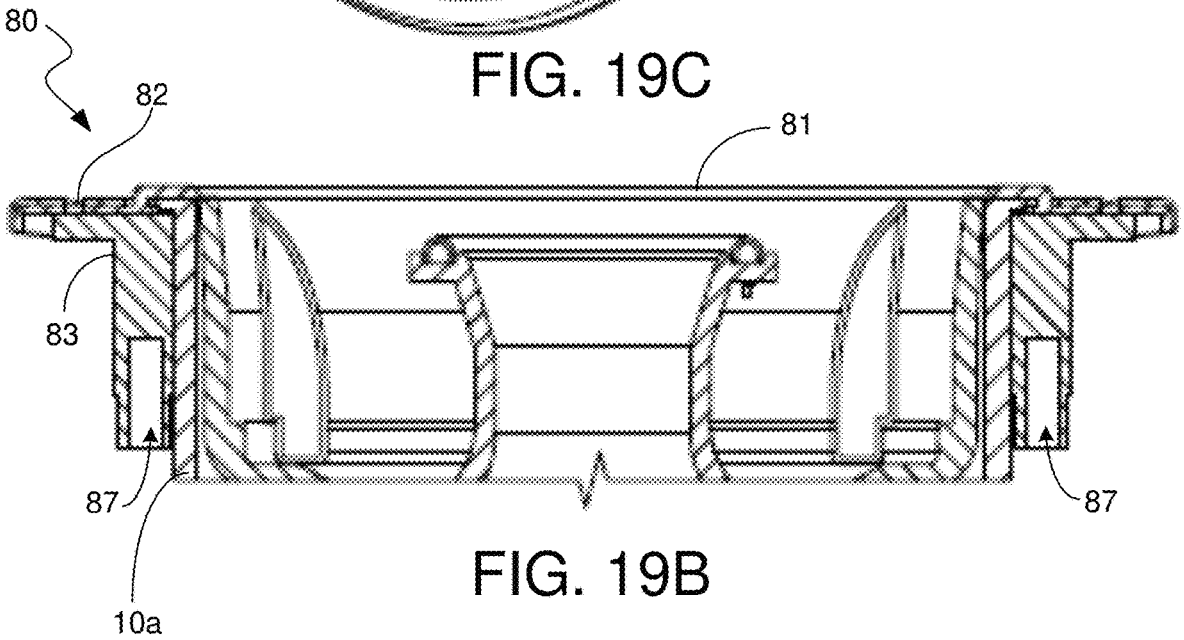
FIG. 19B shows an enlarged view of the portion of the grommet style spa jet assembly shown in FIG. 19A inside of the dashed box in accordance with an embodiment showing the opening, or slit, formed in the jet face/flange through which light emitted by the LEDs that passes through the translucent grommet can pass.

FIG. 19A shows a side cross-sectional view of the grommet style spa jet assembly 80 in accordance with a representative embodiment in which the jet face/flange assembly 81 has an opening, or slit, 82 formed in it and the grommet 83 is translucent or transparent to allow light emitted by one or more LEDs of the spa jet assembly 80 to pass through the grommet 83 and through the opening, or slit, 82 formed in the jet face/flange assembly 81. FIG. 19B shows an enlarged view of the portion of the grommet style spa jet assembly 80 shown in FIG. 19A inside of the dashed box 85. FIG. 19C shows a front perspective view of the grommet style spa jet assembly 80 shown in FIG. 19A.

Figures 19D, 19E:
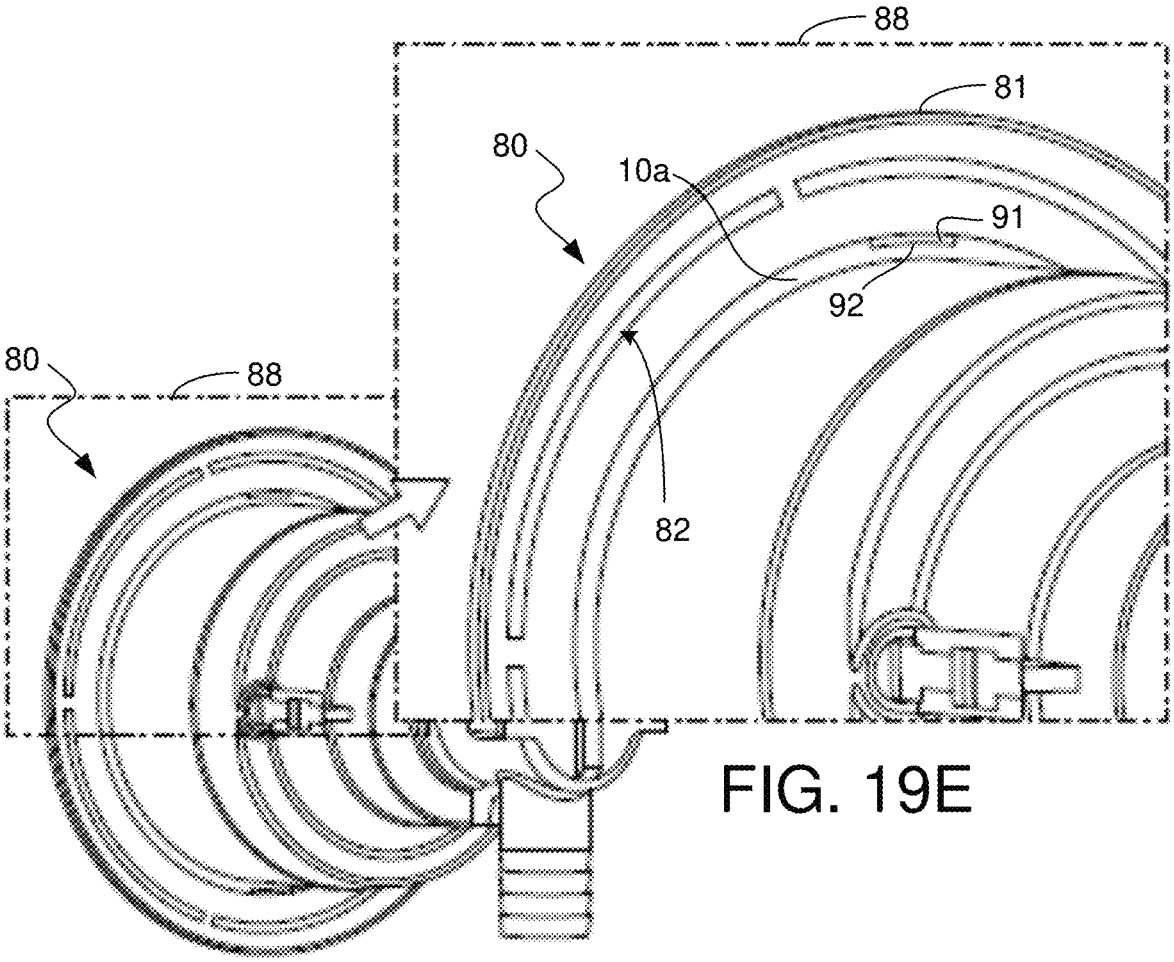
FIG. 19D shows a back perspective view of the grommet style spa jet assembly shown in FIG. 19C.
FIG. 19E shows an enlarged view of the portion of the grommet style spa jet assembly shown in the dashed box in FIG. 19D to show snap features on the bottom side of the jet face/flange assembly engaged with notch features on the jet housing to removably couple the jet face/flange assembly with the jet housing.

FIG. 19D shows a back perspective view of the grommet style spa jet assembly 80 shown in FIG. 19A. FIG. 19E shows an enlarged view of the portion of the grommet style spa jet assembly 80 shown in the dashed box 88 in FIG. 19D to show snap features 91 on the bottom side of the jet face/flange assembly 81 engaged with notch features 92 on the jet housing 10*a* to removably couple the jet face/flange assembly 81 with the jet housing 10*a*. The inventive principles and concepts are not limited with respect to the types or locations of the features that are used to removably secure the jet face/flange assembly 81 to the jet housing 10*a*.

An alternative to the clock/turning/rotating features described above is to provide the jet housing 10*a* with the notch features 92 at angular increments along the circumference of the jet housing 10*a* to receive the snap features 91 on the jet face/flange assembly 81 at different angular orientations relative to the circumference of the jet housing 10*a*. The notch features 92 can be sized such that the jet face/flange assembly 81 cannot rotate after installation. Multiple notch features around the circumference of the jet housing 10*a* allows for incremental adjustment of the jet face/flange assembly 81 around the circumference of the jet housing 10*a*. This allows patterned, asymmetrical, and/or non-circular jet face/flange assembly designs to be adjusted such that all jet faces/flange assemblies being used in the spa are in alignment with each other while the water/air connections on the jet housings can be positioned in different orientations to optimize plumbing and piping efficiency.

The low profile grommet style spa jet assembly 80 shown in FIGS. 19A-19E can have the same configuration as the low profile grommet style spa jet assembly 10 shown in FIG. 4 with the exception that the grommet 83 has the LED ports 87 formed therein and is made of a transparent or translucent material. Thus, the jet housing 10*a* shown in FIGS. 19A-19E can have the same configuration as the jet housing 10*a* shown in FIG. 4.

As indicated above, light emitted by the LEDs held in the ports 87 passes through the grommet 83 and through the opening, or slit, 82 formed in the jet face/flange assembly 81. The opening, or slit, 82 can have lighted design elements disposed therein that interact with the light entering the opening, or slit, 82 to achieve a desired or preselected optical effect that is visible to the spa user.

Figure 20A:
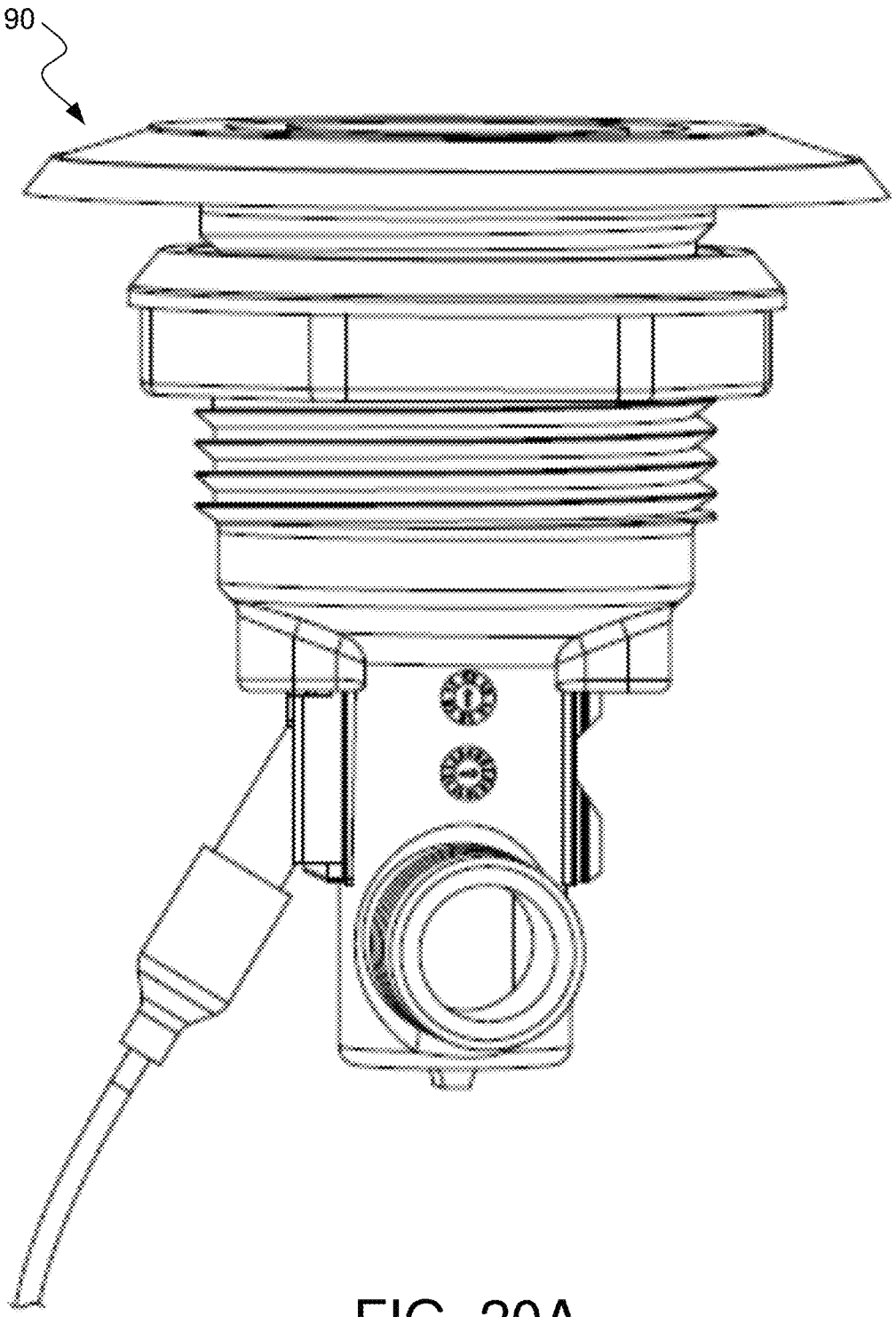
FIG. 20A is a side view of a representative embodiment of the threaded/nut style spa jet assembly having the jet internal assembly shown in FIG. 7B or 8B and having the jet face/flange assembly shown in FIGS. 2 and 7A.
Figure 20B:
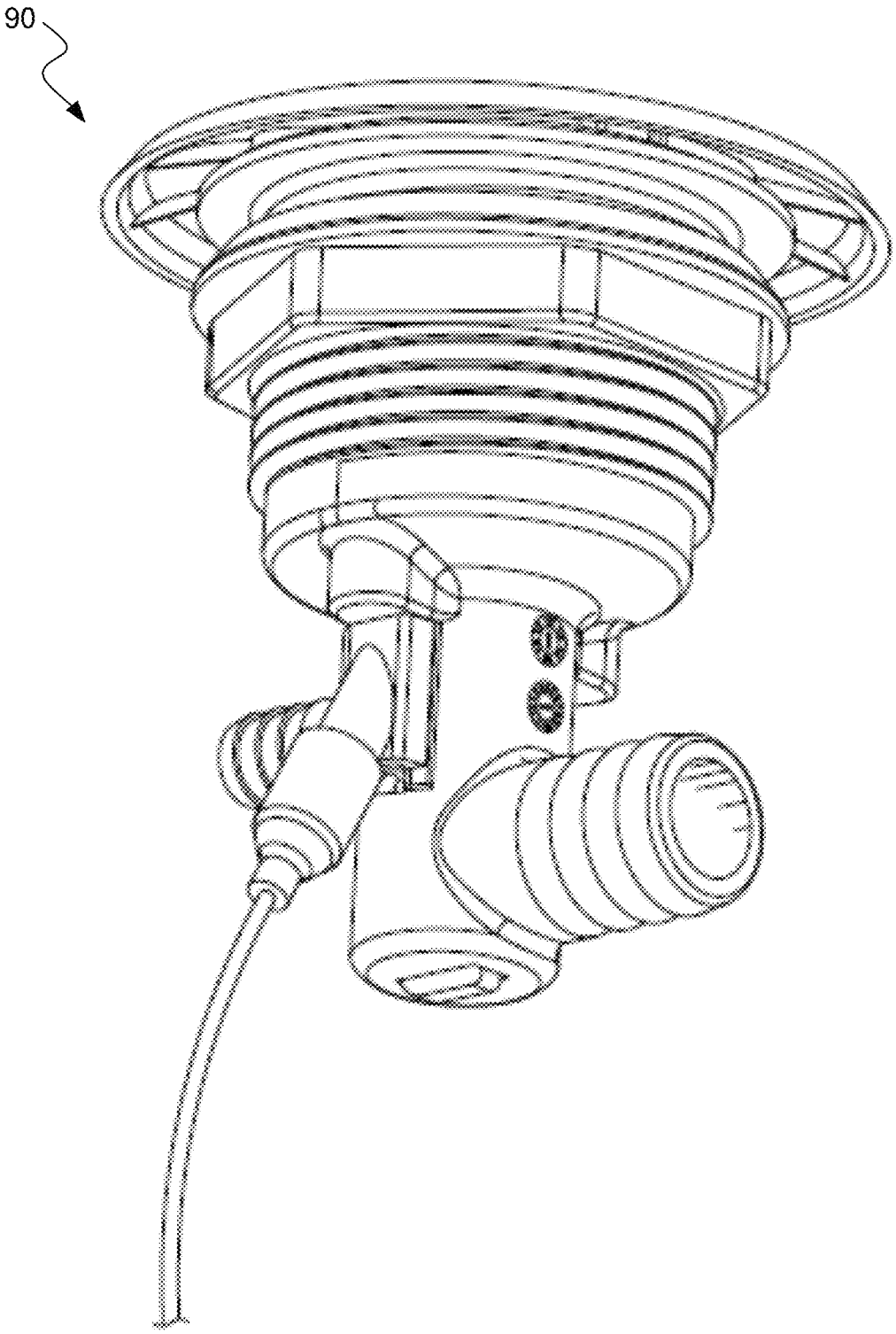
FIG. 20B is a bottom perspective view of the embodiment of FIG. 20A rotated to the right.
Figure 20C:
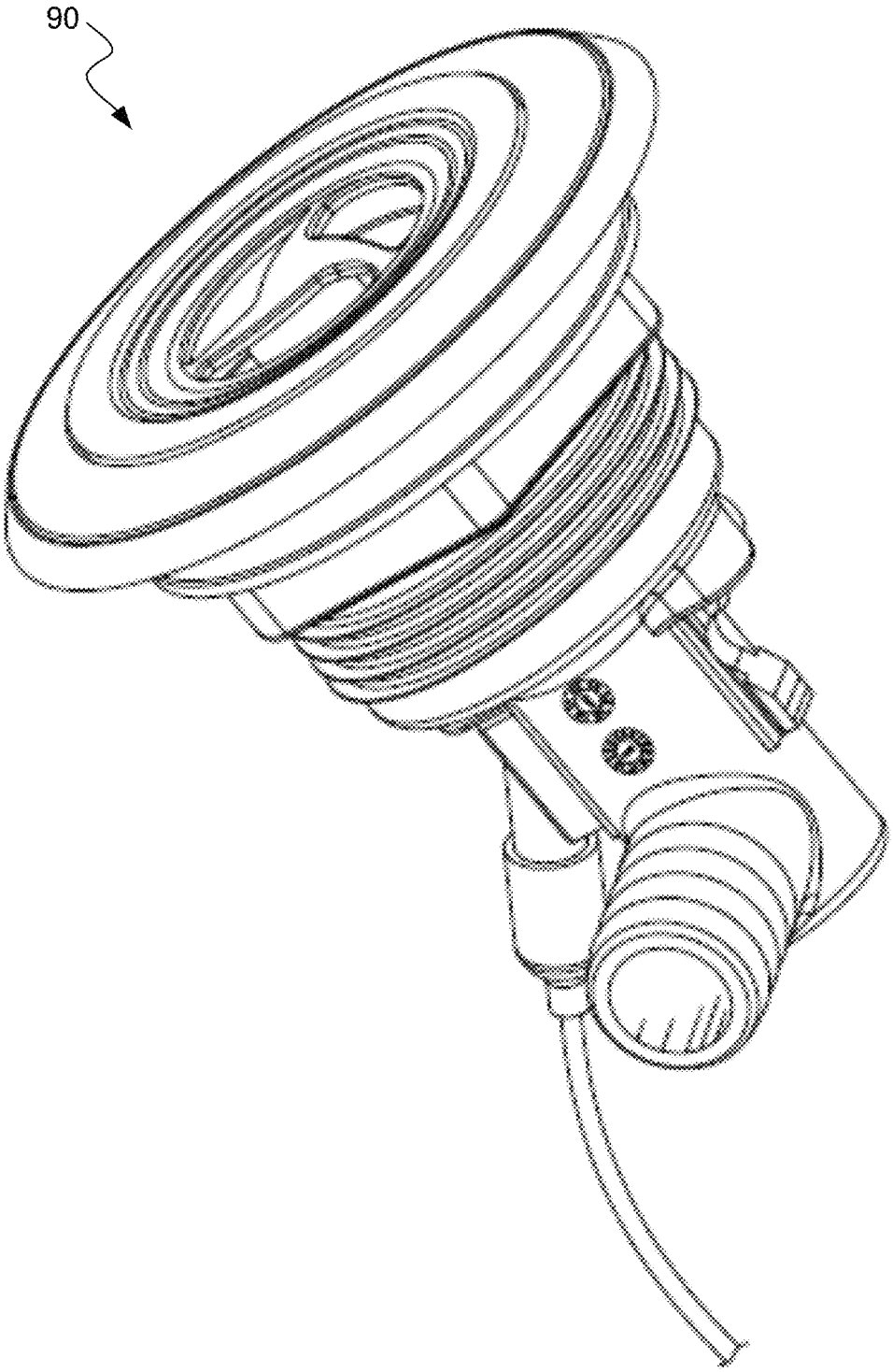
FIG. 20C is a top perspective view of the embodiment of FIG. 20A rotated to the left.
Figure 20D:
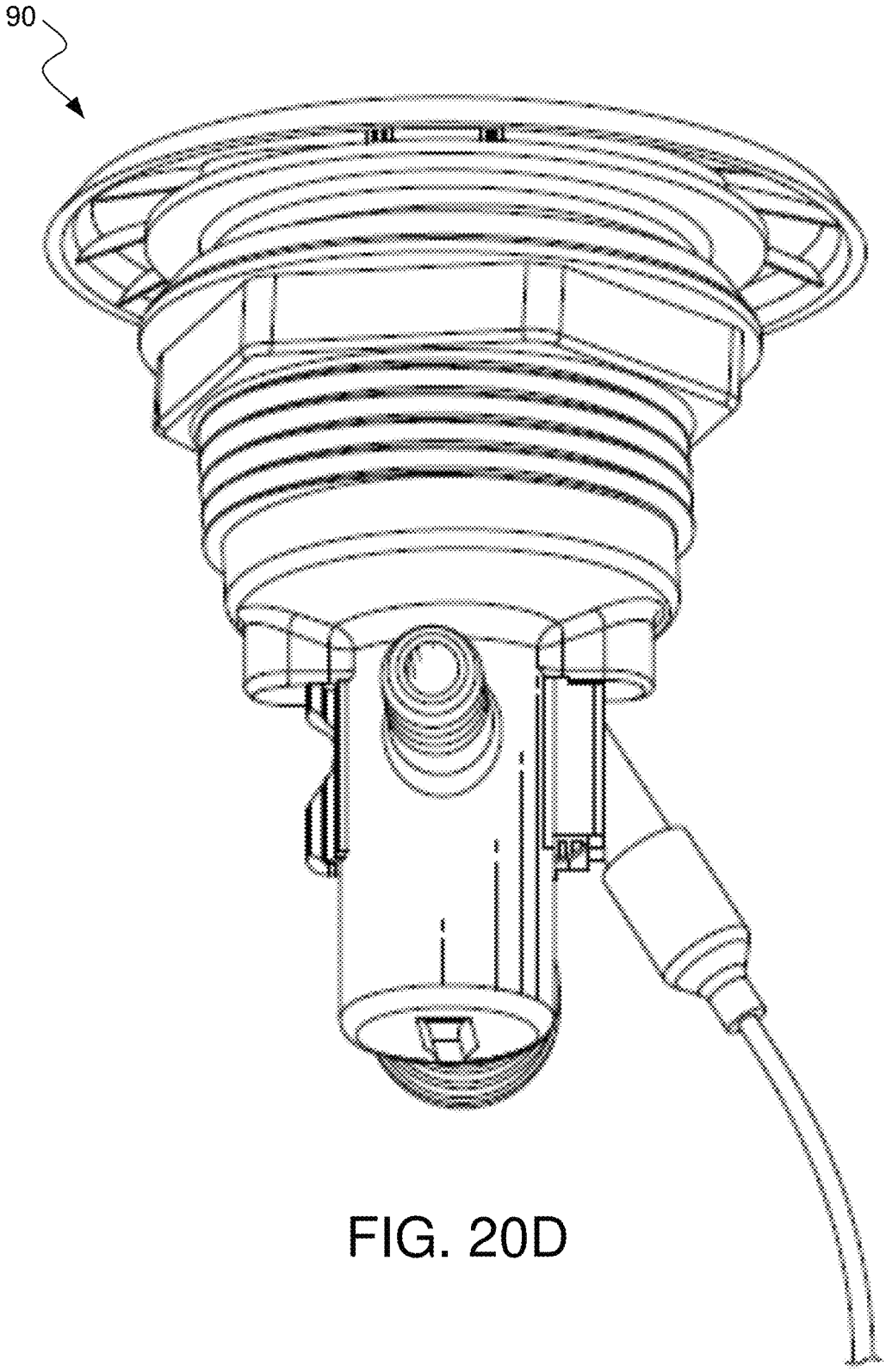
FIG. 20D is a bottom perspective view of the embodiment of FIG. 20A rotated approximately 180 degrees.

FIGS. 20A-27D illustrate examples of various alternative embodiments of the spa jet assemblies and their components in accordance with inventive principles and concepts of the present disclosure. FIG. 20A is a side view of a representative embodiment of the low profile threaded/nut style spa jet assembly 90 that can have the jet internal assembly shown in FIG. 7B or 8B and the jet face/flange assembly shown in FIGS. 2 and 7A. FIG. 20B is a bottom perspective view of the embodiment of FIG. 20A rotated to the right. FIG. 20C is a top perspective view of the embodiment of FIG. 20A rotated to the left. FIG. 20D is a bottom perspective view of the embodiment of FIG. 20A rotated approximately 180 degrees.

Figure 21A:
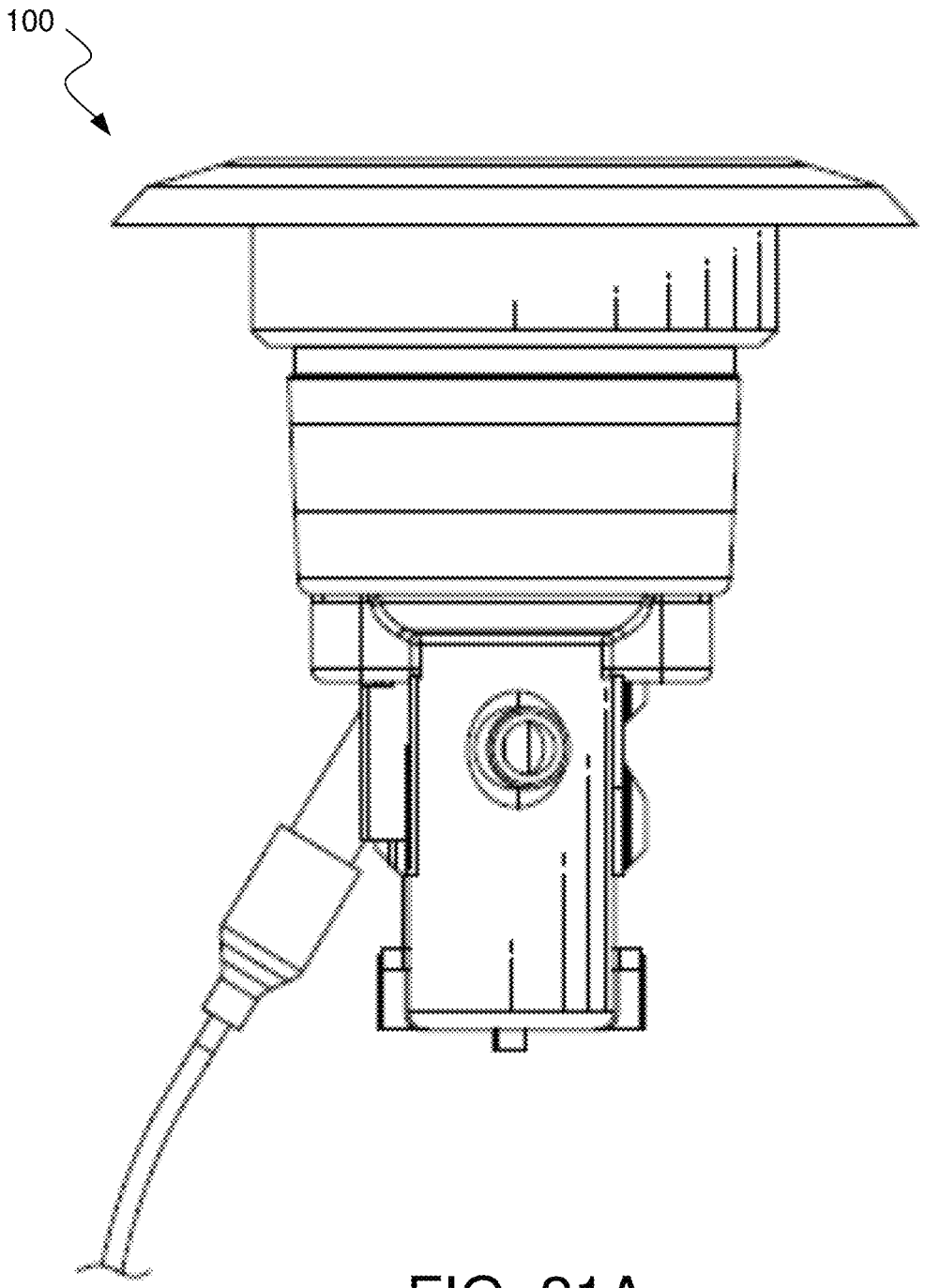
FIG. 21A is a side view of a representative embodiment of the grommet style spa jet assembly having the jet internal assembly shown in FIG. 8A and having the jet face/flange assembly shown in FIG. 2.
Figure 21B:
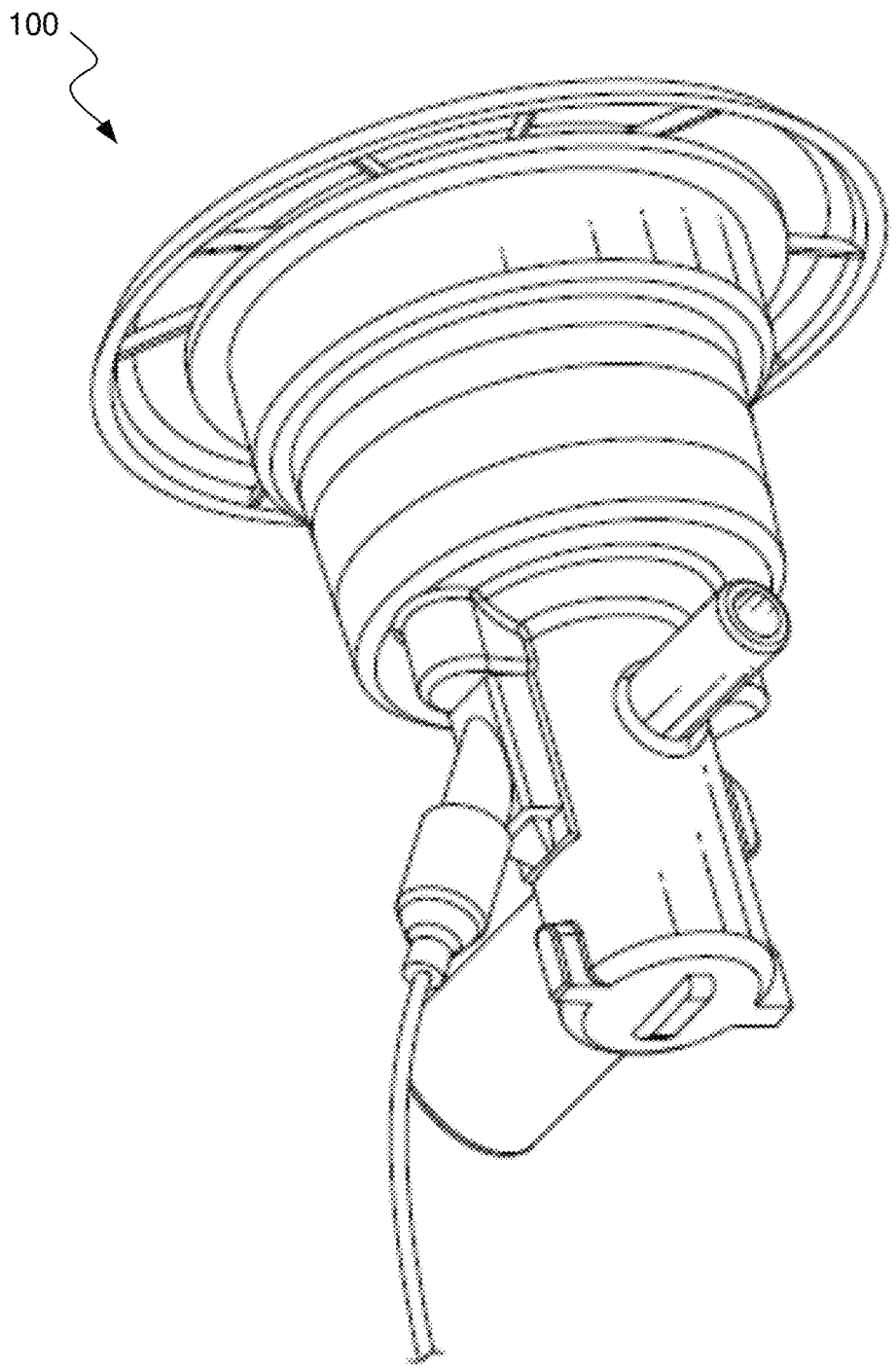
FIG. 21B is a bottom perspective view of the embodiment of FIG. 21A rotated to the right.
Figure 21C:
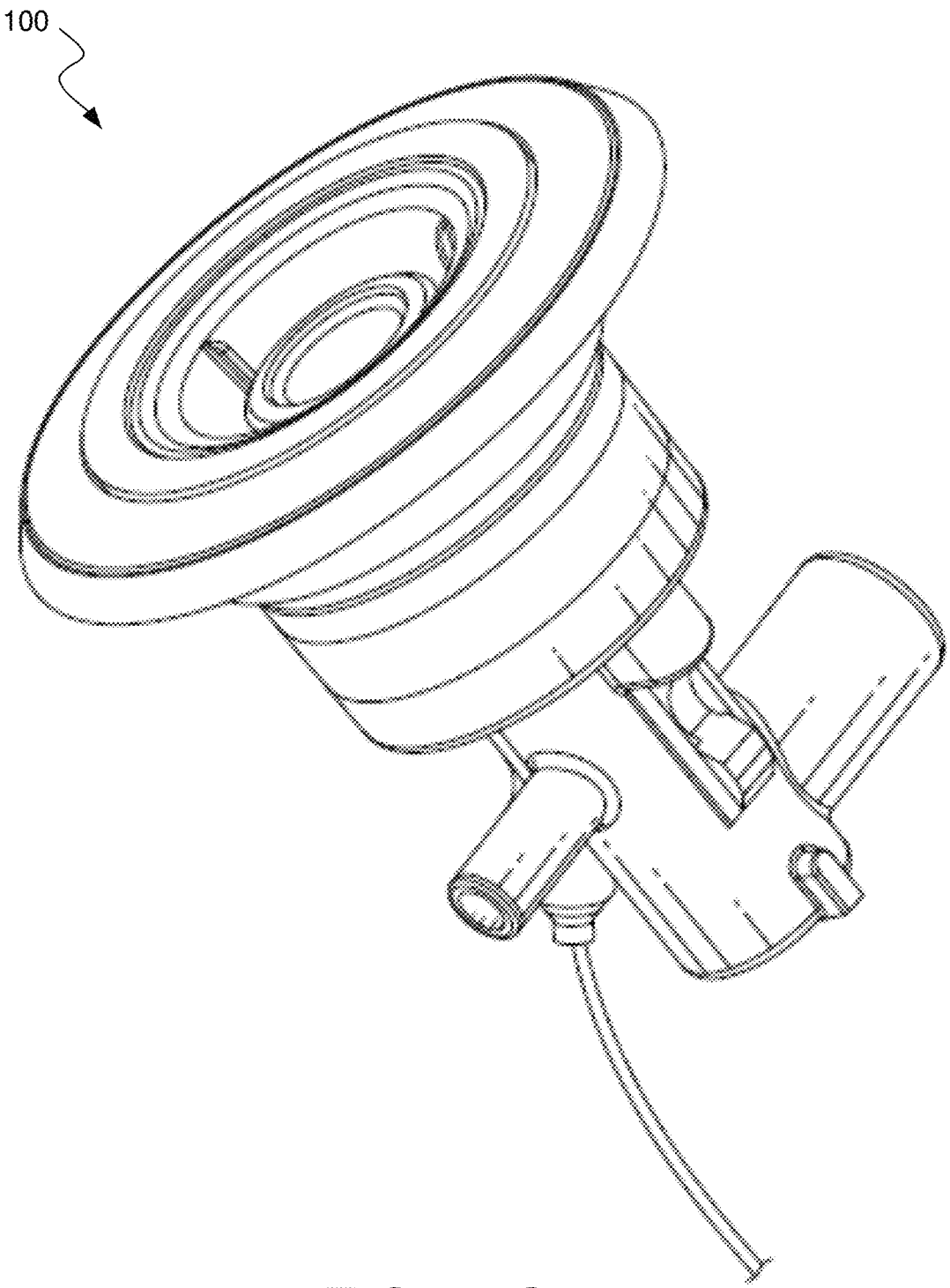
FIG. 21C is a top perspective view of the embodiment of FIG. 21A rotated to the left.
Figure 21D:
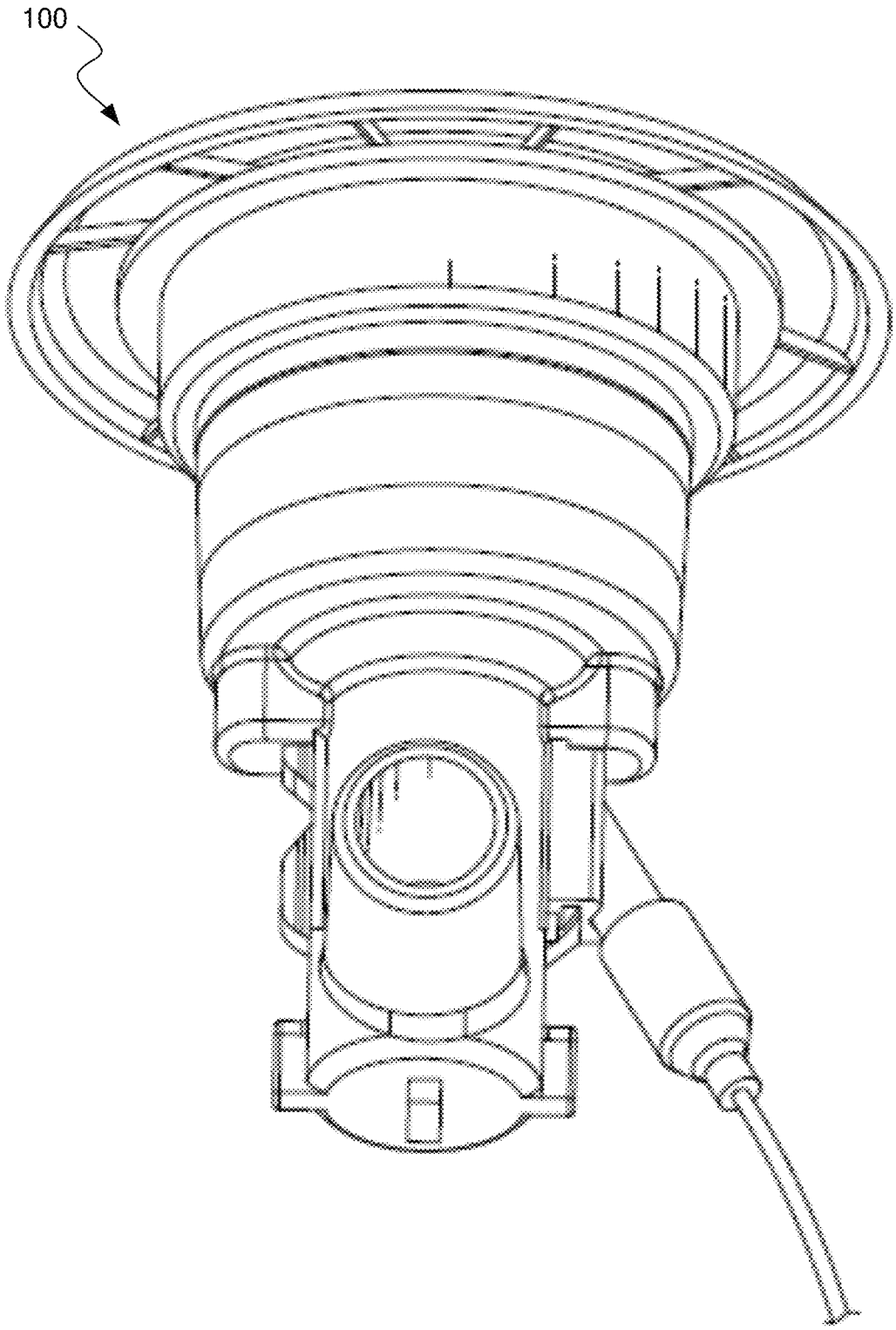
FIG. 21D is a bottom perspective view of the embodiment of FIG. 21A rotated approximately 180 degrees.

FIG. 21A is a side view of a representative embodiment of the low profile grommet style spa jet assembly 100 that can have the jet internal assembly shown in FIG. 8A and the jet face/flange assembly shown in FIG. 2. FIG. 21B is a bottom perspective view of the embodiment of FIG. 21A rotated to the right. FIG. 21C is a top perspective view of the embodiment of FIG. 21A rotated to the left. FIG. 21D is a bottom perspective view of the embodiment of FIG. 21A rotated approximately 180 degrees.

Figure 22A:
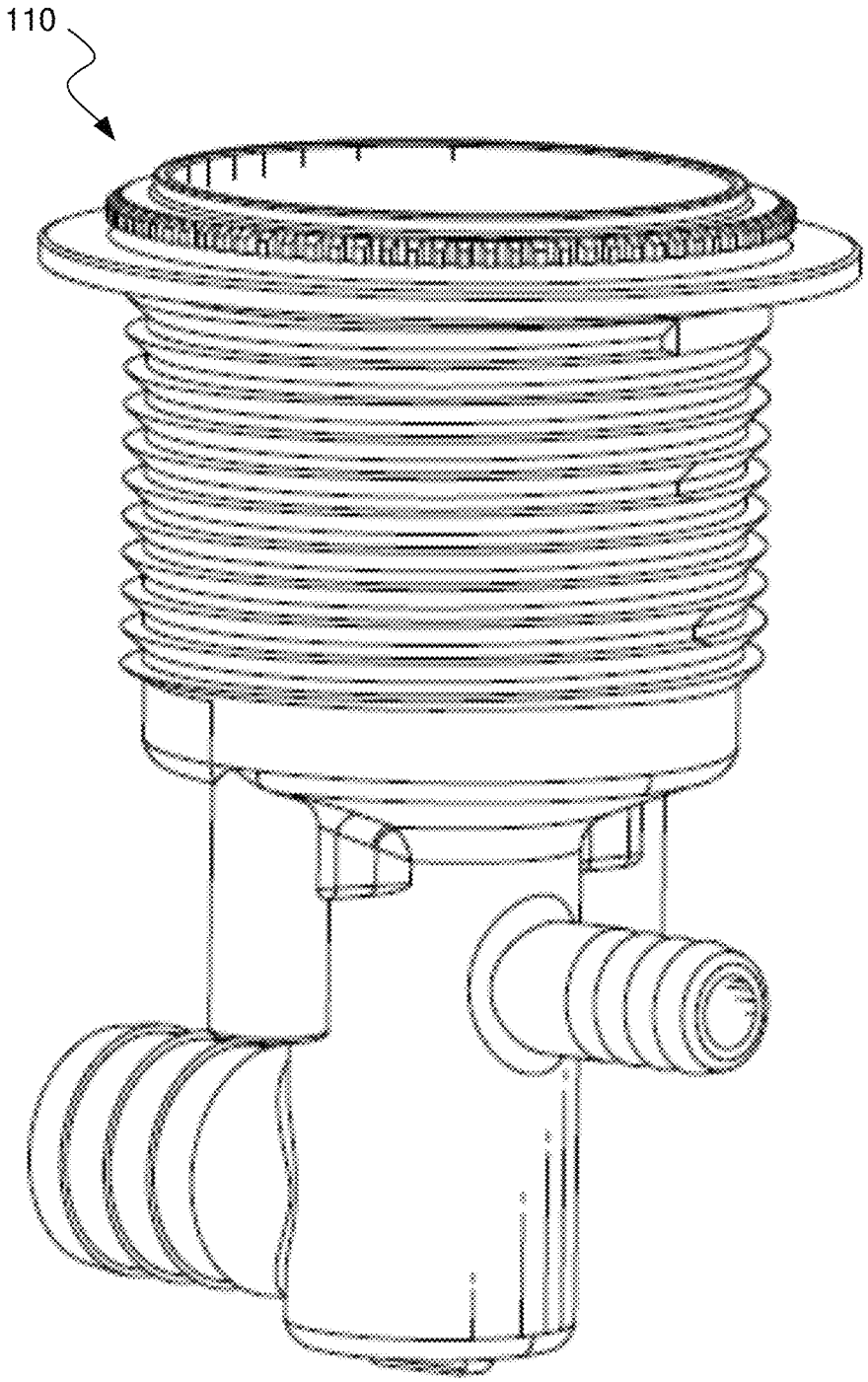
FIG. 22A is a side view of another representative embodiment of the threaded/nut style spa jet assembly.
Figure 22B:
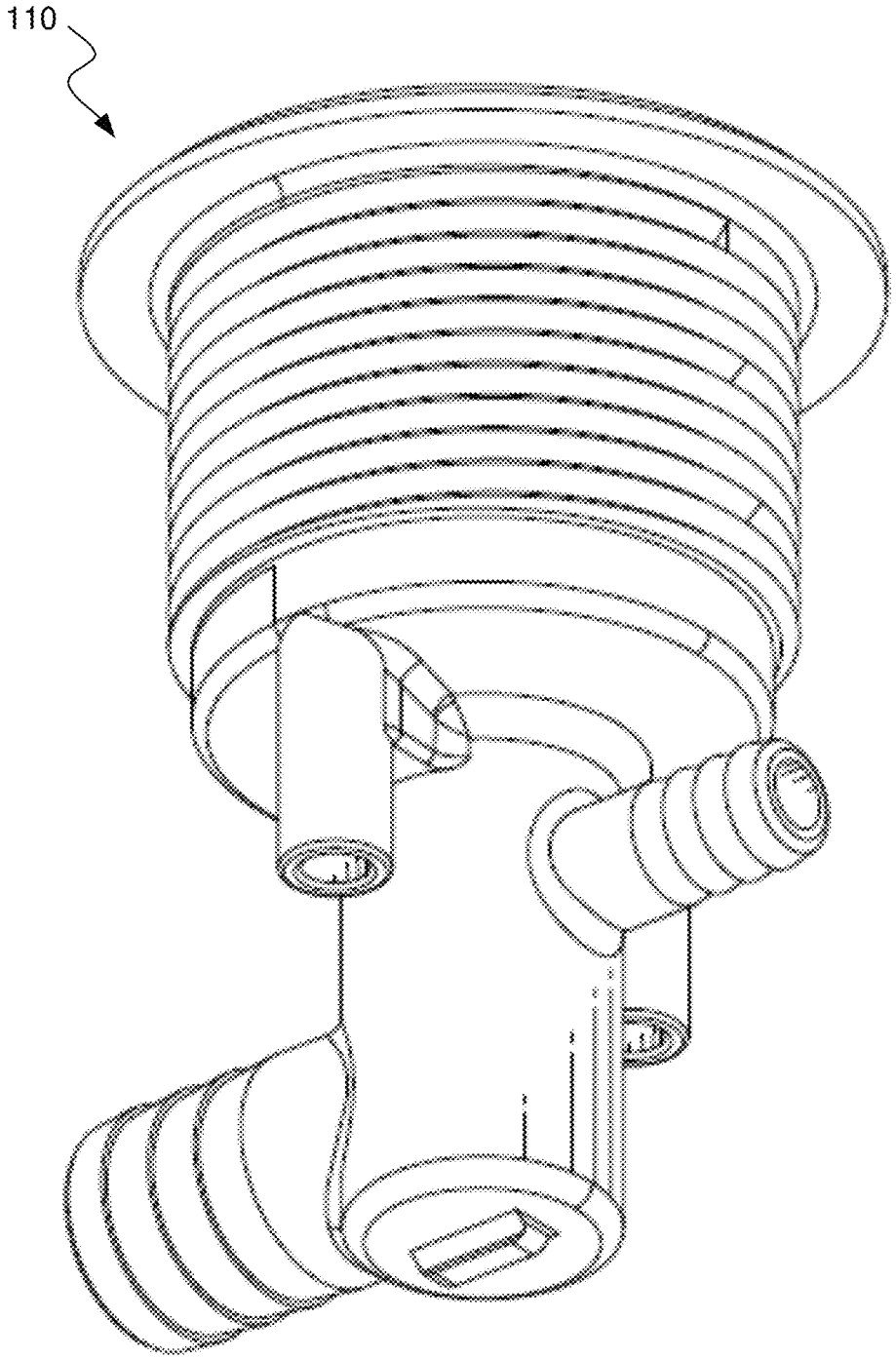
FIG. 22B is a bottom perspective view of the embodiment of FIG. 22A rotated to the right.
Figure 22C:
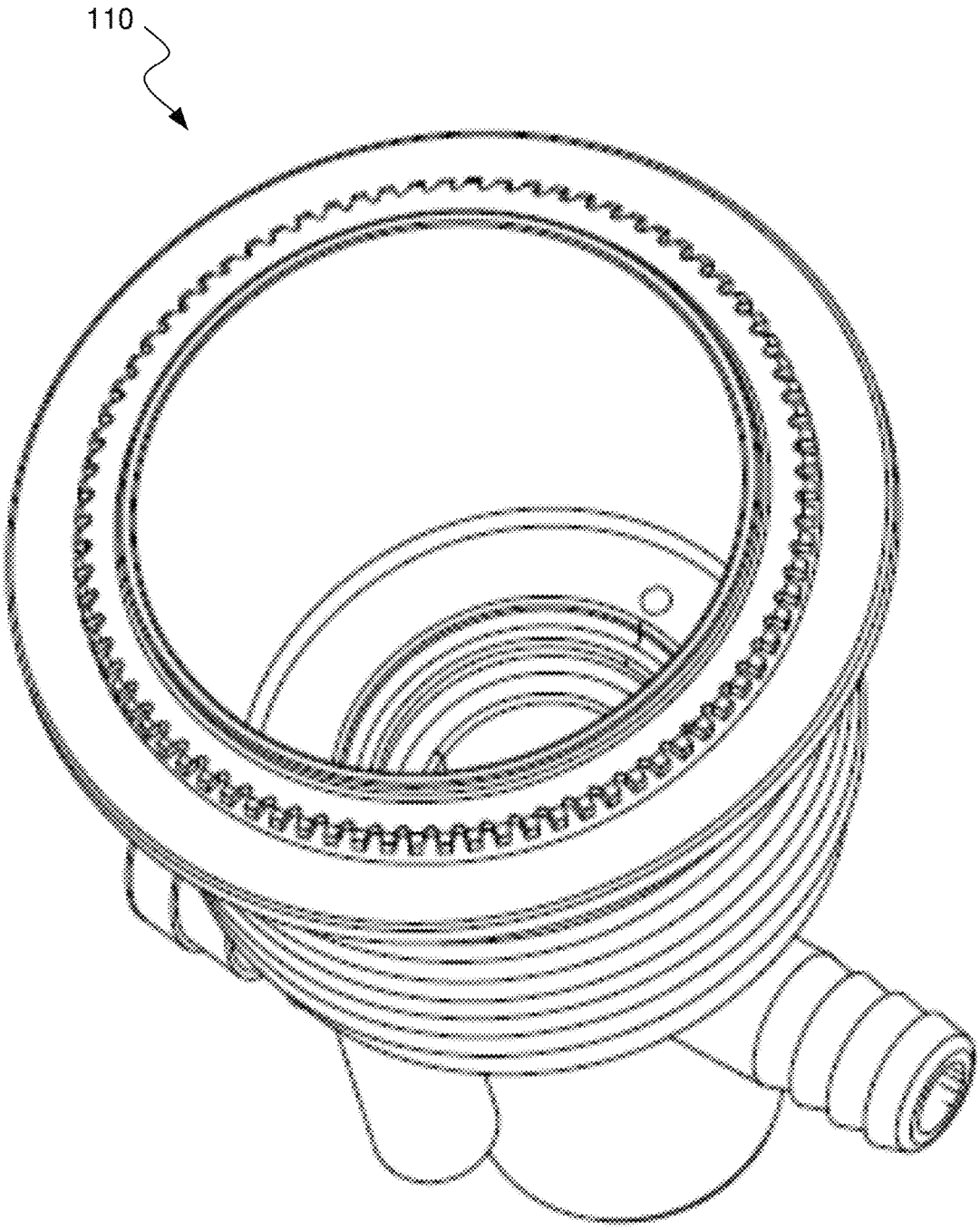
FIG. 22C is a top perspective view of the embodiment of FIG. 22A rotated to the left.
Figure 22D:
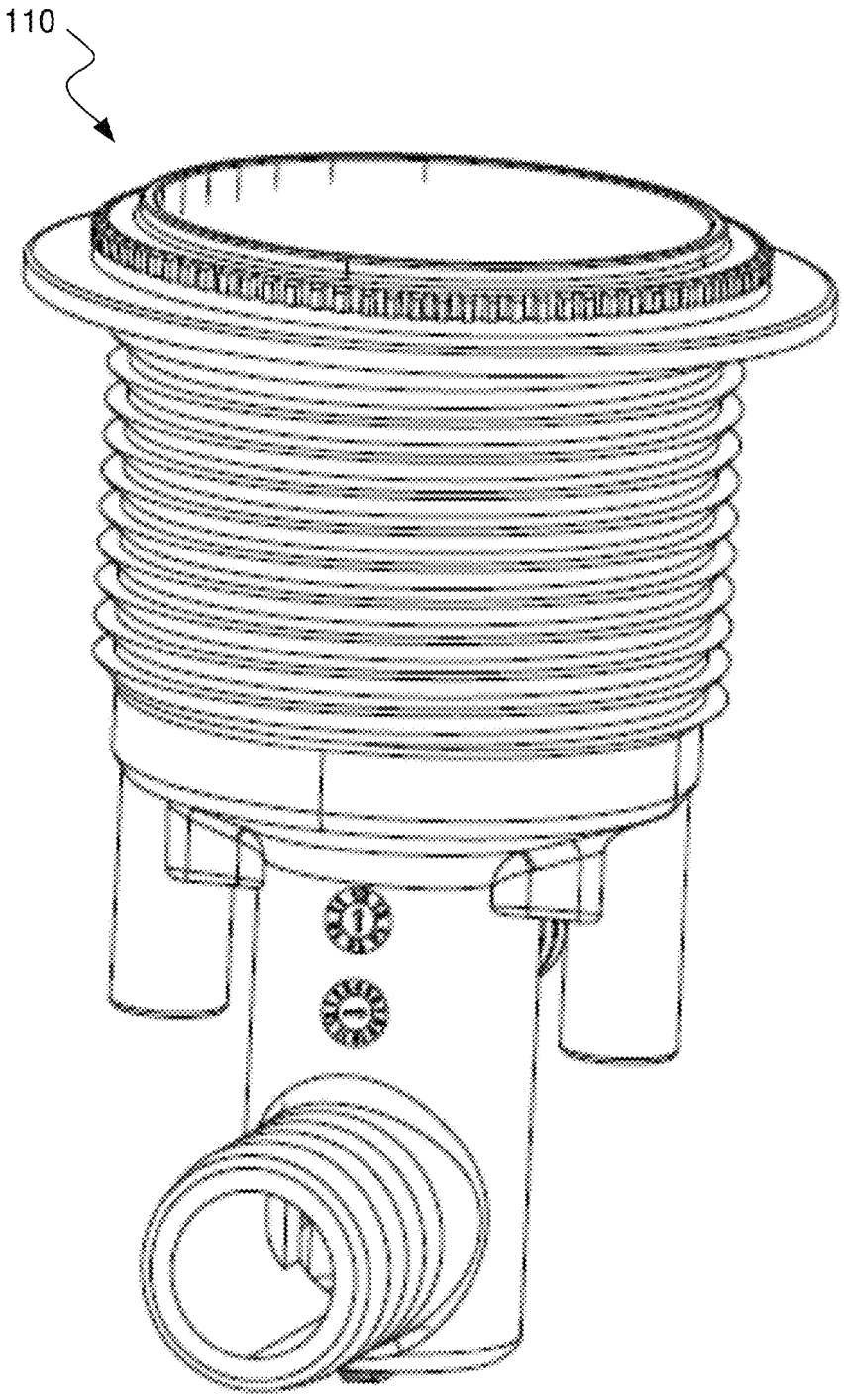
FIG. 22D is a bottom perspective view of the embodiment of FIG. 22A rotated approximately 180 degrees.

FIG. 22A is a side view of another representative embodiment of the low profile threaded/nut style spa jet assembly 110. FIG. 22B is a bottom perspective view of the embodiment of FIG. 22A rotated to the right. FIG. 22C is a top perspective view of the embodiment of FIG. 22A rotated to the left. FIG. 22D is a bottom perspective view of the embodiment of FIG. 22A rotated approximately 180 degrees.

Figure 23A:
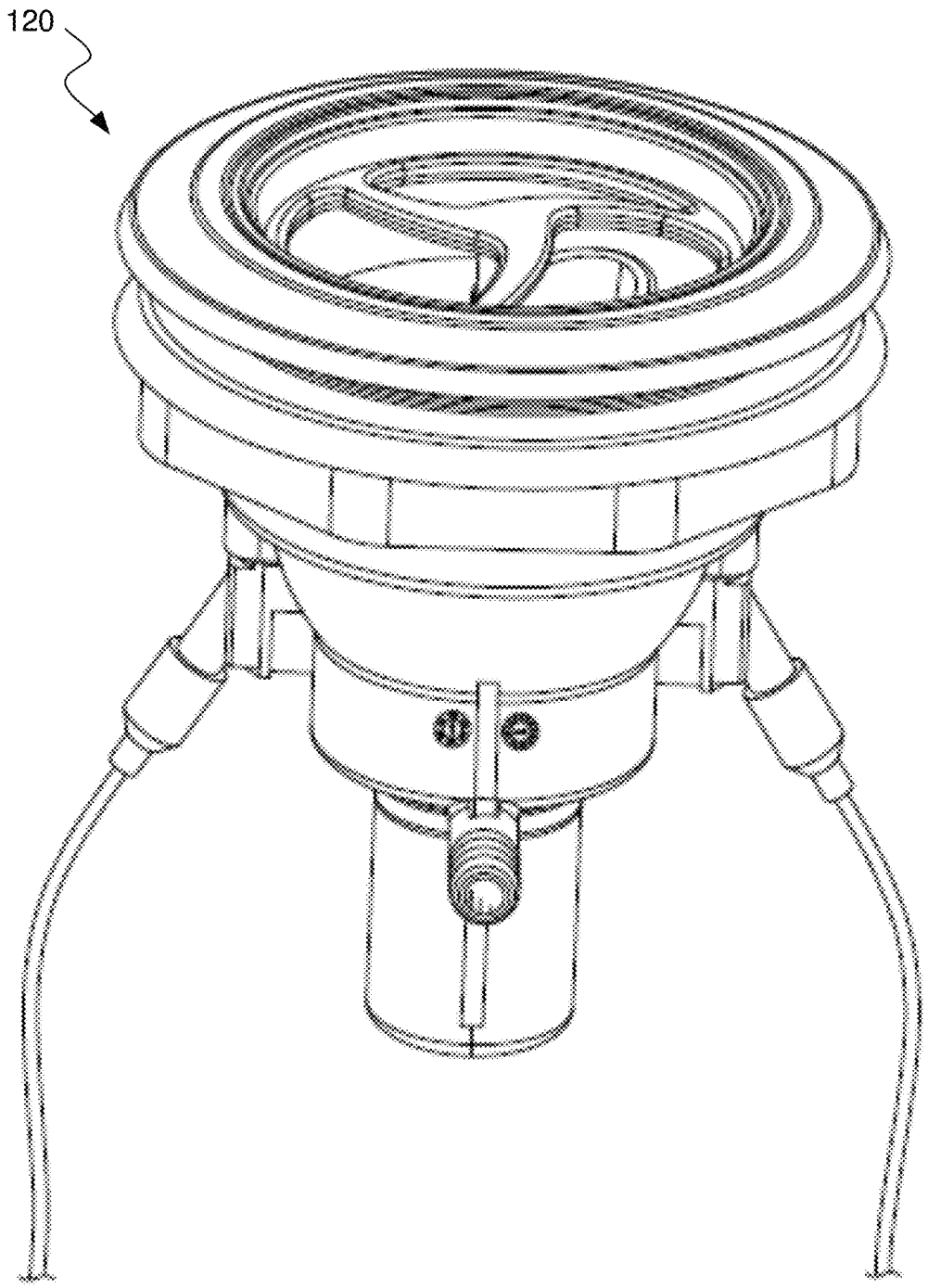
FIG. 23A is a side view of a representative embodiment of the threaded/nut style spa jet assembly having the jet internal assembly shown in FIG. 8A or 8B and having the jet face/flange assembly shown in FIG. 2.
Figure 23B:
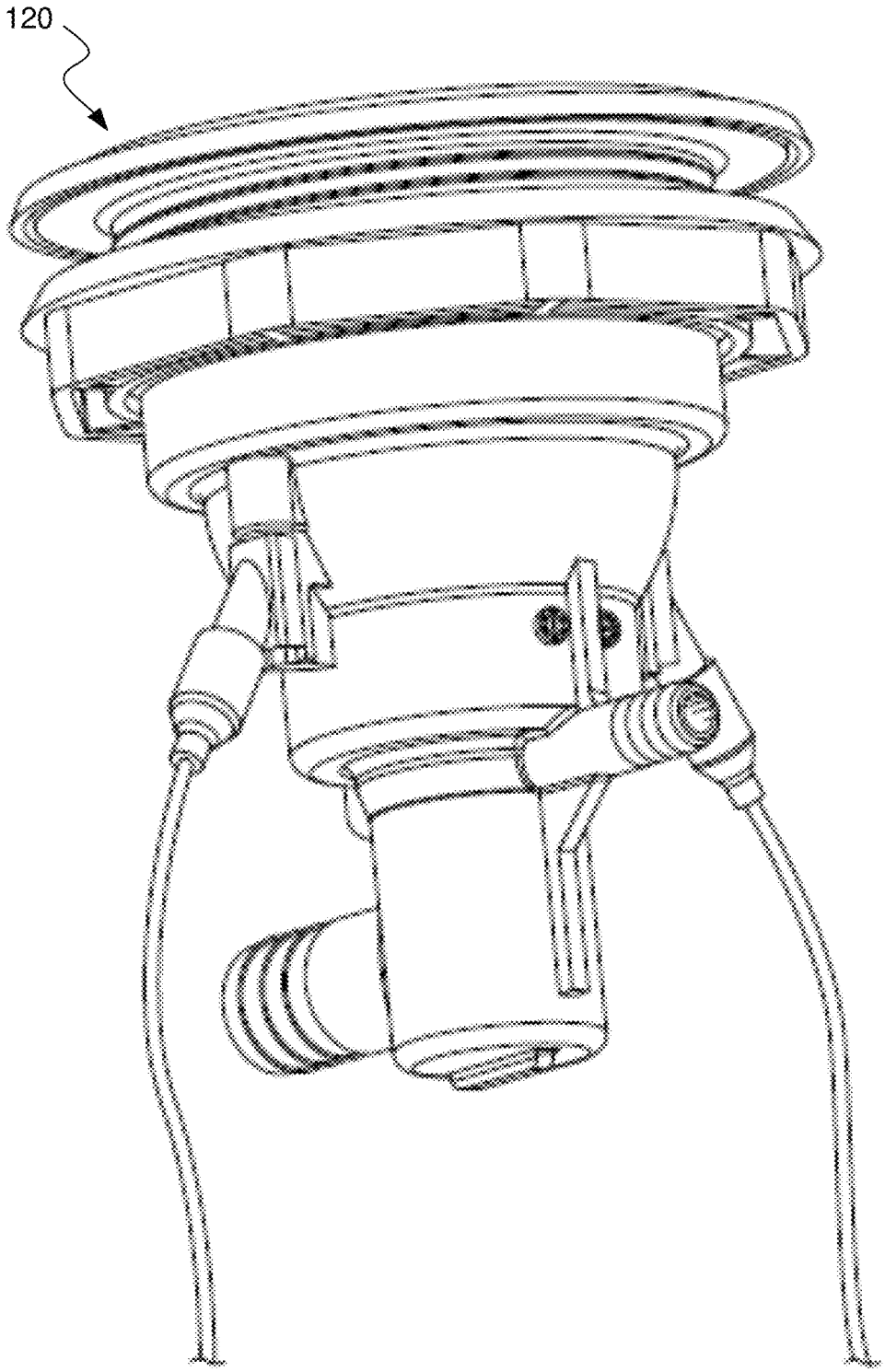
FIG. 23B is a bottom perspective view of the embodiment of FIG. 23A rotated to the right.
Figure 23C:
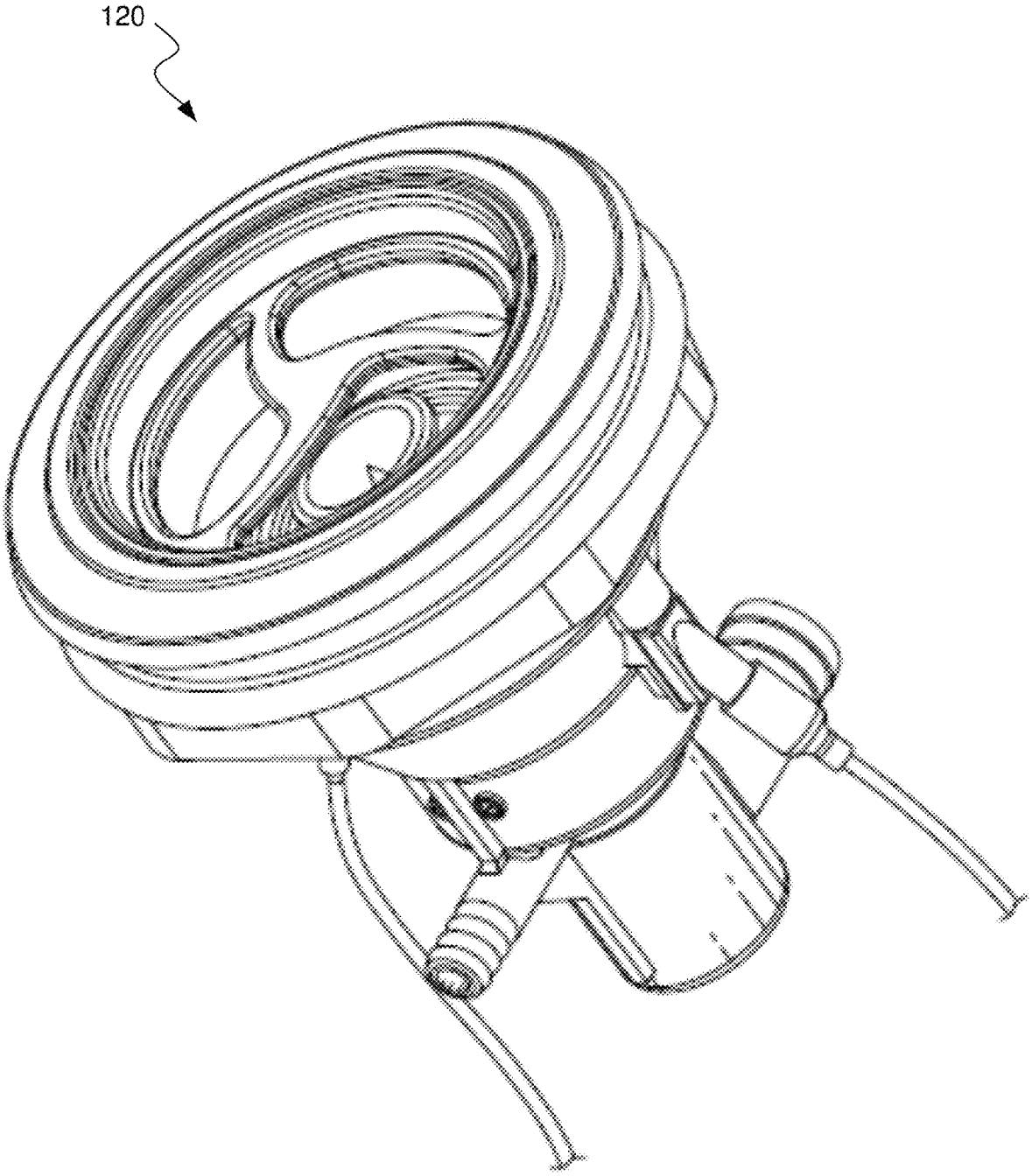
FIG. 23C is a top perspective view of the embodiment of FIG. 23A rotated to the left.
Figure 23D:
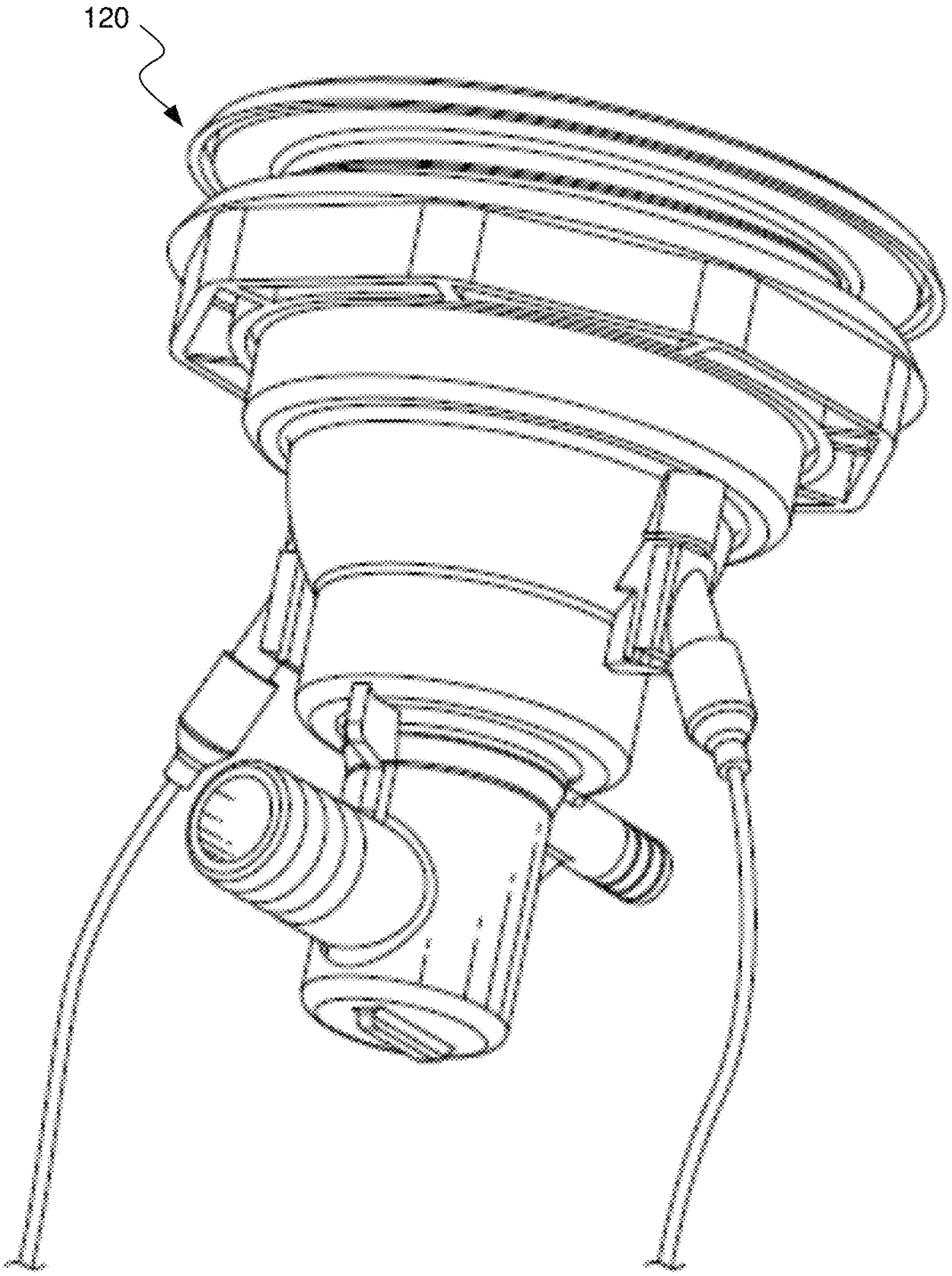
FIG. 23D is a bottom perspective view of the embodiment of FIG. 23A rotated approximately 180 degrees.

FIG. 23A is a side view of a representative embodiment of the low profile threaded/nut style spa jet assembly 120 that can have the jet internal assembly shown in FIG. 8A or 8B and the jet face/flange assembly shown in FIG. 2. FIG. 23B is a bottom perspective view of the embodiment of FIG. 23A rotated to the right. FIG. 23C is a top perspective view of the embodiment of FIG. 23A rotated to the left. FIG. 23D is a bottom perspective view of the embodiment of FIG. 23A rotated approximately 180 degrees.

Figure 24A:
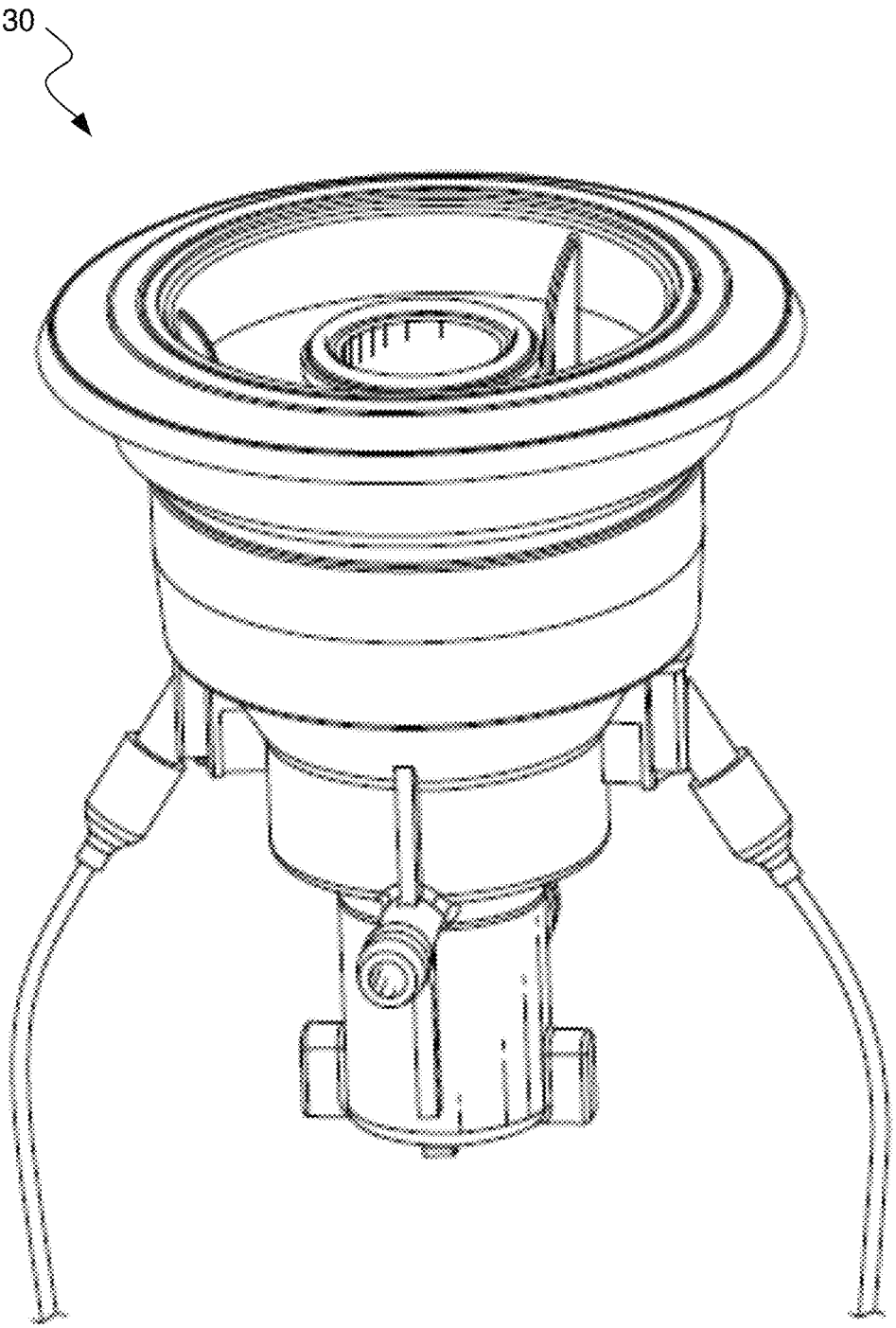
FIG. 24A is a side view of a representative of the grommet style spa jet assembly comprising the jet internal assembly shown in FIGS. 8A and 8B and the jet face/flange assembly shown in, for example, FIG. 1, 8B, 18D, or 19C.
Figure 24B:
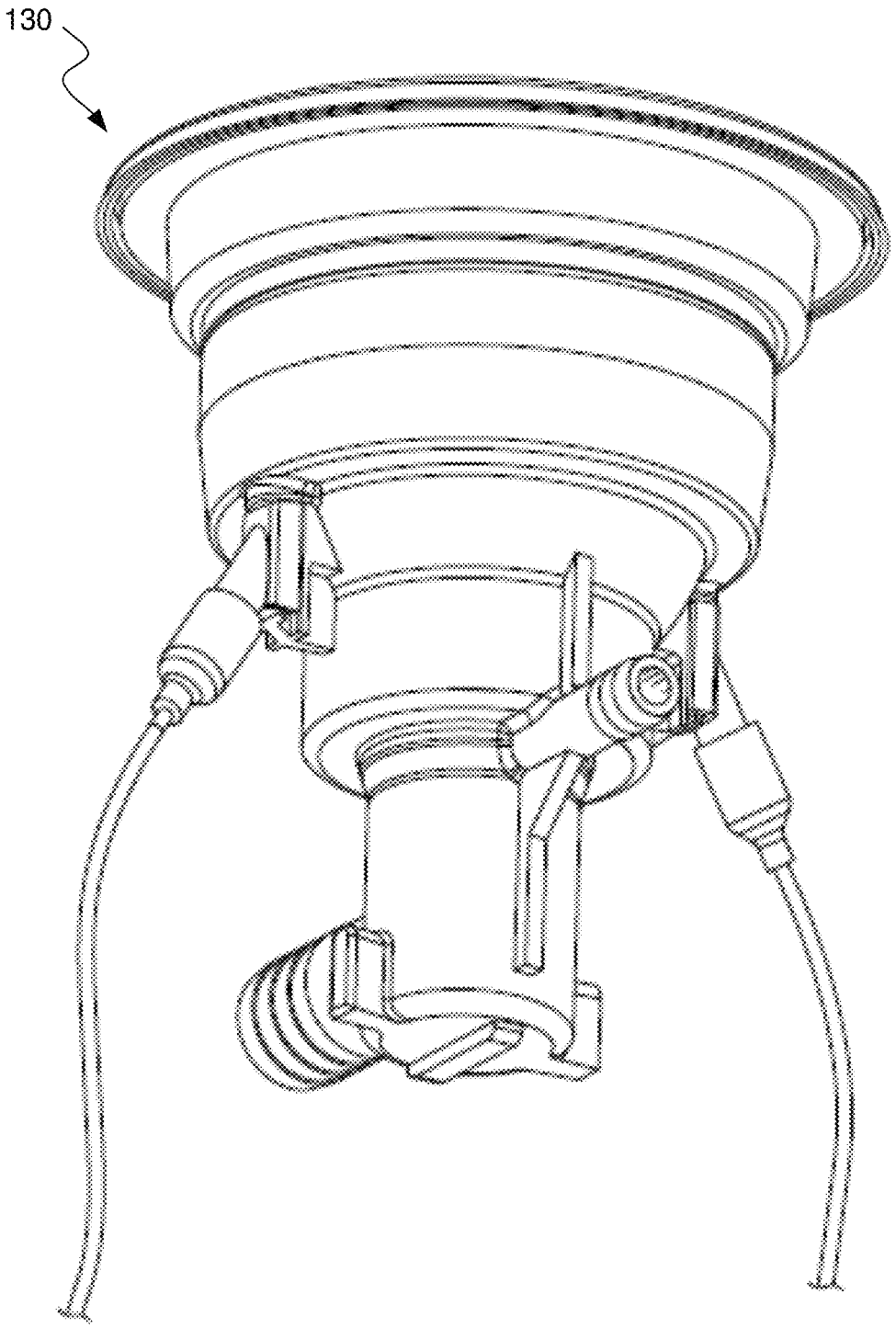
FIG. 24B is a bottom perspective view of the embodiment of FIG. 24A rotated to the right.
Figure 24C:
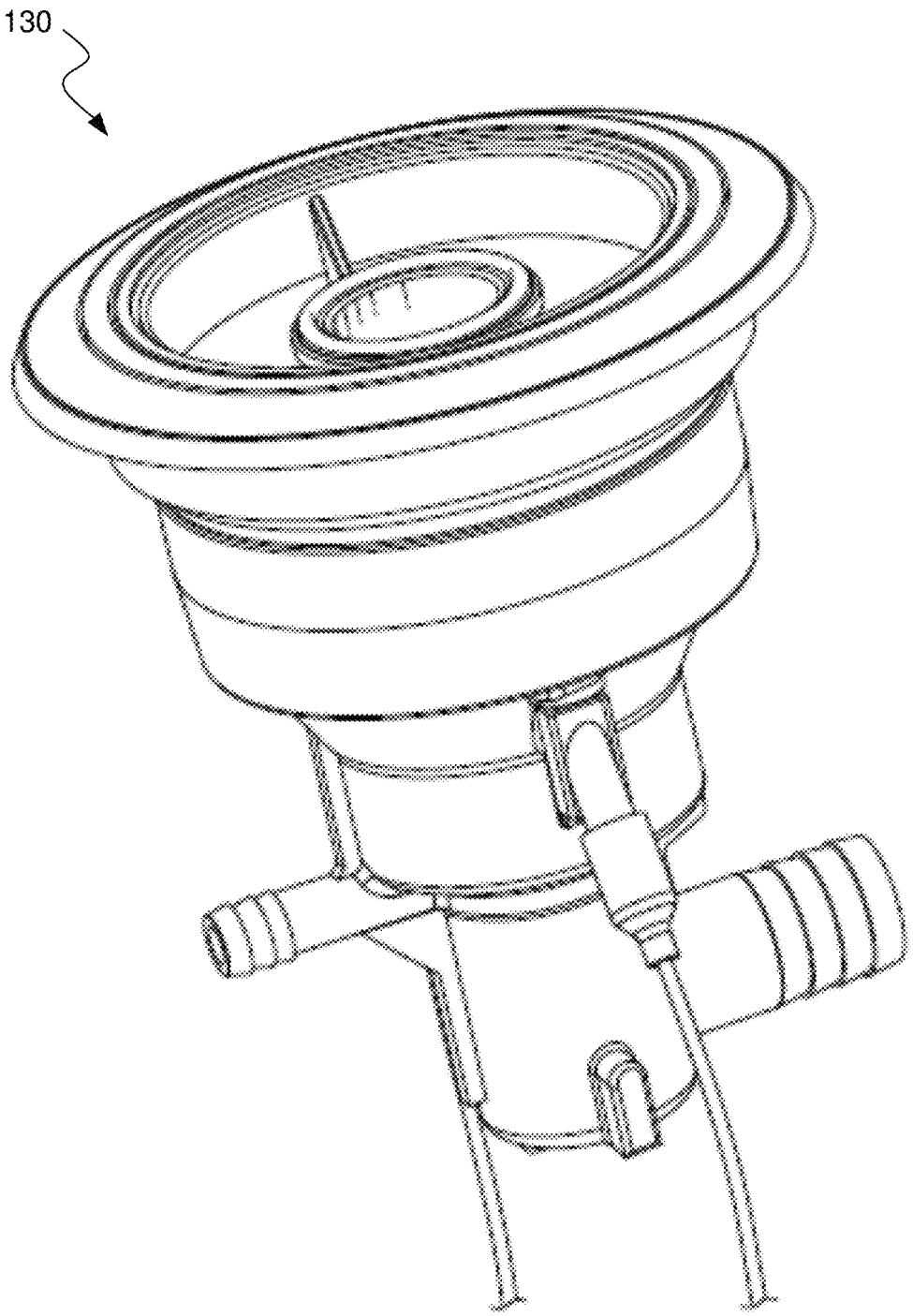
FIG. 24C is a top perspective view of the embodiment of FIG. 24A rotated to the left.
Figure 24D:
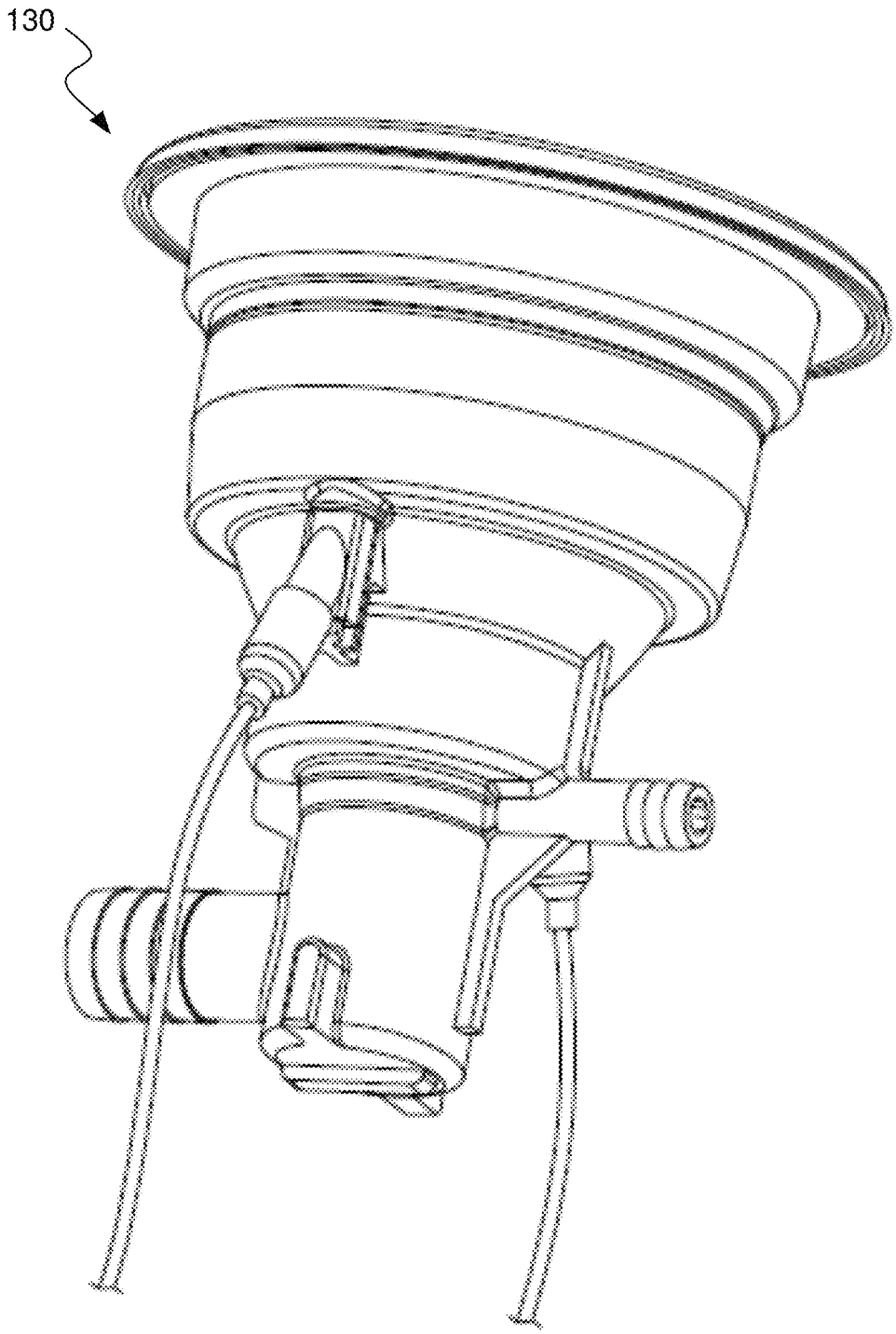
FIG. 24D is a bottom perspective view of the embodiment of FIG. 24A rotated approximately 180 degrees.

FIG. 24A is a side view of a representative of the low profile grommet style spa jet assembly 130 that can comprise the jet internal assembly shown in FIGS. 8A and 8B and the jet face/flange assembly shown in, for example, FIG. 1, 8B, 18D, or 19C. FIG. 24B is a bottom perspective view of the embodiment of FIG. 24A rotated to the right. FIG. 24C is a top perspective view of the embodiment of FIG. 24A rotated to the left. FIG. 24D is a bottom perspective view of the embodiment of FIG. 24A rotated approximately 180 degrees.

Figure 25A:
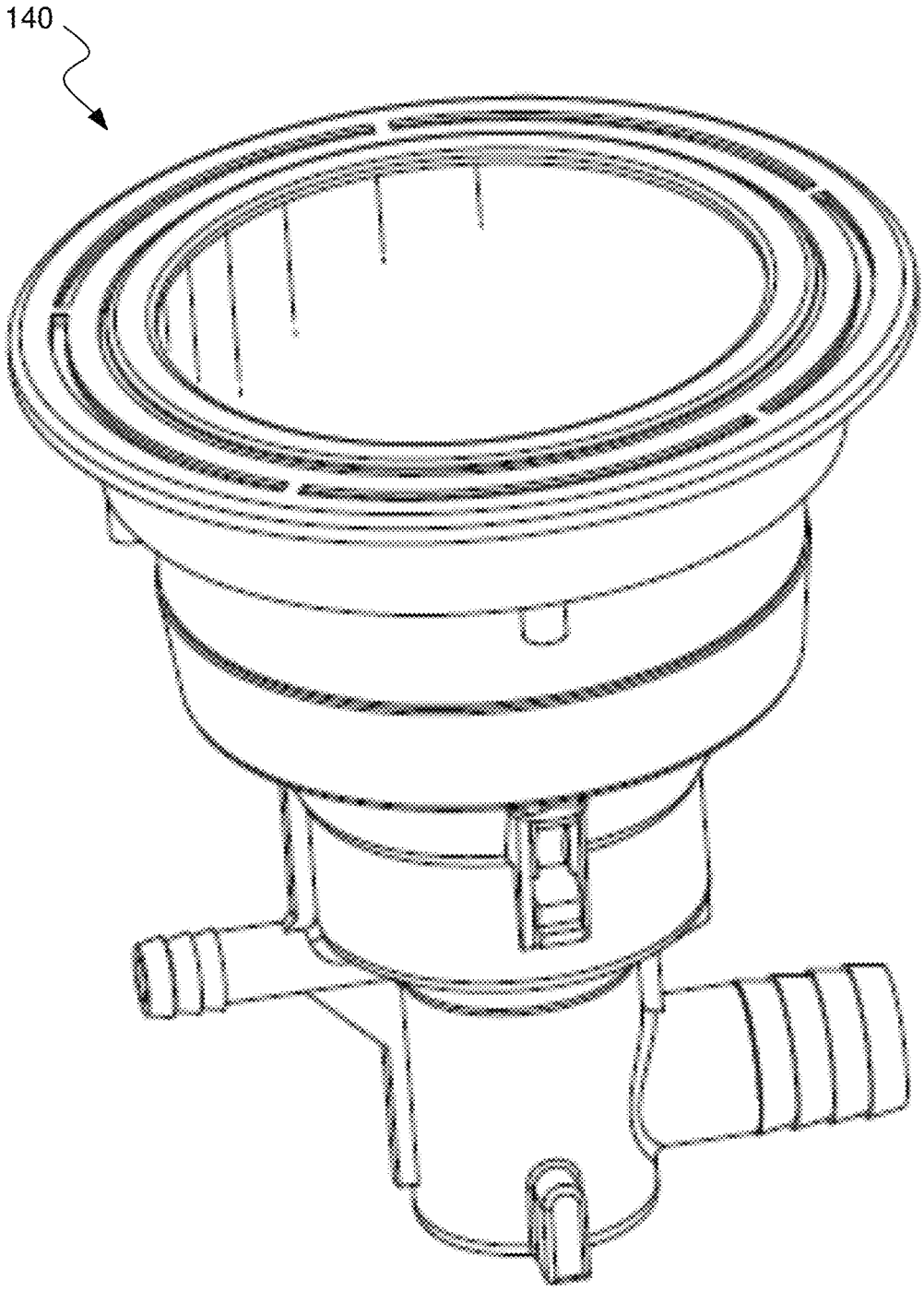
FIG. 25A is a side view of a representative embodiment of the grommet style spa jet assembly comprising the jet internal assembly and the jet face/flange assembly shown in FIG. 19C.
Figure 25B:
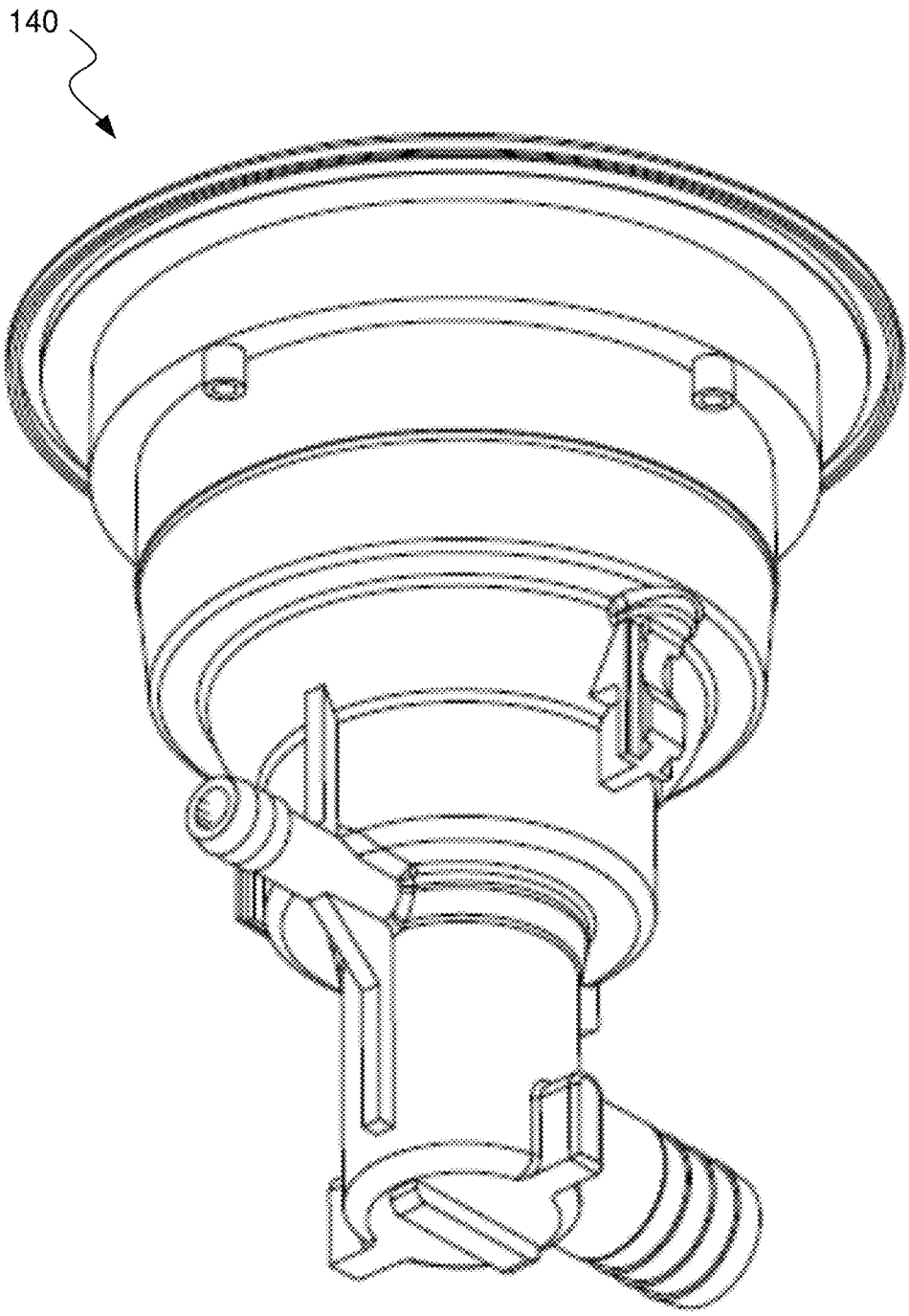
FIG. 25B is a bottom perspective view of the embodiment of FIG. 25A rotated to the right.
Figure 25C:
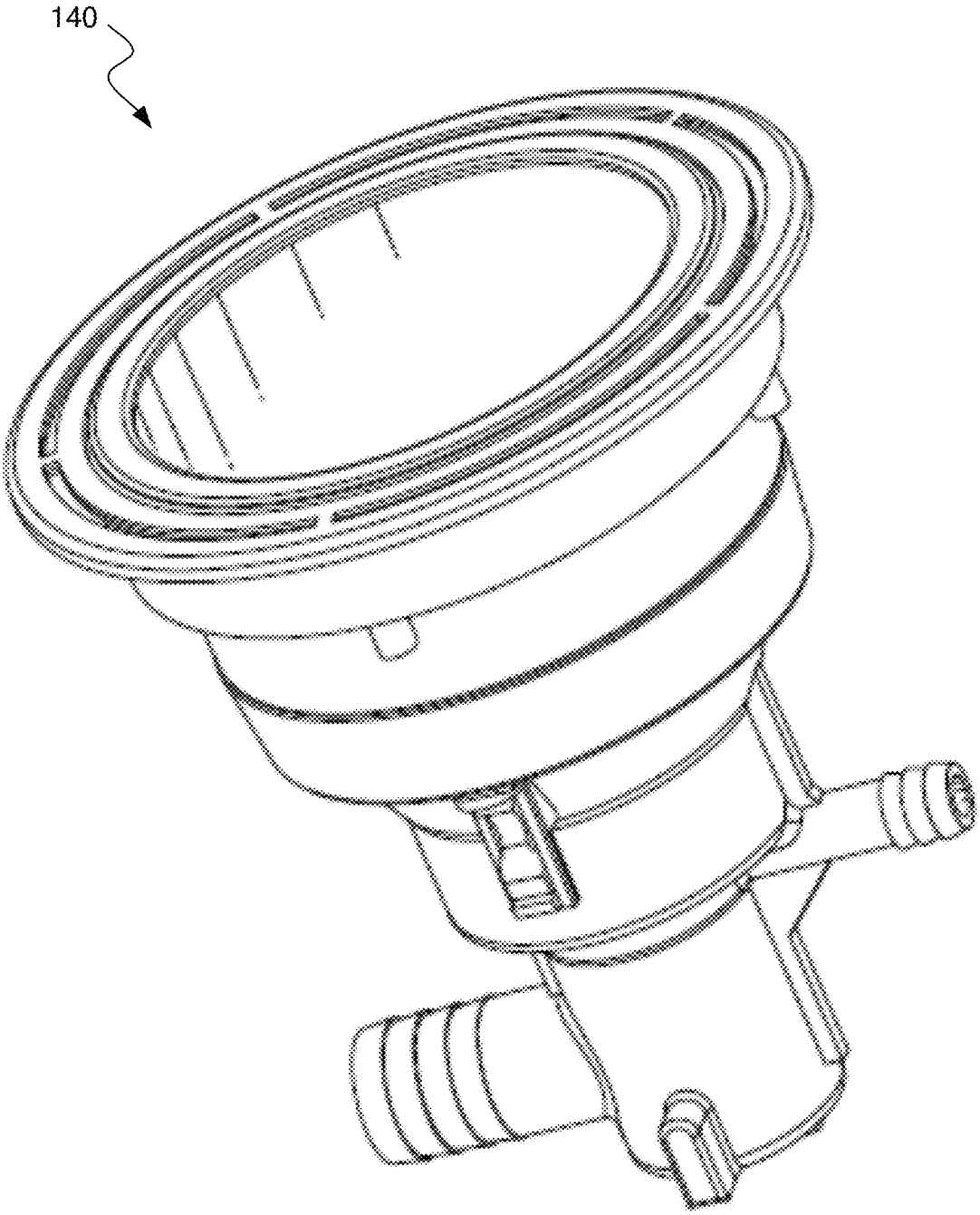
FIG. 25C is a top perspective view of the embodiment of FIG. 25A rotated to the left.
Figure 25D:
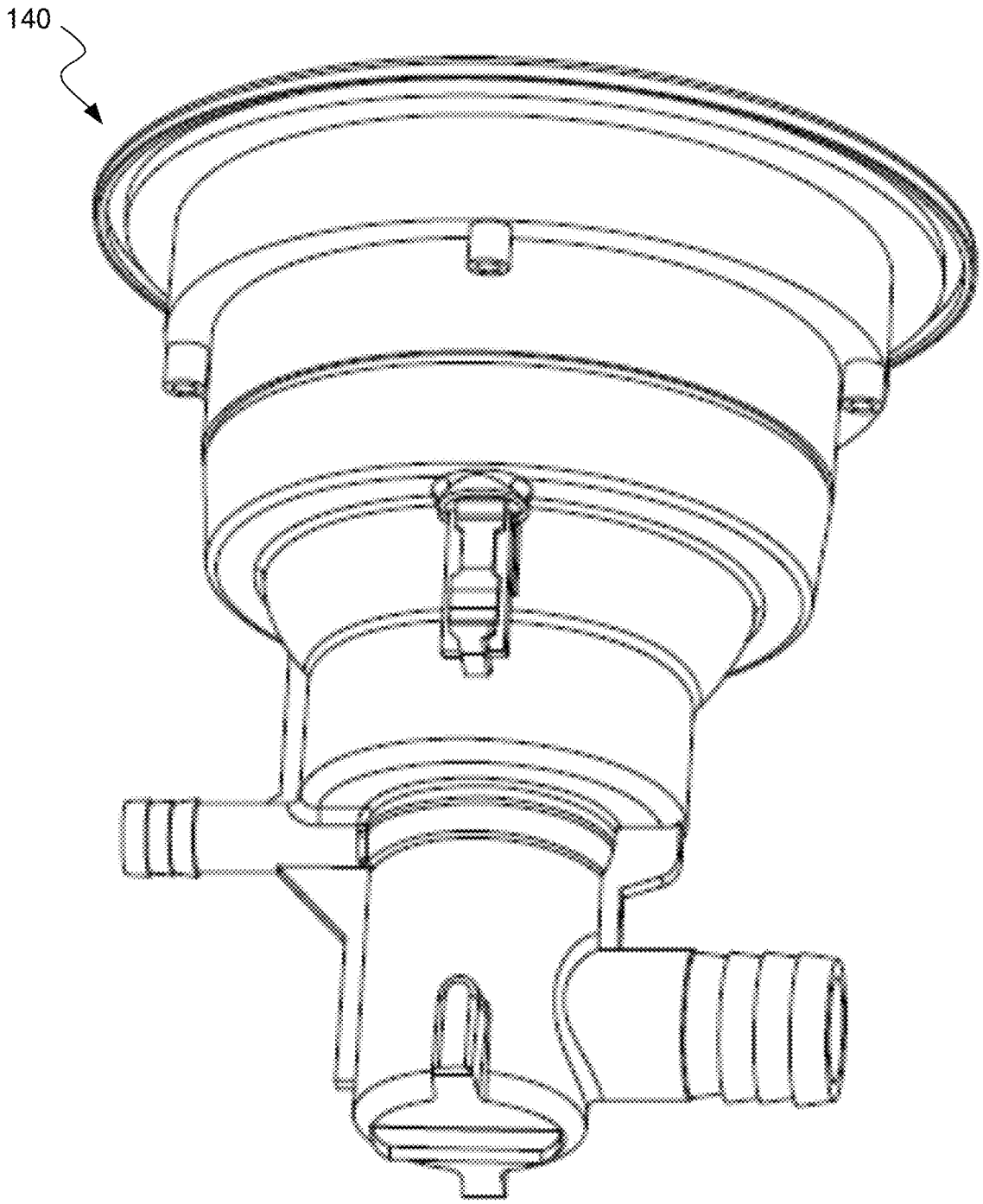
FIG. 25D is a bottom perspective view of the embodiment of FIG. 25A rotated approximately 180 degrees.

FIG. 25A is a side view of a representative embodiment of the low profile grommet style spa jet assembly 140 that can comprise the jet internal assembly and the jet face/flange assembly shown in FIG. 19C. FIG. 25B is a bottom perspective view of the embodiment of FIG. 25A rotated to the right. FIG. 25C is a top perspective view of the embodiment of FIG. 25A rotated to the left. FIG. 25D is a bottom perspective view of the embodiment of FIG. 25A rotated approximately 180 degrees.

Figure 26A:
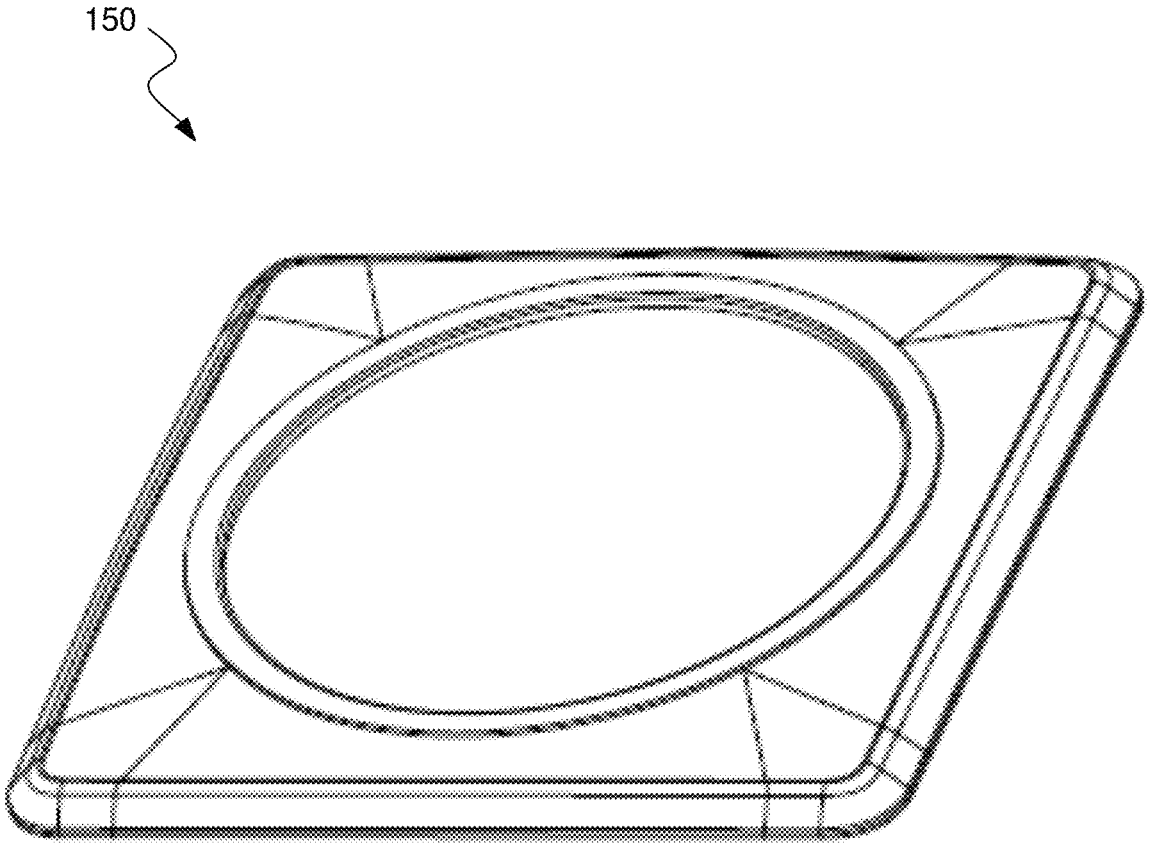
FIG. 26A is a top perspective view of a square low profile jet face/flange assembly for comparison to the round low profile jet face/flange assemblies shown herein.
Figure 26B:
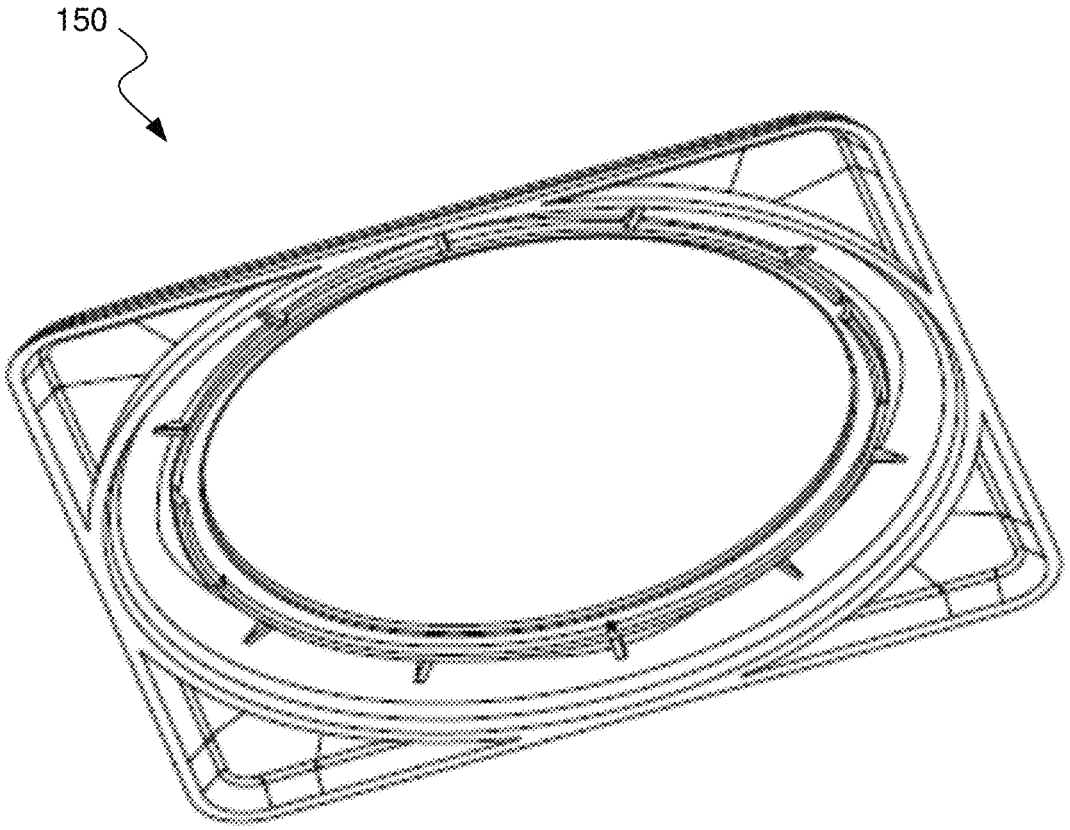
FIG. 26B is a bottom perspective view of the square low profile jet face of FIG. 26A.
Figure 26C:
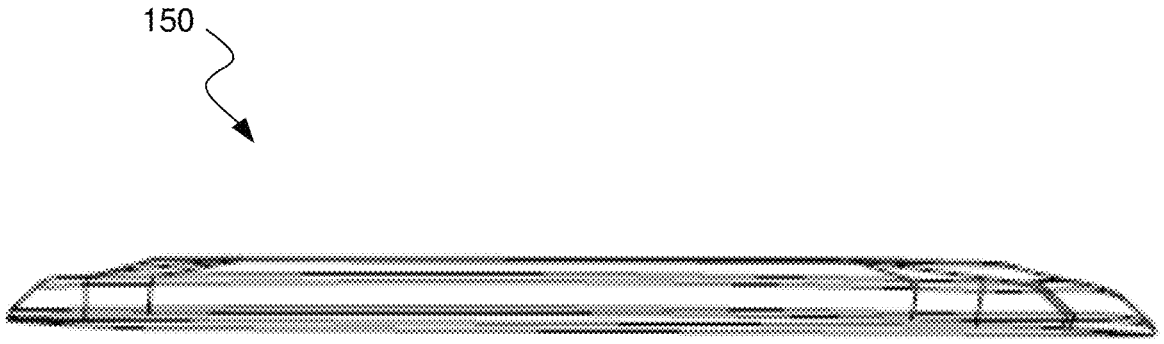
FIG. 26C is a side view of the square low profile jet face/flange assembly of FIG. 26A.

FIG. 26A is a top perspective view of a square low profile jet face/flange assembly 150 for comparison to the round low profile jet face/flange assemblies shown herein. FIG. 26B is a bottom perspective view of the square low profile jet face/flange assembly 150 of FIG. 26A. FIG. 26C is a side view of the square low profile jet face/flange assembly 150 of FIG. 26A.

Figure 27A:
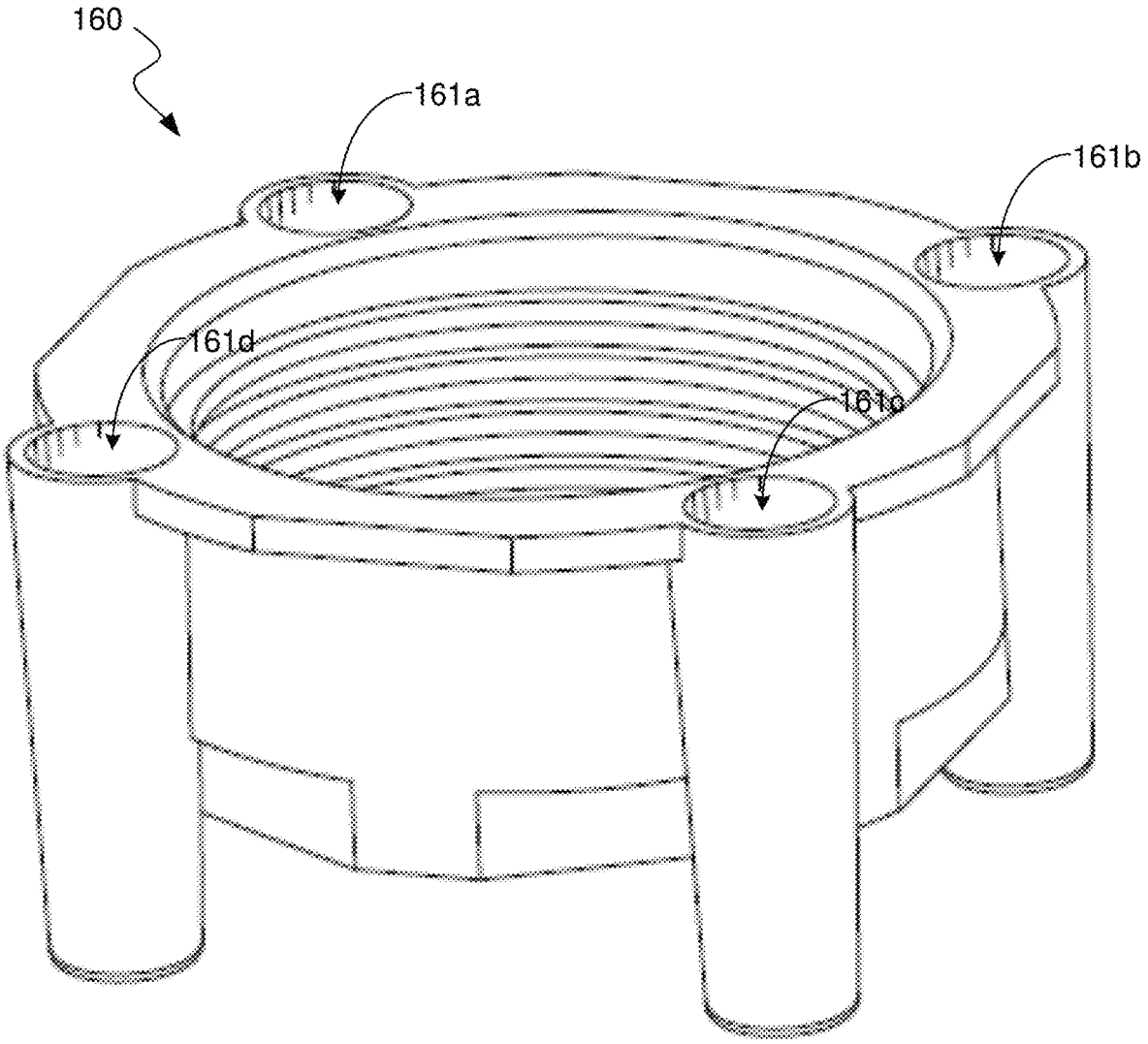
FIG. 27A is top perspective view of a LED-containing nut for use in connection with the threaded/nut style spa jet assemblies shown herein.
Figure 27B:
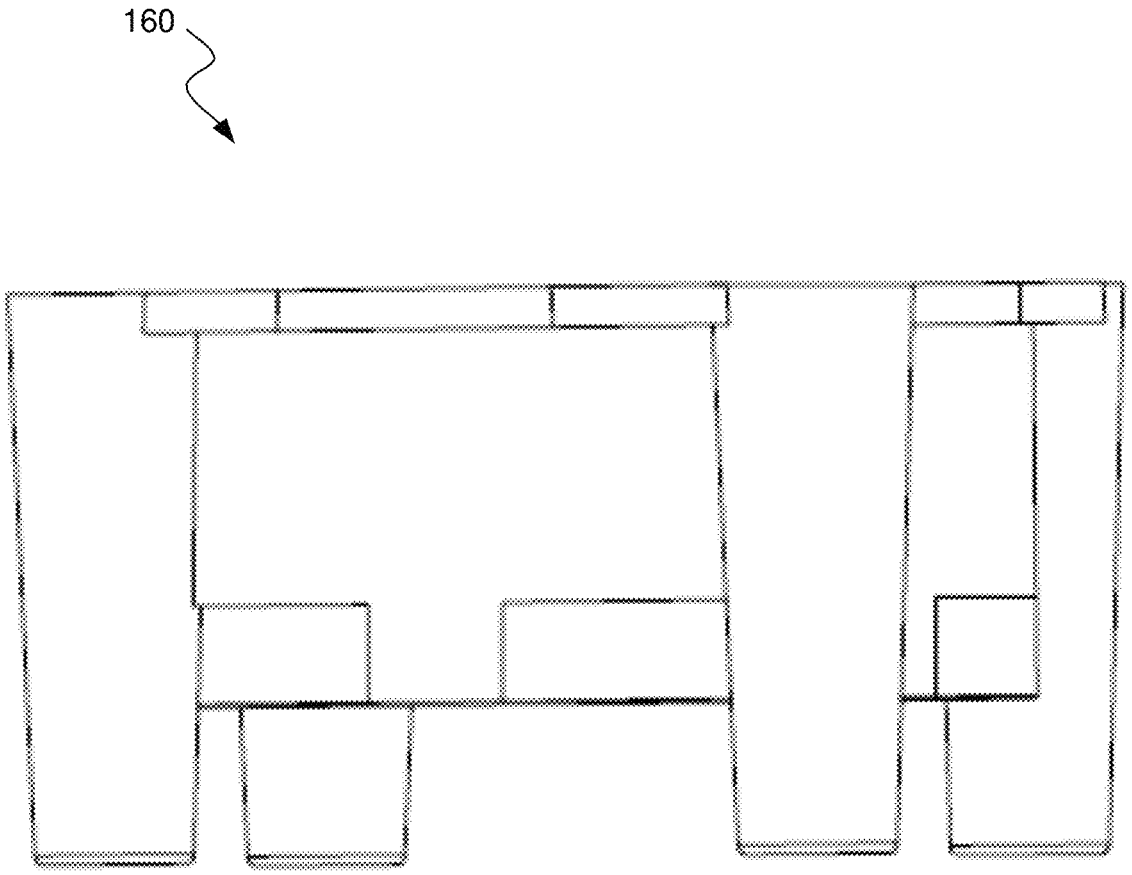
FIG. 27B is a side view of the LED-containing nut of FIG. 27A.
Figure 27C:
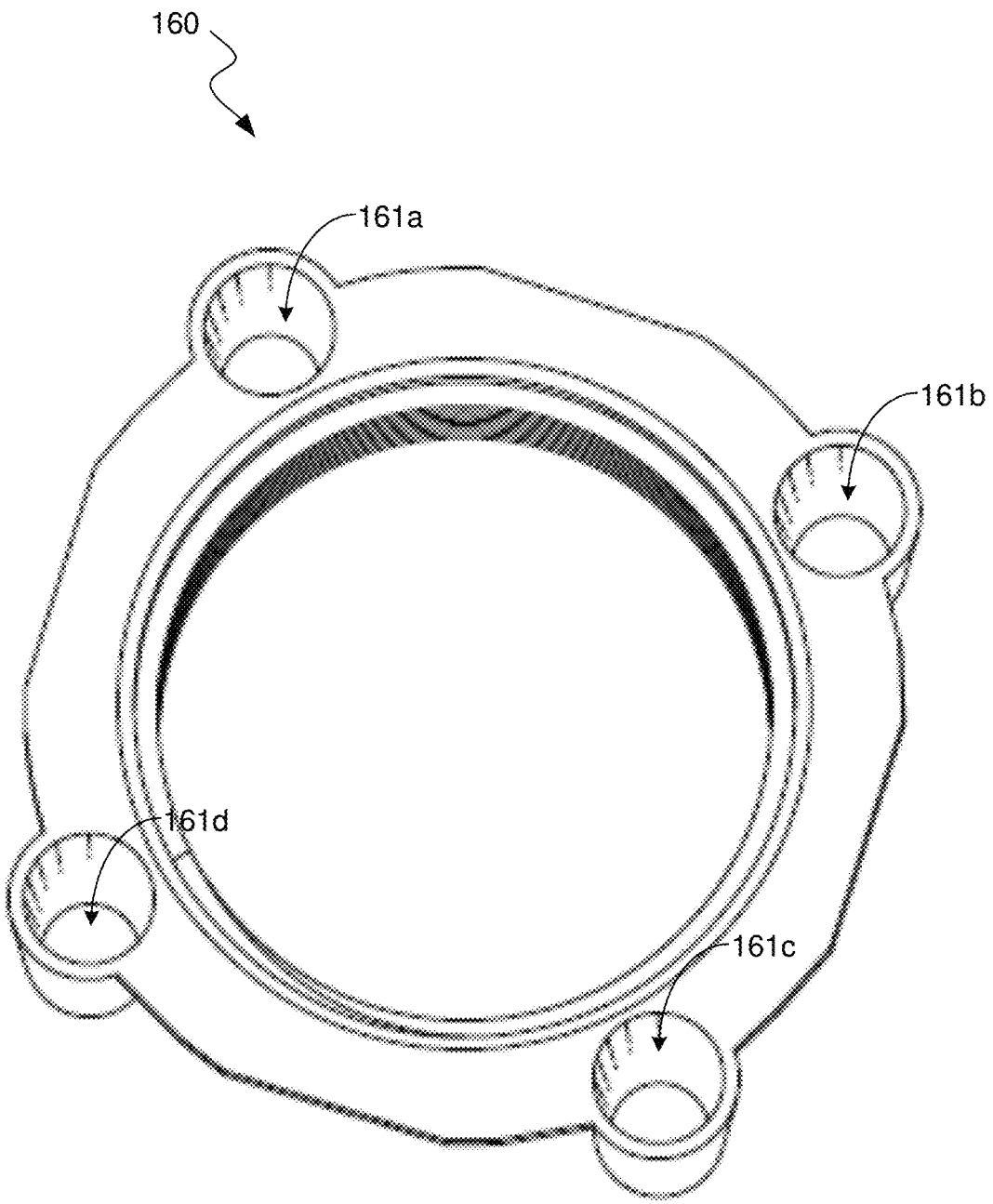
FIG. 27C is top view of the LED-containing nut of FIG. 27A.
Figure 27D:
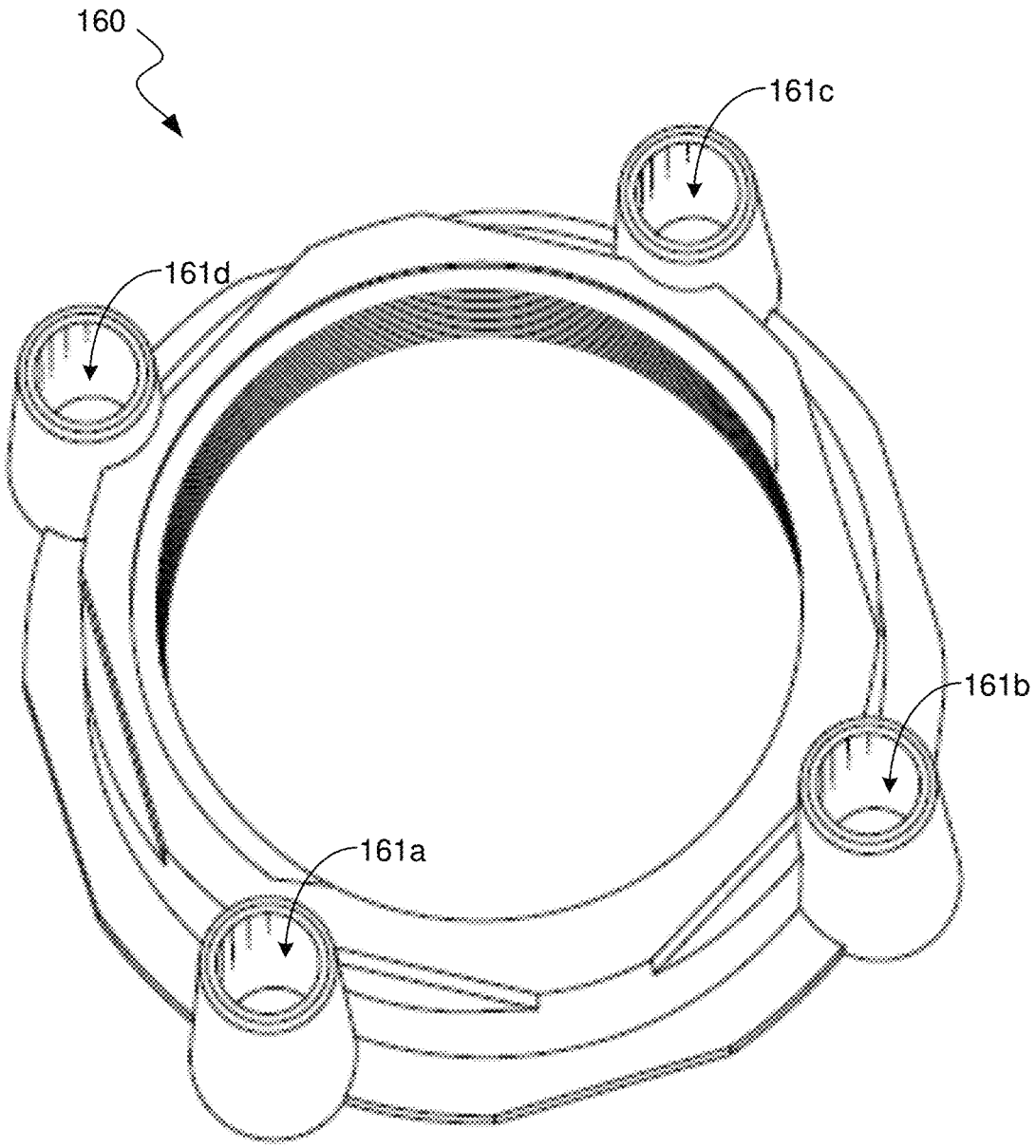
FIG. 27D is a bottom view of the LED-containing nut of FIG. 27A.

FIG. 27A is top perspective view of a LED-containing nut 160 that is suitable for use in connection with the low profile threaded/nut style spa jet assemblies described above and shown herein. FIG. 27B is a side view of the LED-containing nut of FIG. 27A. FIG. 27C is top view of the LED-containing nut of FIG. 27A. FIG. 27D is a bottom view of the LED-containing nut of FIG. 27A.

The LED-containing nut 160 can be threaded onto, for example, the male threaded portion 22 of the jet housing 20*a* shown in FIG. 5, in which case the nut 160 replaces the nut 20*d* shown in FIG. 6. The nut 160 in accordance with this embodiment comprises four LED ports 161*a*-161*d* in which LEDs can be disposed. Light emitted by the LEDs passes out of the ports 161*a*-161*d* and is incident on the jet face/flange assembly. The nut 160 can be made of a translucent or transparent material such that light emitted by the LEDs would pass through the side walls of the nut 160 and into the interior region of the jet housing where it is coupled into the jets produced by the spa jet assembly.

The various embodiments described herein are provided by way of example and are not intended to limit the scope of the disclosure. The described embodiments comprise different features, not all of which are required in all embodiments of the disclosure. Some embodiments of the present disclosure utilize only some of the features or possible combinations of the features.

Variations of embodiments of the present disclosure that are described, and embodiments of the present disclosure comprising different combinations of features as noted in the described embodiments, will occur to persons with ordinary skill in the art. It will be appreciated by persons with ordinary skill in the art that the present disclosure is not limited by what has been particularly shown and described herein above. Rather the scope of the invention is defined by the appended claims.

In the claims, means-plus-function clauses are intended to cover the structures described herein as performing the recited function and not only structural equivalents, but also equivalent structures. Thus, it is the express intention of the applicant not to invoke 35 USC § 112(f) for any limitations of any of the claims herein, except for those in which the claim expressly uses the words "means for" together with an associated function.

Therefore, although selected aspects have been illustrated and described in detail, it will be understood that various substitutions and alterations may be made therein without departing from the spirit and scope of the present disclosure, as defined by the following claims.

What is claimed is:

1. A low profile spa jet assembly comprising:

a) a jet housing, a jet housing flange, and a jet face/flange assembly, wherein the jet housing flange is removably securable to the jet face/flange assembly such that the jet housing flange is disposed in between a spa wall and a bottom surface of the jet face/flange assembly, the jet housing comprising an internal region, the jet housing further comprising at least one of an air connection and a water connection configured to be connected to an external air connection and an external water connection, respectively, wherein the jet housing is removably secured to the jet face/flange assembly before or after the jet housing has been installed in the spa wall and before or after at least one of the water connection and the air connection of the jet housing has been connected to an external water connection or an external air connection, respectively;

b) a jet internal assembly installed and disposed in the internal region of the jet housing, the jet internal assembly comprising a nozzle configuration, a jet barrel, and a diffuser, the diffuser interfacing with said at least one of an air connection and a water connection of the jet housing; and c) a spa wall interface configuration configured to couple the jet housing to the spa wall.

2. The low profile spa jet assembly of claim 1, wherein the spa wall interface configuration comprises a grommet, wherein when the low profile spa jet assembly is in a fully installed state in the spa wall, a flange of the grommet is disposed in between the jet housing flange and the spa wall.

3. The low profile spa jet assembly of claim 1, wherein the spa wall interface configuration comprises a threaded/nut configuration, the jet housing having a threaded configuration on a portion thereof adjacent the jet housing flange configured to threadingly engage a threaded nut of the threaded/nut configuration wherein when the low profile spa jet assembly is in a fully installed state in the spa wall, the spa wall is disposed in between the jet housing flange and the threaded nut.

4. The low profile spa jet assembly of claim 1, wherein the jet housing flange is configured to be removably secured to different jet face/flange assemblies having different configurations before or after the jet housing has been coupled to the spa wall by the spa wall interface configuration and before or after the internal jet assembly has been installed in the jet housing without altering a distance between the spa wall and an outer surface of the jet face/flange assembly that is removably secured to the jet housing, the distance being in a direction substantially normal to the outer surface of the jet face/flange assembly that is removably secured to the jet housing.

5. The low profile spa jet assembly of claim 4, wherein the distance is less than 0.5 inches.

6. The low profile spa jet assembly of claim 4, wherein after a first jet face/flange assembly has been removably coupled to the jet housing flange, the first jet face/flange assembly is decoupled from the jet housing flange and a second jet face/flange assembly having a different configuration from the first jet face/flange assembly is removably coupled to the jet housing flange without decoupling the jet housing from the spa wall and without deinstalling the internal jet assembly from the jet housing, and wherein the distance between the spa wall and an outer surface of the first jet face/flange assembly when the first jet face/flange assembly is removably secured to the jet housing is substantially equal to the distance between the spa wall and an outer surface of the second jet face/flange assembly when the second jet face/flange assembly is removably secured to the jet housing.

7. The low profile spa jet assembly of claim 6, wherein the spa wall interface configuration comprises a grommet, wherein when the low profile spa jet assembly is in a fully installed state in the spa wall, a flange of the grommet is disposed in between the jet housing flange and the spa wall.

8. The low profile spa jet assembly of claim 6, wherein the spa wall interface configuration comprises a threaded/nut configuration, the jet housing having a threaded configuration on a portion thereof adjacent the jet housing flange configured to threadingly engage a threaded nut of the threaded/nut configuration wherein when the low profile spa jet assembly is in a fully installed state in the spa wall, the spa wall is disposed in between the jet housing flange and the threaded nut.

9. The low profile spa jet assembly of claim 6, wherein the jet internal assembly is removable and interchangeable with a different jet internal assembly without decoupling the jet face/flange assembly from the jet housing flange.

10. The low profile spa jet assembly of claim 6, wherein the jet face/flange assembly has a clock/turning/rotating feature that is configured to engage a counterpart clock/turning/rotating feature of the jet housing flange to enable the jet face/flange assembly to be rotated relative to the jet housing and locked in preselected angular increments independent of the coupling of the jet housing with the spa wall and independent of positions of said at least one of an air connection and a water connection relative to the external air connection and the external water connection, respectively.

11. The low profile spa jet assembly of claim 10, wherein the preselected angular increments are less than 90-degree increments.

12. The low profile spa jet assembly of claim 10, wherein the preselected angular increments are less than 10-degree increments.

13. The low profile spa jet assembly of claim 10, wherein the preselected angular increments are 4.5-degree increments along at least 45 degrees of a circumference of the jet housing.

14. The low profile spa jet assembly of claim 10, wherein the preselected angular increments are 4.5-degree increments along a circumference of the jet housing ranging from between 45 degrees and 90 degrees of the circumference of the jet housing.

15. The low profile spa jet assembly of claim 10, wherein the preselected angular increments are adjustable along at least 180 degrees of the circumference of the jet housing.

16. The low profile spa jet assembly of claim 10, wherein the preselected angular increments are adjustable along at least 135 degrees of the circumference of the jet housing.

17. The low profile spa jet assembly of claim 1, further comprising at least one lighting element disposed on a dry side of the spa wall and optically coupled to at least one of the jet housing and the spa wall interface configuration, wherein at least a portion of at least one of the jet housing and the spa wall interface configuration is translucent or transparent to allow light emitted by said at least one lighting element to illuminate the jet face/flange assembly.

18. The low profile spa jet assembly of claim 17, wherein the jet face/flange assembly comprises an opening or slit through which the light emitted by said at least one lighting element passes.

19. The low profile spa jet assembly of claim 17, wherein the opening or slit comprises at least one design element that is illuminated by the light emitted by said at least one lighting element.

20. A method for installing low profile spa jet assemblies in a spa, the method comprising installing at least first and second low profile spa jet assemblies in a spa wall of the spa, the first and second low profile spa jet assemblies each comprising:

a) a jet housing, a jet housing flange, face/flange assembly such that the jet housing flange is disposed in between a spa wall and a bottom surface of the jet face/flange assembly, the jet housing comprising an internal region, wherein the jet housing is and a jet face/flange assembly, wherein the jet housing flange is removably securable to the jet removably secured to the jet face/flange assembly;

b) a jet internal assembly installed and disposed in the internal region of the jet housing, the jet internal assembly comprising a nozzle configuration, a jet barrel, and a diffuser, the diffuser interfacing with at least one of an air connection and a water connection of the jet housing; and c) a spa wall interface configuration configured to couple the jet housing to the spa wall, wherein the jet face/flange assembly of the first low profile spa jet assembly and the jet face/flange assembly of the second low profile spa jet assembly are different from one another, and wherein a distance between the spa wall and an outer surface of the jet face/flange assembly of the first low profile spa jet assembly in a direction substantially normal to the spa wall at an installation location of the first low profile spa jet assembly is substantially equal to a distance between the spa wall and an outer surface of the jet face/flange assembly of the second low profile spa jet assembly in a direction substantially normal to the spa wall at an installation location of the second low profile spa jet assembly.

21. The method of claim 20, wherein the jet housing is configured to be removably secured to the jet face/flange assembly before or after the jet housing has been installed in the spa wall and before or after the at least one of a water connection and an air connection of the jet housing has been connected to the external water connection or the external air connection, respectively, and wherein said at least one of an air connection and a water connection is configured to be connected to an external air connection and an external water connection, respectively.

22. The method of claim 21, wherein the spa wall interface configuration of the first low profile spa jet assembly comprises a grommet, wherein a flange of the grommet is disposed in between the jet housing flange of the first low profile spa jet assembly and the spa wall at the installation location of the first low profile spa jet assembly, and wherein the spa wall interface configuration of the second low profile spa jet assembly comprises a threaded/nut configuration, the jet housing of the second low profile spa jet assembly having a threaded configuration on a portion thereof configured to threadingly engage a threaded nut of the threaded/nut configuration, wherein the spa wall is disposed in between the jet housing flange of the second low profile spa jet assembly and the threaded nut at the installation location of the second low profile spa jet assembly.

23. A method for installing low profile spa jet assemblies in a spa, the method comprising installing at least first and second low profile spa jet assemblies in a spa wall of the spa, the first and second low profile spa jet assemblies each comprising:

a) a jet housing between a spa wall and a bottom surface of the jet face/flange assembly, the jet housing comprising an internal region, wherein the jet housing is, a jet housing flange, and a jet face/flange assembly, wherein the jet housing flange is removably securable to the jet face/flange assembly such that the jet housing flange is disposed in to be removably secured to the jet face/flange assembly before or after the jet housing has been installed in the spa wall and before or after at least one of a water connection and an air connection of the jet housing has been connected to an external water connection or an external air connection, respectively, and wherein the internal region of the jet housing is configured to receive and house a jet internal assembly;

b) a jet internal assembly installed and disposed in the internal region of the jet housing, the jet internal assembly comprising a nozzle configuration, a jet barrel, and a diffuser, the diffuser interfacing with said at least one of an air connection and a water connection of the jet housing; and c) a spa wall interface configuration configured to couple the jet housing to the spa wall, wherein the jet face/flange assembly of the first low profile spa jet assembly and the jet face/flange assembly of the second low profile spa jet assembly are the same, and wherein a distance between the spa wall and an outer surface of the jet face/flange assembly of the first low profile spa jet assembly in a direction substantially normal to the spa wall at an installation location of the first low profile spa jet assembly is substantially equal to a distance between the spa wall and an outer surface of the jet face/flange assembly of the second low profile spa jet assembly in a direction substantially normal to the spa wall at an installation location of the second low profile spa jet assembly.

24. The method of claim 23, wherein the spa wall interface configuration of the first low profile spa jet assembly comprises a grommet, wherein a flange of the grommet is disposed in between the jet housing flange of the first low profile spa jet assembly and the spa wall at the installation location of the first low profile spa jet assembly, and wherein the spa wall interface configuration of the second low profile spa jet assembly comprises a threaded/nut configuration, the jet housing of the second low profile spa jet assembly having a threaded configuration on a portion thereof configured to threadingly engage a threaded nut of the threaded/nut configuration, wherein the spa wall is disposed in between the jet housing flange of the second low profile spa jet assembly and the threaded nut at the installation location of the second low profile spa jet assembly.

* * * * *